US011592167B1

(12) United States Patent
Callahan

(10) Patent No.: US 11,592,167 B1
(45) Date of Patent: Feb. 28, 2023

(54) DISTRIBUTABLE DIMMER PACKAGE HAVING A SIX-CIRCUIT OUTPUT CONNECTOR AND RE-CONFIGURABLE POWER INPUT

(71) Applicant: Michael Callahan, New York, NY (US)

(72) Inventor: Michael Callahan, New York, NY (US)

( * ) Notice: Subject to any disclaimer, the term of this patent is extended or adjusted under 35 U.S.C. 154(b) by 1405 days.

(21) Appl. No.: 15/215,675

(22) Filed: Jul. 21, 2016

Related U.S. Application Data

(63) Continuation of application No. 14/676,616, filed on Apr. 1, 2015, now abandoned.

(60) Provisional application No. 61/973,592, filed on Apr. 1, 2014.

(51) Int. Cl.

| | |
|---|---|
| ***F21V 23/00*** | (2015.01) |
| ***E04C 3/02*** | (2006.01) |
| ***F21S 8/04*** | (2006.01) |
| ***F21S 2/00*** | (2016.01) |
| ***H05B 47/105*** | (2020.01) |
| *F21V 21/088* | (2006.01) |
| *F21V 17/00* | (2006.01) |
| *F21V 21/30* | (2006.01) |
| *E04C 3/04* | (2006.01) |

(52) U.S. Cl.
CPC ..... *F21V 23/009* (2013.01); *E04C 3/02* (2013.01); *F21S 2/00* (2013.01); *F21S 8/043* (2013.01); *H05B 47/105* (2020.01); *E04C 2003/0495* (2013.01); *F21V 17/007* (2013.01); *F21V 21/088* (2013.01); *F21V 21/30* (2013.01)

(58) Field of Classification Search
CPC .... F21V 23/009; F21V 17/007; F21V 21/088; F21V 21/30; H05B 47/105
See application file for complete search history.

(56) References Cited

U.S. PATENT DOCUMENTS

| | | | |
|---|---|---|---|
| 3,562,994 | A | 2/1971 | Linsowe |
| 3,783,573 | A | 1/1974 | Vanghan |
| 4,335,556 | A | 6/1982 | Arnold |
| 4,829,739 | A | 5/1989 | Coppa |
| 5,390,463 | A | 2/1995 | Sollner |
| 5,711,131 | A | 1/1998 | Thomas |
| 6,026,626 | A | 2/2000 | Fisher |
| 6,408,587 | B2 | 6/2002 | Cronin et al. |
| 6,672,792 | B1 | 1/2004 | Schipani et al. |
| 6,715,255 | B2 | 4/2004 | Schipani et al. |
| 7,716,897 | B2 | 5/2010 | Merrifield |
| 8,028,488 | B2 | 10/2011 | Dodd |
| 8,667,633 | B2 | 3/2014 | Le La Chevrotiere |
| 2004/0000117 | A1 | 1/2004 | Schipani et al. |

(Continued)

*Primary Examiner* — Anne M Hines
(74) *Attorney, Agent, or Firm* — Davidson Davidson and Kappel, LLC

(57) ABSTRACT

An improved dimming apparatus is disclosed. Major economies are achieved by the ability to distribute groups of dimmers in proximity to the lamp loads that they control. Variations in the location and distance between the apparatus and lamp loads, as well as in the differing connector types installed on such loads, are addressed by terminating the six power stages contained in a common enclosure in a six-circuit multi-pole connector, such that a variety of prior art "break-out" adaptors between said multi-pole connector and individual circuit connectors can be selected among. The power input to the enclosure can be made re-configurable.

6 Claims, 56 Drawing Sheets

(56) References Cited

U.S. PATENT DOCUMENTS

| | | | |
|---|---|---|---|
| 2004/0244327 | A1 | 12/2004 | Stonecypher |
| 2014/0190095 | A1 | 7/2014 | De La Chevrotiere |

75
76
77
78
79
80
81

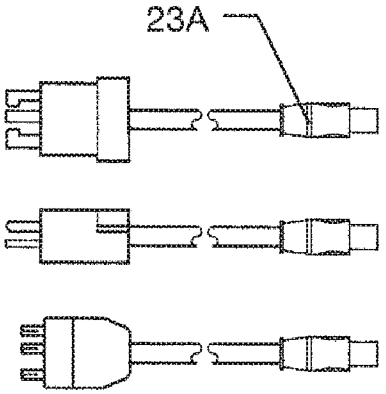
Fig.24A
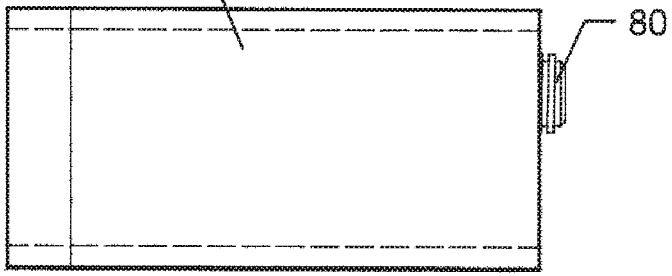
Fig.24B
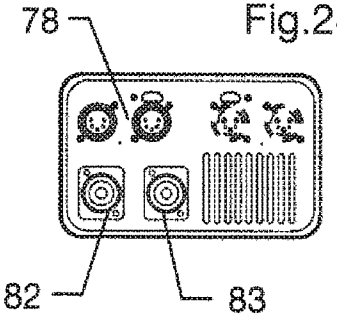
Fig.24C
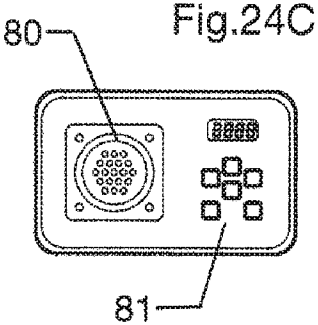
Fig.24D
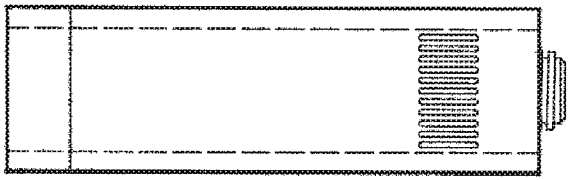

Fig.26B
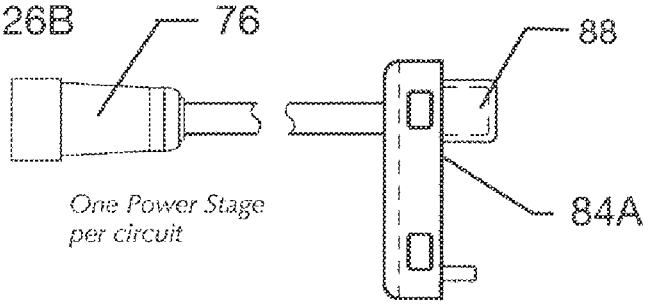
Fig.26C
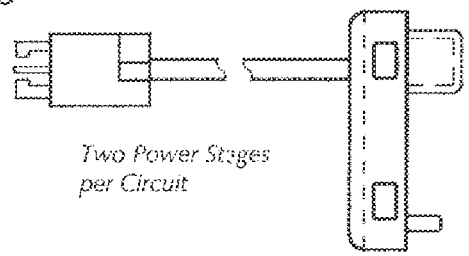
Fig.26A
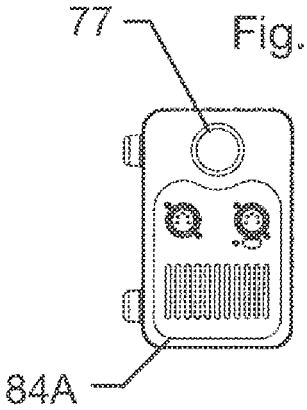
Fig.26D
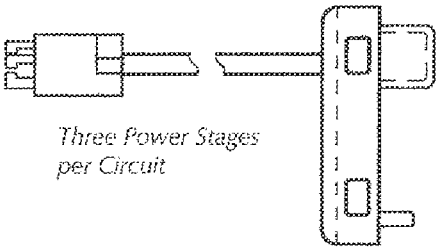
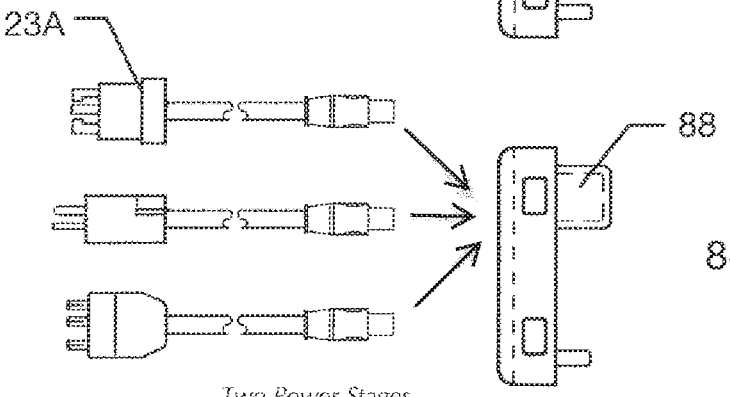
Fig.26F
Fig.26E
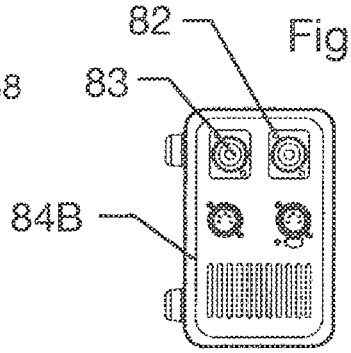

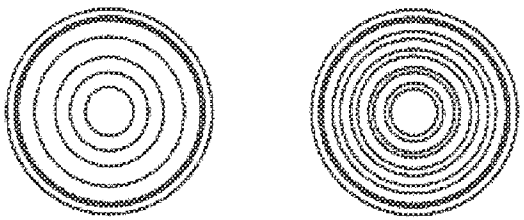
Fig.33D
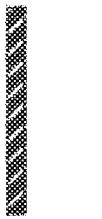
Fig.33B
Fig.33E
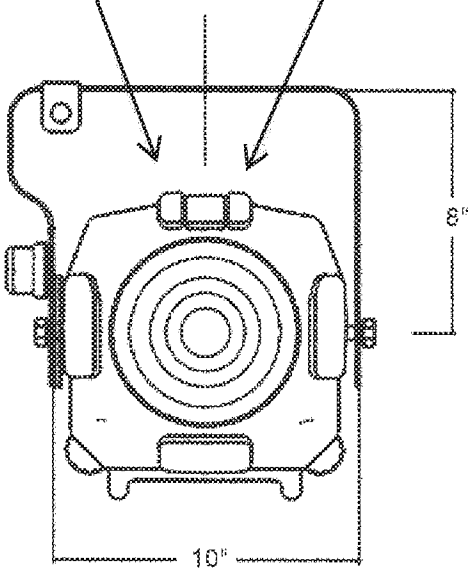
Fig.33C
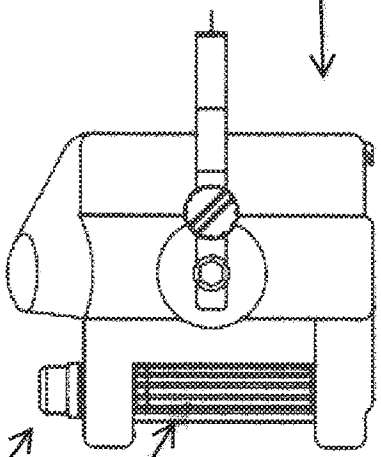
Fig.33A

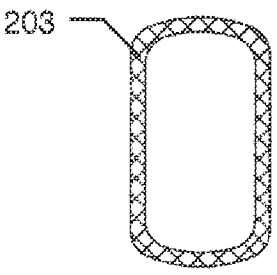
Fig.34A
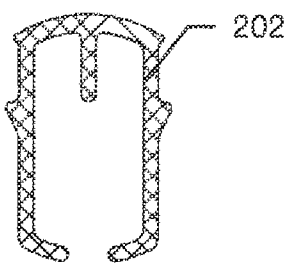
Fig.34B
Fig.34C
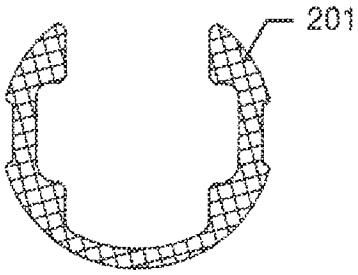
Fig.34D
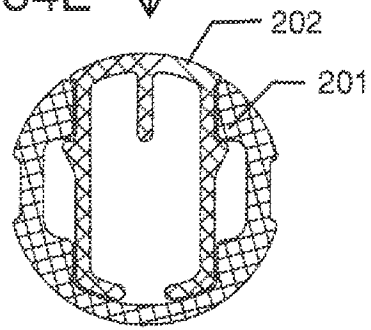
Fig 34E
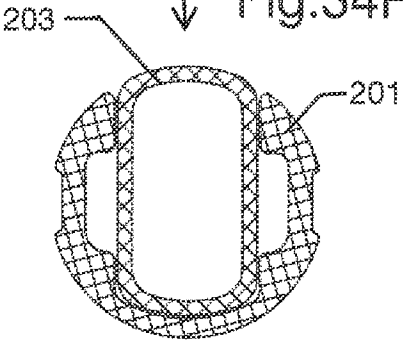
Fig.34F 203
203

201

203A

203B 203H
203A
203B
201H
201

203

203

204
201

203
204
201

204

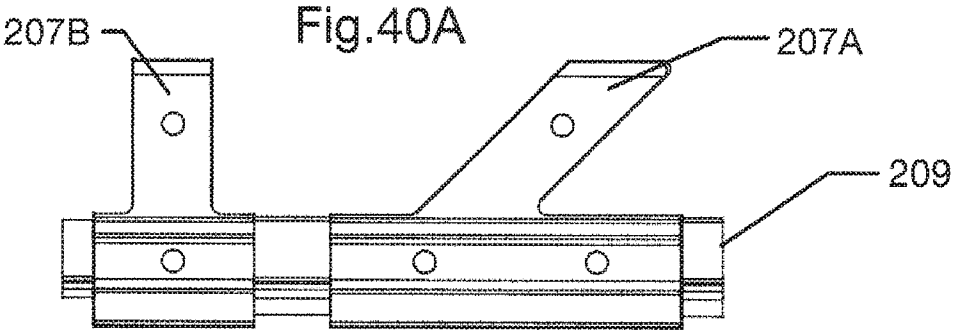
Fig.40A
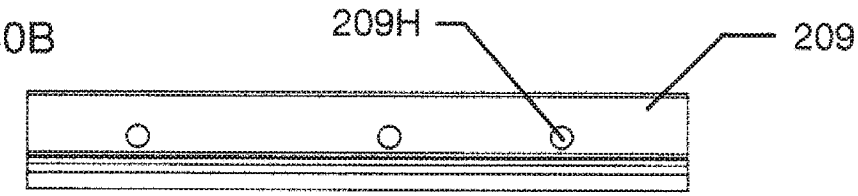
Fig.40B
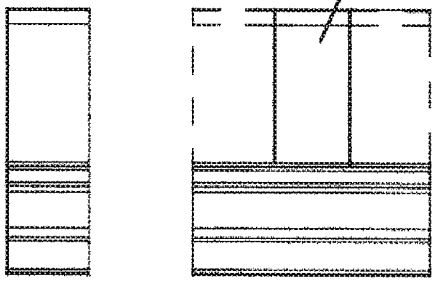
Fig.40C
Fig.40D
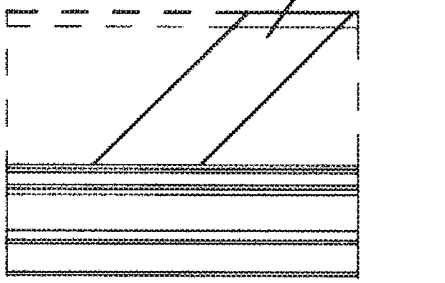
Fig.40E

203

203
205
210
205
201

203

203
201
205

203D
203

Fig.45A
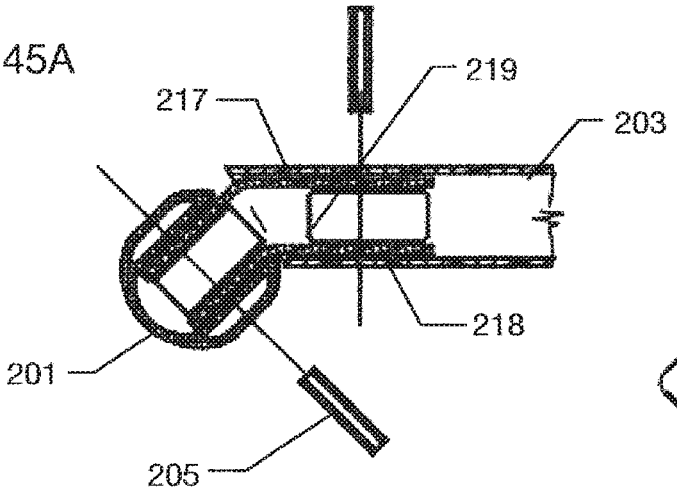
Fig.45B
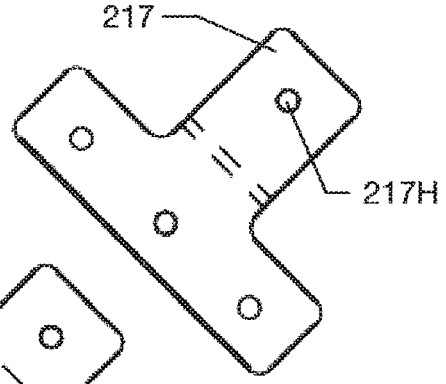
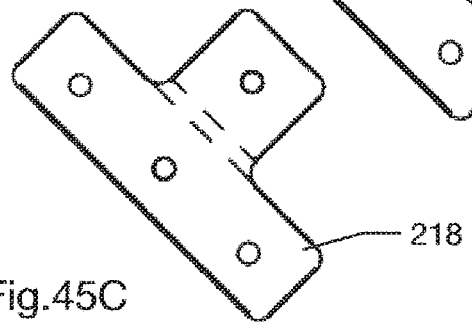
Fig.45C

Fig.46A
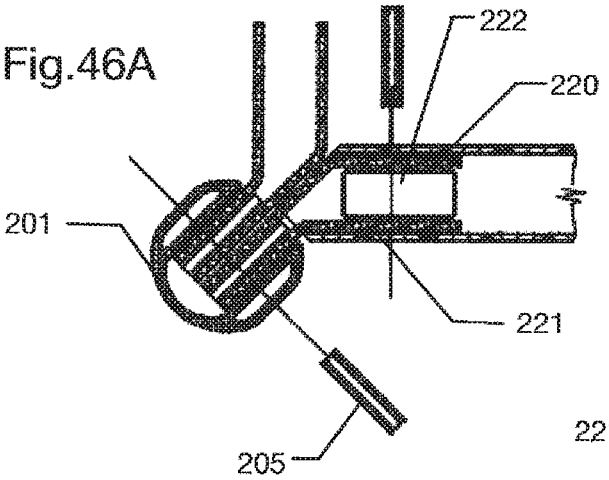
Fig.46B
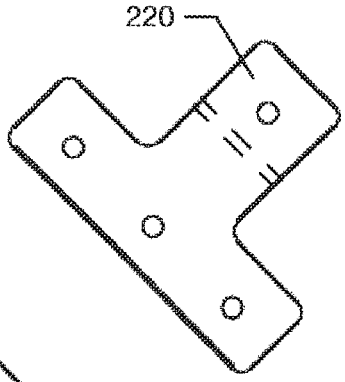
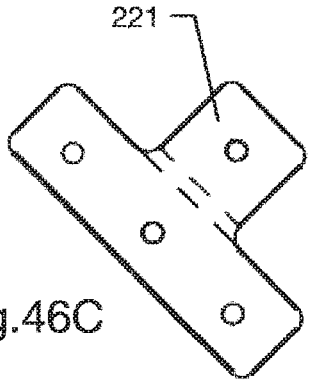
Fig.46C

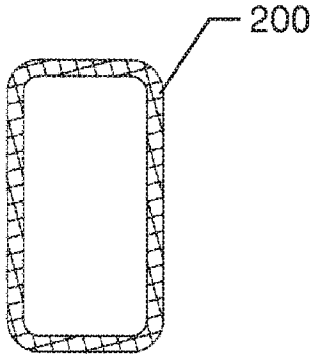
Fig.48A
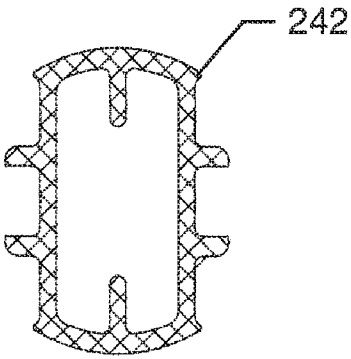
Fig.48C
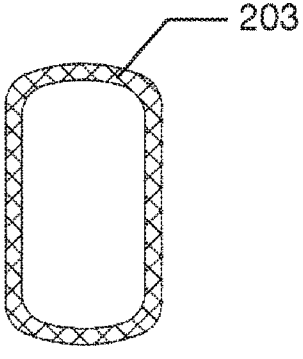
Fig.48E
Fig.48B
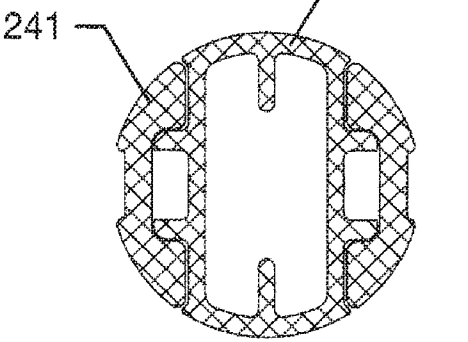
Fig.48D
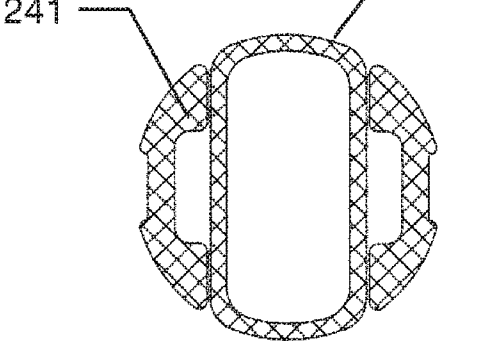
Fig.48F 201
207
250

255H
255
255
250H

203D 203D
203V

203V

203D

203D 203V
203V
261S
261H 261S
261

200

261S
261

261
261S

261

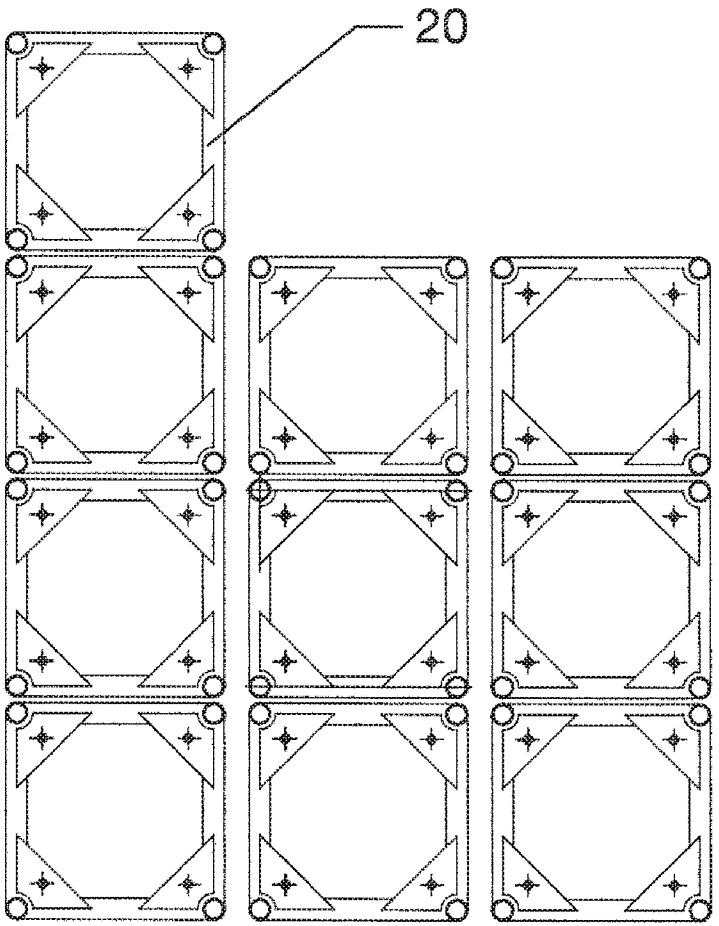
Fig.56D
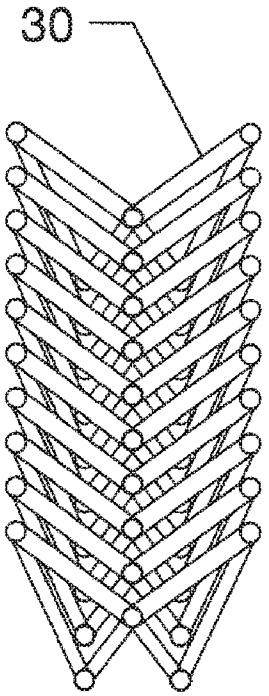
Fig.56C
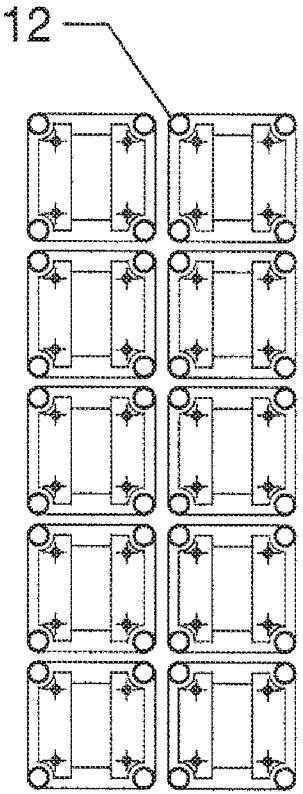
Fig.56B
FIG. 56A

DISTRIBUTABLE DIMMER PACKAGE HAVING A SIX-CIRCUIT OUTPUT CONNECTOR AND RE-CONFIGURABLE POWER INPUT

This application is a continuation of U.S. Ser. No. 14/676,616, filed Apr. 1, 2015, and claims priority from Provisional Application 61/973,592 filed Apr. 1, 2014, the entire disclosures of which are hereby incorporated by in their entirety.

The application relates to lighting and lighting equipment and other apparatus employed therewith, and in other uses.

Background and summary of the invention are integrated into the detailed description.

FIGURES

FIG. 24A is a plan view of the unit of the prior Figures using interchangeable single-circuit power inlet adaptors, three of which are also illustrated adjacent.

FIG. 24B is one end elevation of the unit of FIG. 24A.

FIG. 24C is the other end elevation of the unit of FIG. 24A.

FIG. 24D is one end elevation of the unit of FIG. 24A.

FIG. 26A is an end elevation equivalent to FIG. 23B, incorporating a cable strain relief in a plug-in end cap.

FIG. 26B illustrates such a plug-in end cap employing a 19-pin connector, as also illustrated in FIGS. 23A and 23D FIG. 26C illustrates such a plug-in end cap employing a connector different than the prior Figure.

FIG. 26D illustrates such a plug-in end cap employing a connector different than both prior Figures.

FIG. 26E is an end elevation of such a plug-in end cap employing dual inlet connectors, equivalent to FIG. 24B.

FIG. 26F illustrates such a plug-in cap as illustrated in the prior Figure, using interchangeable single-circuit power inlet adaptors, three of which are also illustrated adjacent.

FIG. 33A is a side elevation of an improved fixture design.

FIG. 33B is a side elevation of a lens that may be inserted in the fixture of the prior Figure.

FIG. 33C is a front elevation of the fixture of the prior two Figures.

FIG. 33D is a front elevation, illustrating a lens as may be inserted in the fixture of the prior Figures.

FIG. 33E is a front elevation, illustrating a different lens as may also be inserted in the fixture of the prior Figures.

FIG. 34A is a section of rounded corner rectangular stock.

FIG. 34B is a section of a plug shape.

FIG. 34C is a section of a shape suitable for crossmembers and plug stock.

FIG. 34D is a basic shape suitable for elongated members.

FIG. 34E illustrates the plug shape of FIG. 34B inserted in the basic shape of FIG. 34D.

FIG. 34F illustrates the shape of FIG. 34C inserted in the basic shape of FIG. 34D.

FIG. 40A is a side elevation showing the fitting and reinforcement shapes of the prior Figures assembled.

FIG. 40B is a side elevation of the reinforcing shape as fabricated for the assembly of the prior Figure.

FIG. 40C is a side elevation of a trimmed length of the fitting feedstock illustrated in FIG. 39C.

FIG. 40D is equivalent to FIGS. 38A and 38B, illustrating the fabrication of a fitting from a feedstock.

FIG. 40E illustrates the fabrication of a different fitting from feedstock.

FIG. 42B is a section through the shape used for crossmembers and filler, also incorporated between break lines as 203(R).

FIG. 42C is a section through the basic shape used for the elongated members.

FIG. 45A is a section illustrating an angled joint employing plural planar brackets.

FIG. 45B is a rotated elevation of one of the brackets employed.

FIG. 45C is a rotated elevation of the other of the brackets employed.

FIG. 46A is a section illustrating an angled dual joint employing plural generally planar brackets.

FIG. 46B is a rotated elevation of one of the brackets employed.

FIG. 46C is a rotated elevation of the other of the brackets employed.

FIG. 47B is a rotated section of the upper crossmember 203K clad with the basic shape 201K.

FIG. 47C is a section through a shape affording multiple tracks that may be attached to the base structure, if desired.

FIG. 47D is a section through a basic shape affording an additional elongated member that may be attached to the base structure, if desired.

FIG. 47E is a section through a shape affording a heavy-duty track, illustrated with a wheeled trolley fitting, if desired.

FIG. 47F is a section through a shape affording a heavy-duty track, illustrated with a bracket fitting for attachment, if desired.

FIG. 48A is a section through rounded corner rectangular stock.

FIG. 48B is a section through an elongated shape.

FIG. 48C is a section through another elongated shape.

FIG. 48D is a section illustrating how the shapes of the prior two Figures can be assembled into a structural element, here of generally circular profile.

FIG. 48E is section through a third elongated shape.

FIG. 48F is a section of the shapes of FIGS. 48B and 48E assembled into a structural element.

Figures 49A, 49B, 49C, 49D, 49E, 49F, 49G, 49H, 49I:
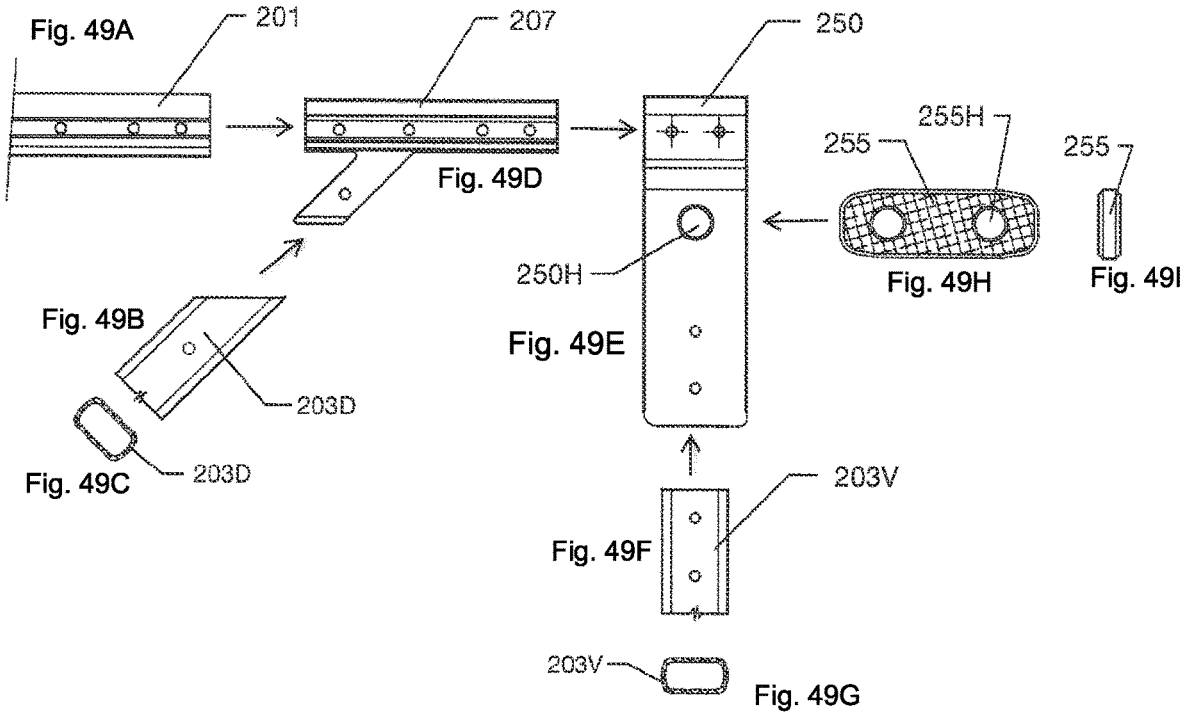

FIG. 49A-I is an exploded side elevation of the use of a corner used in assembling an intersection of truss and other structures, including rotated views; including FIG. 49A is a side elevation of the basic elongated structural shape.

FIG. 49B is a side elevation of a crossmember element.

FIG. 49C is a rotated section of the shape employed for the crossmember element of the prior Figure.

FIG. 49D is a side elevation of a fitting used to joint several elements.

FIG. 49E is a view of the corner detail 250 with the hole 250H.

FIG. 49F is a side elevation of another crossmember element.

FIG. 49G is a rotated section of the shape employed for the crossmember element of the prior Figure.

FIG. 49H is a side elevation of a link element that may be used to connect structures.

FIG. 49I is an end elevation of the link element of the prior Figure.

Figure 50A:
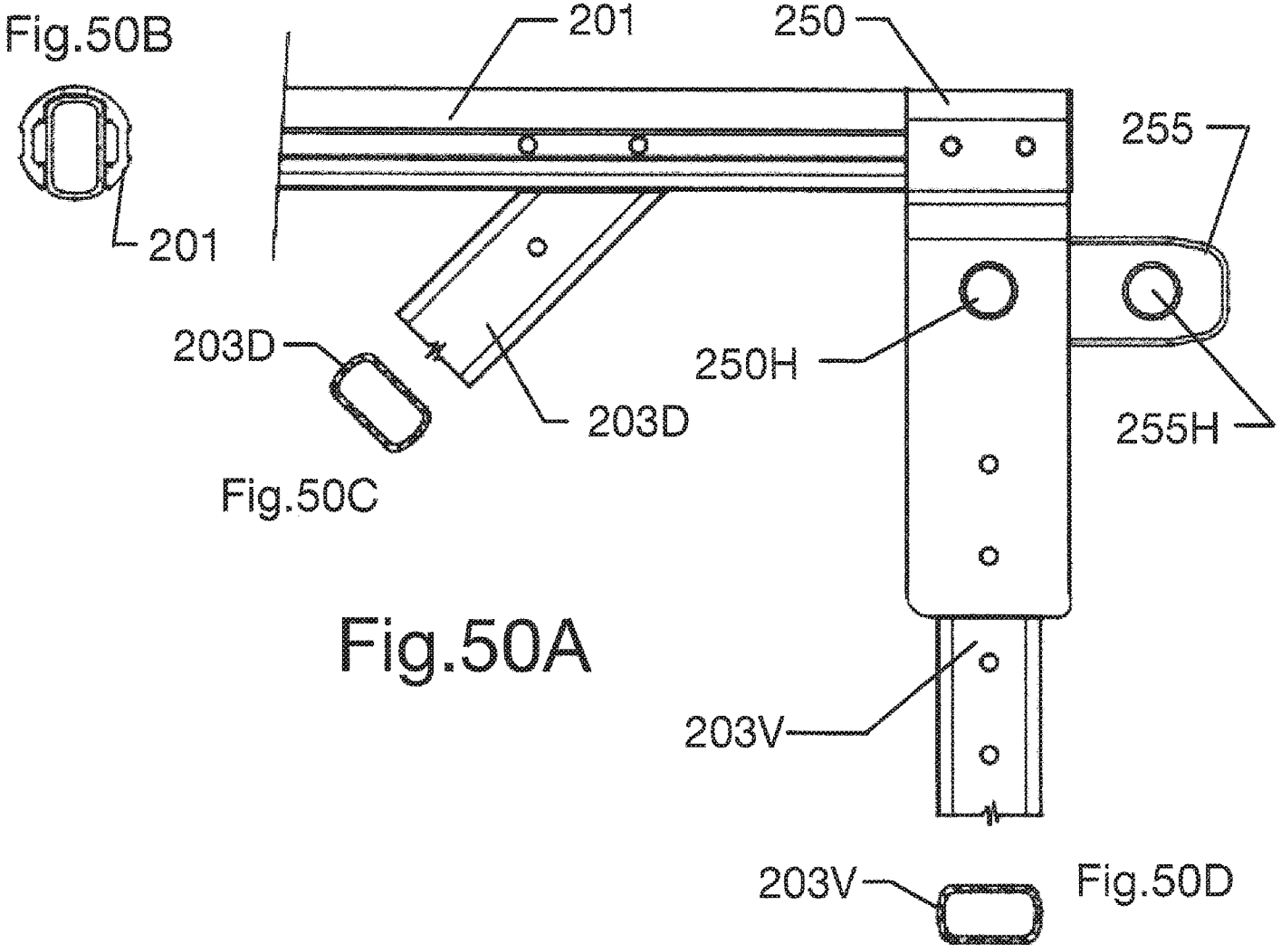

FIG. 50A is a side elevation of the previous Figures after assembly.

FIG. 50B is section through the basic elongated structural shape.

FIG. 50C is a rotated section of the shape employed for the crossmember element 203D of FIG. 50A.

FIG. 50D is a rotated section of the shape employed for the crossmember element 203V of FIG. 50A.

Figures 51A, 51B, 51C, 51D, 51E, 51F, 51G, 51H:
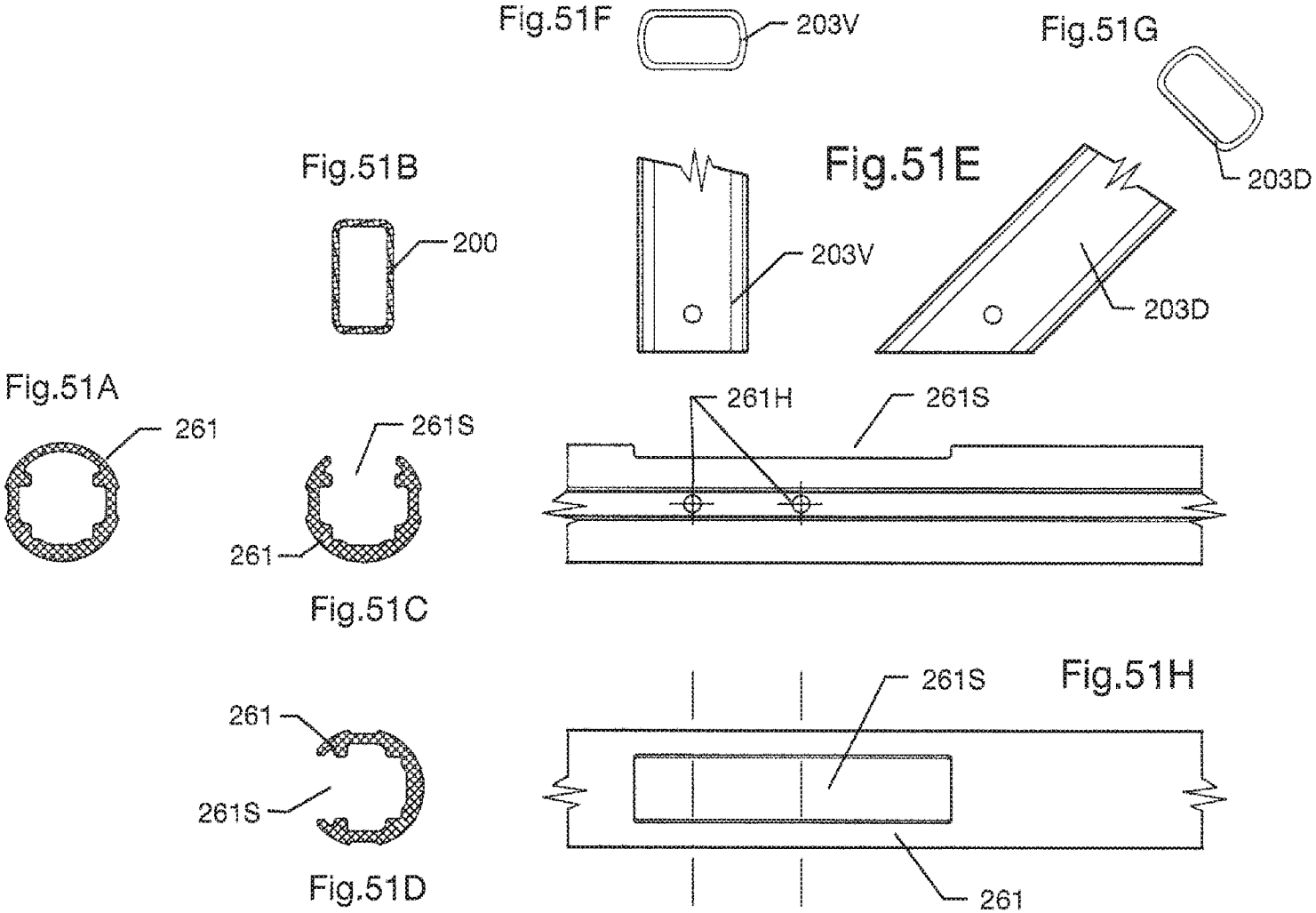

FIG. 51A is a section of an elongated structural shape of substantially continuous profile.

FIG. 51B is a section of rounded corner rectangular stock.

FIG. 51C is a section of the elongated shape of FIG. 51A after an opening 261S has been produced in it.

FIG. 51D is the view of the prior Figure, rotate to correspond to adjacent FIG. 51H.

FIG. 51E is an exploded side elevation of the elements of the prior Figures prior to assembly.

FIG. 51F is a rotated section of the crossmember shape used for 203V in the prior Figure.

FIG. 51G is a rotated section of the crossmember shape used for 203D in FIG. 51E.

FIG. 51H shows basic shape 261with slot 261 S.

Figure 52:
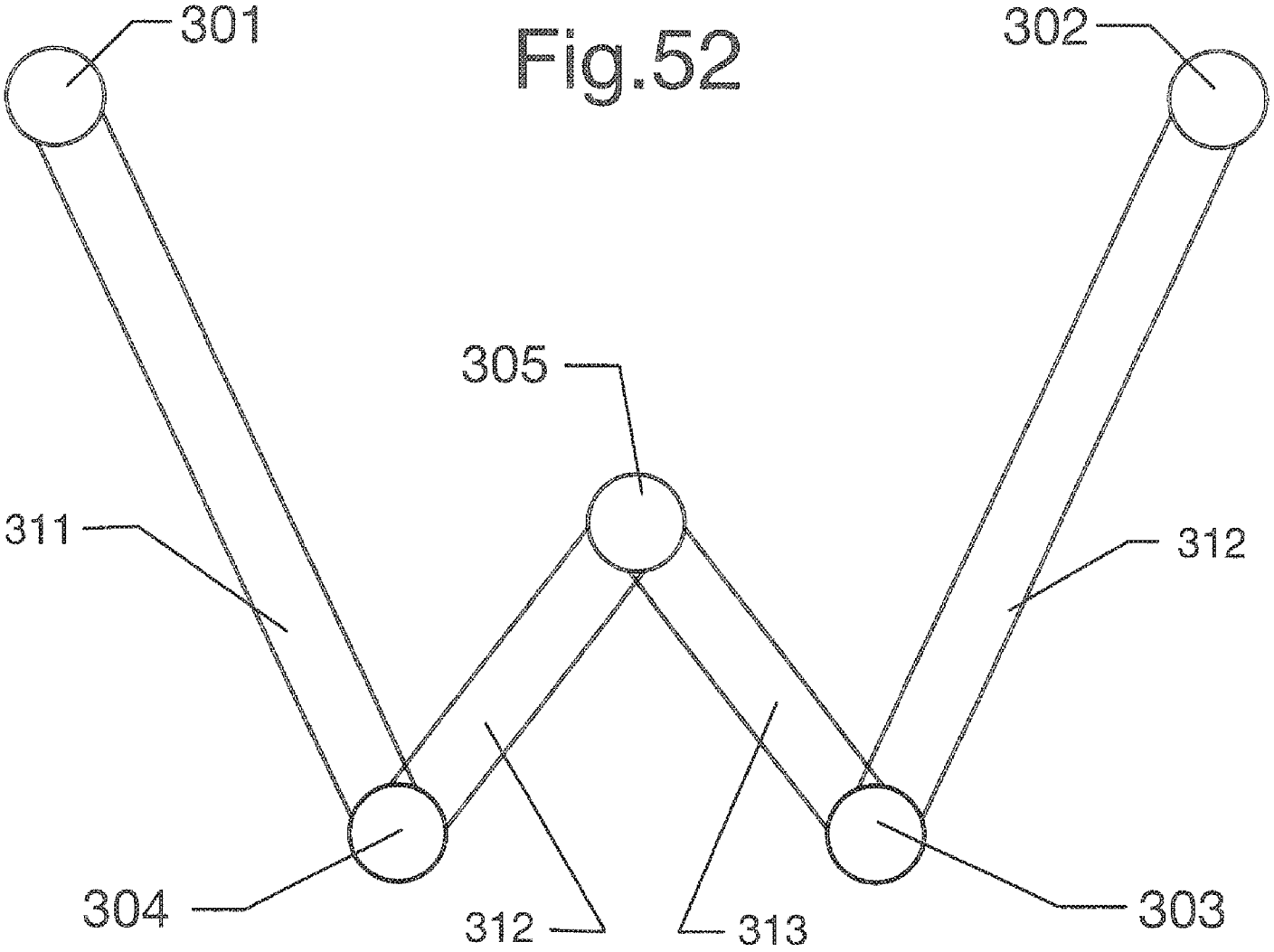

FIG. 52 is a sectional view through a structural truss having advantages.

Figure 53A:
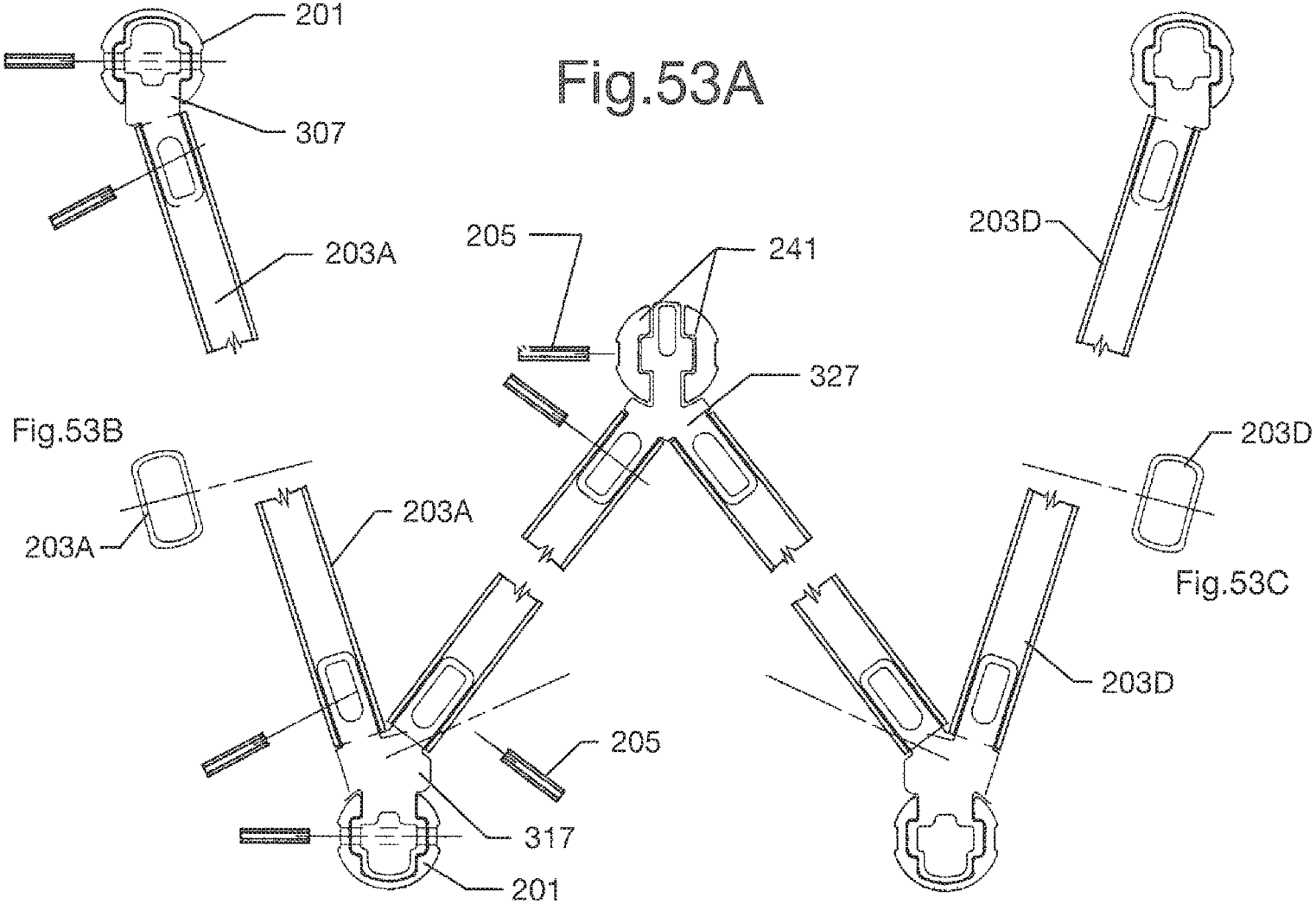

FIG. 53A is a sectional view through a truss with a similar profile employing the structural elements illustrated in prior Figures.

FIG. 53B is a rotated section of the crossmember shape used for 203A in the prior Figure.

FIG. 53C is a rotated section of the crossmember shape used for 203D in FIG. 53A.

Figures 54A, 54B, 54C:
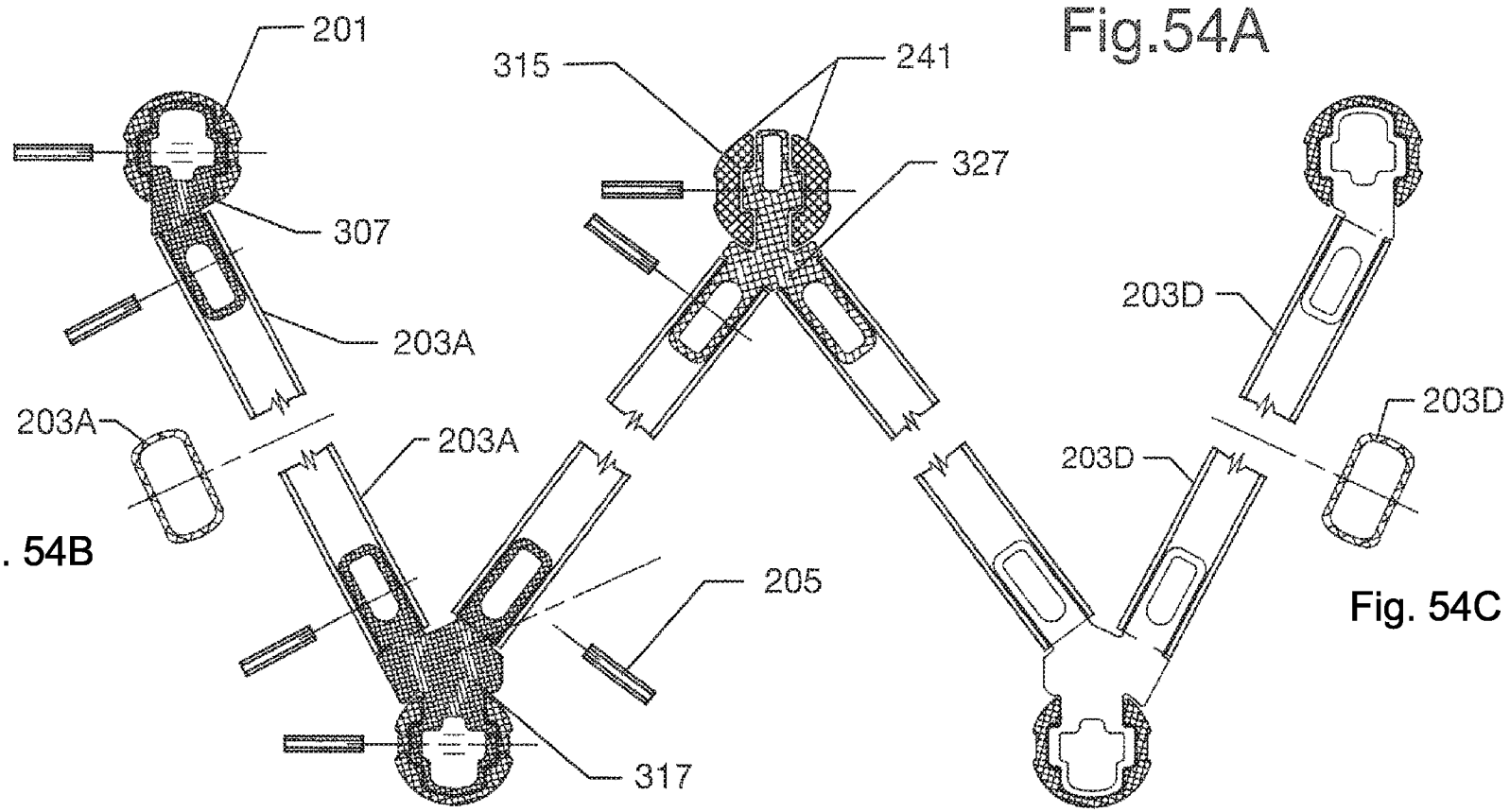

FIG. 54A is a sectional view through a truss similar in profile and construction to the prior Figure, with a center chord located in a similar plane to the more widely separated outer chords.

FIG. 54B is a rotated section of the crossmember shape used for 203A in the prior Figure.

FIG. 54C is a rotated section of the crossmember shape used for 203D in FIG. 54A.

Figure 55A:
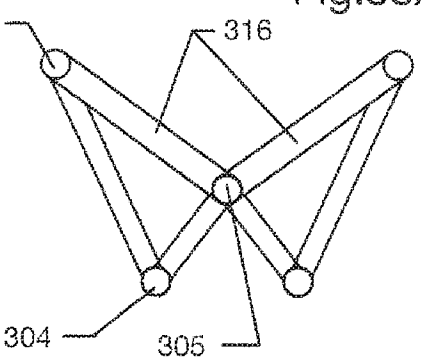

FIG. 55A is an end elevation through a truss with the profile illustrated in the prior Figures with the use of permanent stiffening members 316 connecting the more widely spaced outer chords with the center chord at one end.

Figure 55B:
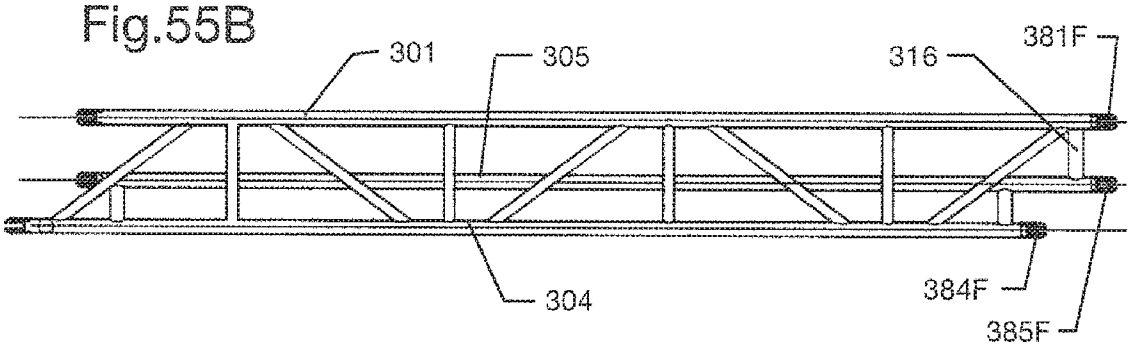

FIG. 55B is a side elevation of a truss structure showing clevis type fittings for endwise joining of sections, with fittings offset to permit nested stacking despite the stiffening detail of the prior Figure.

FIG. 56A is a comparative end elevation of the storage and shipping volume requirements for ten sections of truss of equal length as between two popular prior art profiles and that of the prior Figures.

FIG. 56B is an end elevation of a stack of ten sections of known 12"×12" truss.

FIG. 56C is an end elevation of one embodiment of the improved truss of the present invention, in equal quality and scale as the prior Figure.

FIG. 56D is an end elevation of one embodiment of the known "20.5" truss, in equal quality and scale as the prior Figures.

DETAILED DESCRIPTION

One aspect is in improvements to apparatus for supplying and controlling power to various loads, including lighting fixtures.

In the use of lighting and other systems there have evolved common apparatus and practices.

Millions of lighting fixtures in use employ known incandescent bulbs, varying the intensity of which is performed using known light dimmers. There are many possible electronic designs/principles for such light dimmers, of which the dominant one has long been and remains the use of inverse parallel silicon controlled rectifiers in a phase control mode with a filter inductor. Such (and other) dimmers have been packaged in different architectures, for both permanent installations and for portable or temporary use.

As has been described elsewhere at length, permanent installations generally provide a number of electrical outlets, which are installed at or near positions at which fixtures might be deployed. Such outlets are connected to banks of dimmers, which are in one or more central location.

In early such practice, dimmers were employed, each of a capacity far larger than a typical lighting fixture's lamp wattage/load, and in a quantity substantially less than the number of outlets (if not of the fixtures controlled). An electrical combining/routing apparatus was used to combine multiple outlets, and thereby fixtures, on each of such dimmers. The costs, of such "load-patching", in both capital and in operation, resulted in a trend to "dimmer per circuit", beginning in the 1970s and 80s, in which a number of dimmers equal to the number of outlets was installed, each directly and permanently connected with the other, such that any load-patch was eliminated. Tradeoffs include the cost of what can be many hundreds of dimmers, only a fraction of which might be employed at one time, and not always to their full capacity.

Where lighting systems are employed on a temporary basis (including when a production is touring from facility to facility) they use flexible cables between fixtures and dimmers. In prior practice, with single circuit connectors at both ends, and some form of load patch between them. To reduce assembly and disassembly time and labor, during the 1970s and early 1980s, a "second generation" such system was adopted employing multi-circuit "multi-cables", each conveying six or more circuits via each such cable and a multi-pole/multi-circuit connector.

Offsetting their advantages, such "second generation" dimming systems have a number of tradeoffs (including complexity and capital cost), which have increased because of trends in the industry over the decades.

Some such trends have been in the disparity between the capacity of dimmer and cable and, frequently, the load applied to it.

To accommodate the range of loads that might be applied by different lighting fixtures, singly or in combination, U.S. practice has long been to standardize on cable, connectors, and dimmers of 2400-watt capacity. However, the standardization on high-efficiency lighting fixtures in the most common types using "HPL" bulbs of 575 watts (or, at maximum, 750 watts), combined with the frequent desire to circuit, if not control, the intensity of at least some fixtures singly, has had the result of requiring, in one example, four such multi-cables (e.g., the 20 A "Soco") to supply 24 fixtures, where the combined loads of all 24 fixtures could be supplied by a single such cable. Unused capacity/excessive cabling results in significant penalties in cost, time, labor, trucking, and suspended load.

The same penalties hold true at the portable dimmer rack, when dimmers are often loaded to less than full capacity in the interests of separate control of fixtures. Such racks typically incorporate miniature load patches to combine multiple circuits on the same dimmer (where possible) and to skip over unused circuits in multi-cables, increasing the size and cost of such racks and complicating their use.

Various drawbacks of both such "dimmer per circuit" permanent installations and of such "second generation" portable approaches have both long been known. The inefficiencies of both have been further increased by the adoption of light fixtures and accessories that require a constant source of power that is not dimmed—and especially when that power is preferred or required at a substantially higher voltage than that of the incandescent bulbs.

A notable example is the so-called "automated" or "moving" light as disclosed in U.S. Pat. No. 3,845,351; which often employs a discharge bulb whose intensity is varied by a electro-magnetic douser rather than a remote power dimmer. Such fixtures (as well as other types based on LEDs and electromechanical accessories like color scrollers/changers) require undimmed power.

Reducing the current draw of discharge bulb-based fixtures requires their operation at 208 volts (achieved by phase-to-phase connection in the U.S. rather than the typical 120-volt phase-to-neutral connection).

When such 208 v fixtures are mixed in the same lighting system with those fixtures with 120 v incandescent bulbs dimmed by dimmers, undimmed 208 v must be provided to (and only to) those circuits with such fixtures; 120 v fixtures combined (as possible) on specific dimmers; and those accessories (and other fixture types such as LED based fixtures) requiring undimmed 120 v supplied with it.

Traditional dimming and distribution systems for permanent installations do not offer this flexibility.

To do so in portable/temporary systems, most users have long employed, in varying quantities, "layers" of different, but parallel systems.

Figure 1:
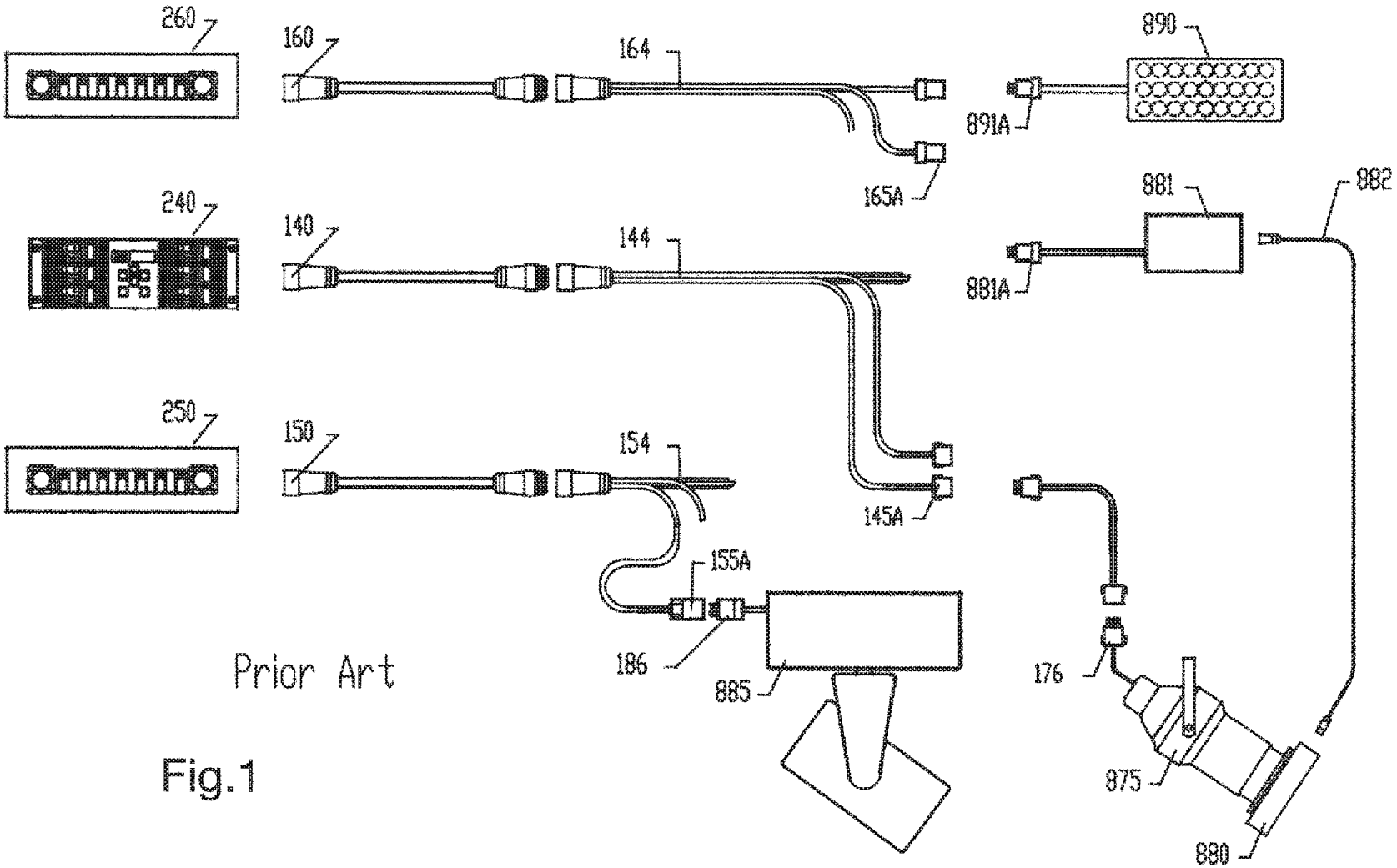
Prior Art Fig. 1
FIG. 1 is a diagram of the systems used to supply power in a typical prior art portable lighting system.
Figure 2A:
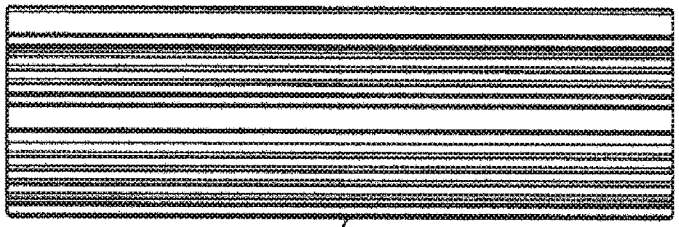
FIG. 2A is a plan view of one embodiment of an improved dimmer.
Figure 2B:
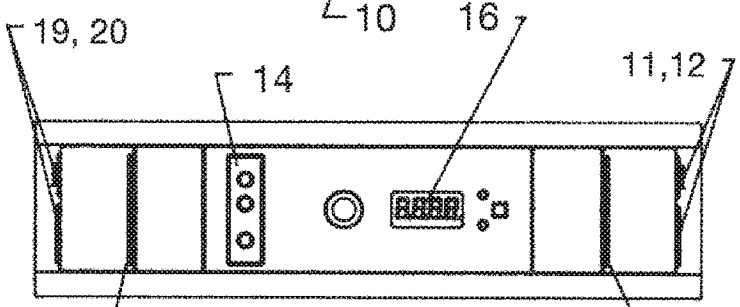
FIG. 2B is a front elevation of the dimmer of FIG. 2A
Figure 2C:
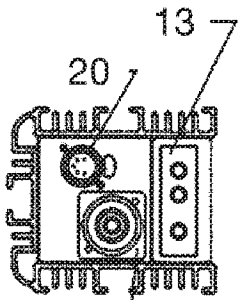
FIG. 2C is one end elevation of the dimmer of FIG. 2A
Figure 2D:
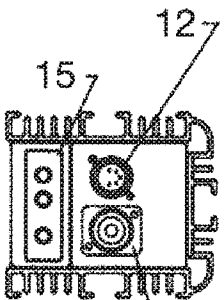
FIG. 2D is the other end elevation of the dimmer of FIG. 2A
Figure 2E:
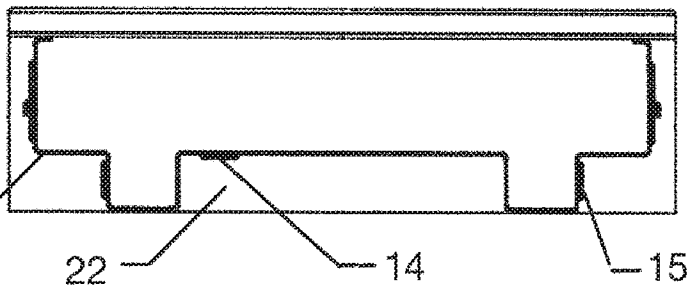
FIG. 2E is a section in plan view of the dimmer of FIG. 2A

Referring to FIG. 1.

"Conventional" incandescent bulb based lighting fixture 875 is supplied via one circuit in six-circuit multi-cable 140. Multi-connector 140 will be plugged, in the known manner, to a dimmer rack or pack 240, which may provide a load-patch for the purposes previously described. This fixture 875 is terminated in a single-circuit plug chosen for this 120 v application, such as a known "pin" connector.

"Moving light" 885 requires or prefers 208 volts, which is supplied by a different, deliberately incompatible connector, typically a known twist-lock. Fixture 885 is supplied from a known power distribution unit 250 (essentially a circuit-breaker panel) via a separate "multi" 141.

Both multi-cables 141 and 151 are of the same type and interchangeable, but different "break-outs" 144 and 154 (as illustrated) adapt from a male 6-circuit multi-connector to six single-circuit connectors on separate leads, terminated with the single-circuit connector type appropriate to the voltage/function.

A third cable system 161 and third "break-out" type 164 are illustrated for supplying undimmed 120-volt power to fixtures (like LED fixture 190) and accessories (power supply 181 for color scroller accessory 880). Such distribution may employ a third single-circuit connector type (typically a standard "Edison") that helps distinguish those 120 v loads dimmed from those that should not be.

The consequence of the use of these approaches to supplying and controlling power to a modern lighting system, whether single-voltage or dual voltage, has, for many years, represented an inefficient use of capital and an excessive quantity of hardware that wastes time and labor in its preparation, assembly, disassembly, and handling; adds weight and volume in transport; increases the supported or suspended weight load; and renders more complex the planning of and operation of lighting systems.

Refer now to FIGS. 2A-2E, which illustrates one embodiment of an approach superior in many respects. A plan view, three elevations, and a section are presented.

In this illustrated embodiment, an example enclosure 10 is fabricated by the combination of an elongated extrusion with one or more formed shapes inserted within it for the mounting and enclosure of components.

As illustrated, the unit has on one end a power inlet connector 11 in the form, for example, of a Neutrix Powercon, as well as a data inlet connector 12, here a known 5-pin XLR. The illustrated unit contains electronics, such as dimmers, to regulate the average power supplied to not less than two separate lamp loads. In this case, separate dimming for three loads is provided; each by a separate output power receptacle 13, 14 and 15, in this case, of a 20 A "pin" type. The unit also affords an interface, including display 16, to the user for functions including the setting of an "address" for the unit; to test loads; to display conditions; to change modes; and for other purposes. The functionality of the interface can be extended by various means, some of which will be described below.

Figure 3:
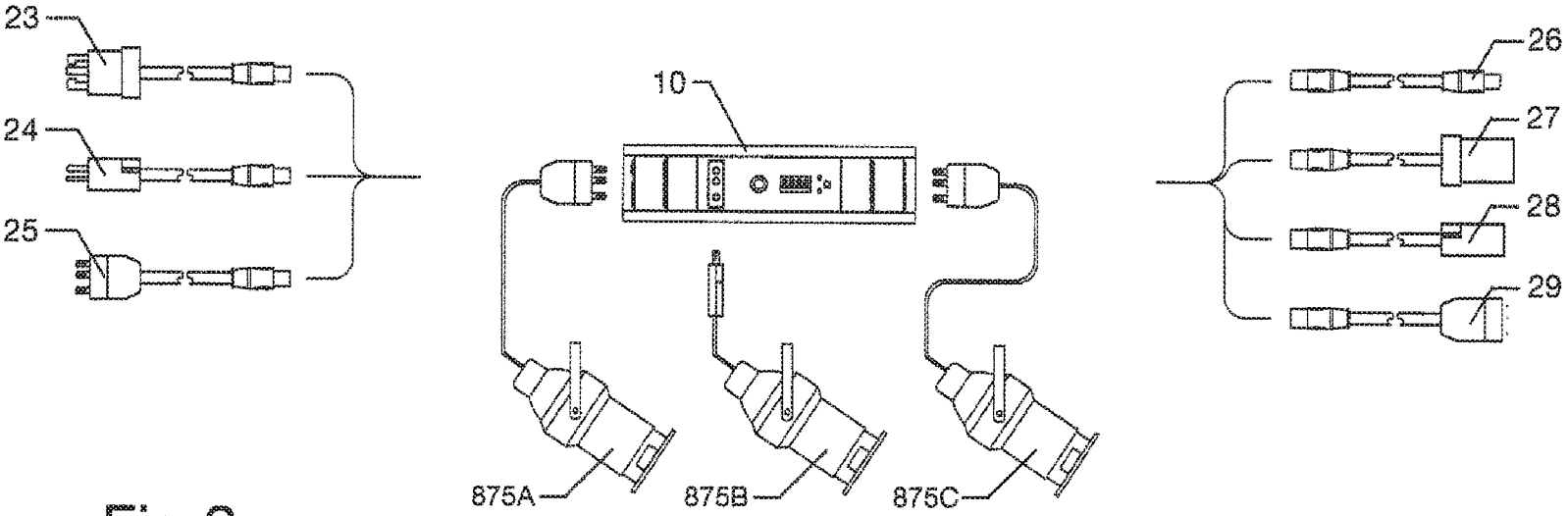
FIG. 3 illustrates the pluralities of interchangeable input and of output adaptors, one of which may be chosen for use with the dimmer of FIG. 2A

FIG. 3 illustrates how adaptors or "line cords" of any desired length can provide for connection from any desired power connector to the power inlet connector on the unit. Male twistlock 23, Edison 24, and pin connector 25 are three possibilities illustrated.

Three incandescent lighting fixtures 875A, 875B, and 875C are depicted with their male plugs adjacent the output receptacles that will supply them.

As illustrated, another end of the unit 10 has a power outlet/passthru wired in parallel to the power inlet 19, and a data output connector 20, also an XLR.

Further, adaptors 27, 28, and 29 are also illustrated that adapt from the illustrated power output/feedthru 19 on the unit 10 to female versions of the three power connector types, as well as 26 to a female of the Powercon or similar input connector, such that two of the illustrated units can be "daisy-chained" with each other.

Figure 4A:
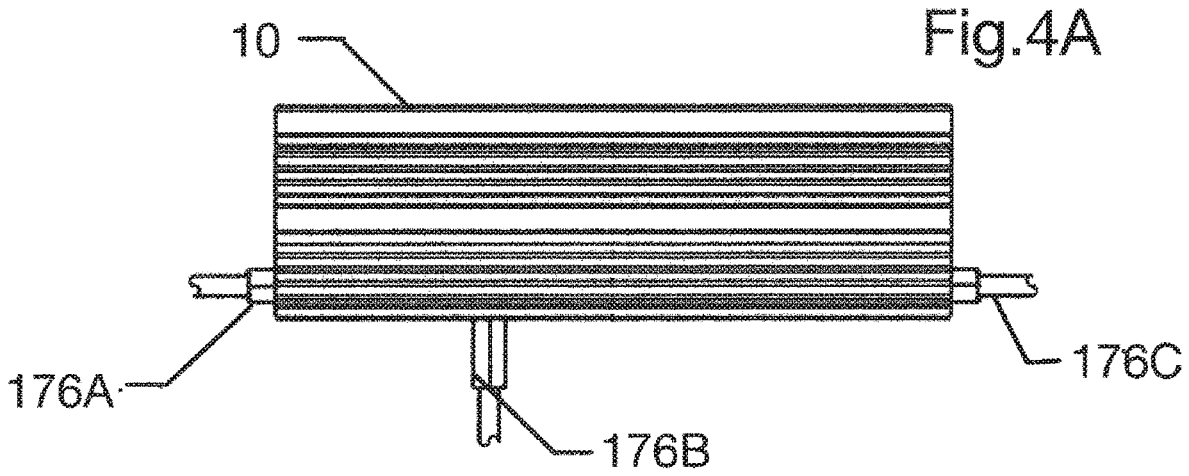
FIG. 4A is the plan view of FIG. 2A with lamp loads plugged to the dimmer.
Figure 4B:
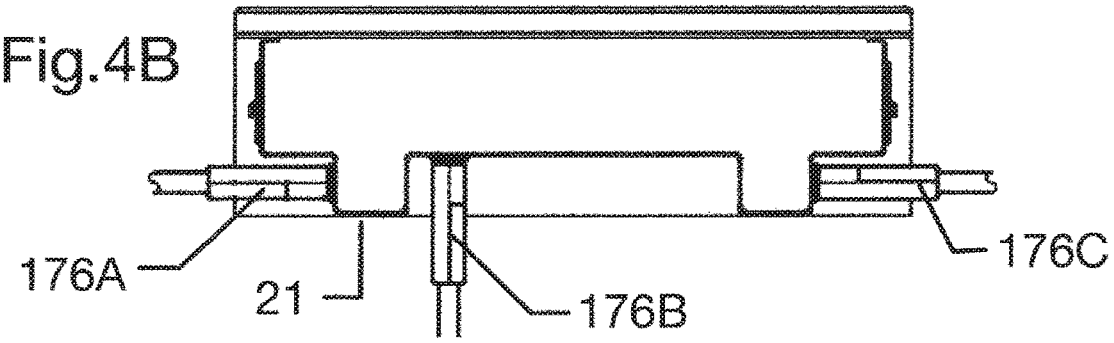
FIG. 4B is the section of FIG. 2E with lamp loads plugged to the dimmer.
Figure 4C:
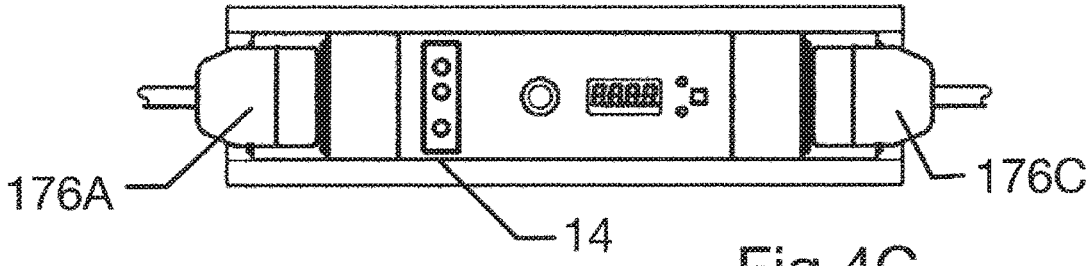
FIG. 4C is the elevation of FIG. 2B with lamp loads plugged to the dimmer.

FIGS. 4A-4C illustrate that the various receptacles can be mounted on surfaces that recess them partially within the outline of the outer form for protection against accidental disconnection or damage.

Figure 5:
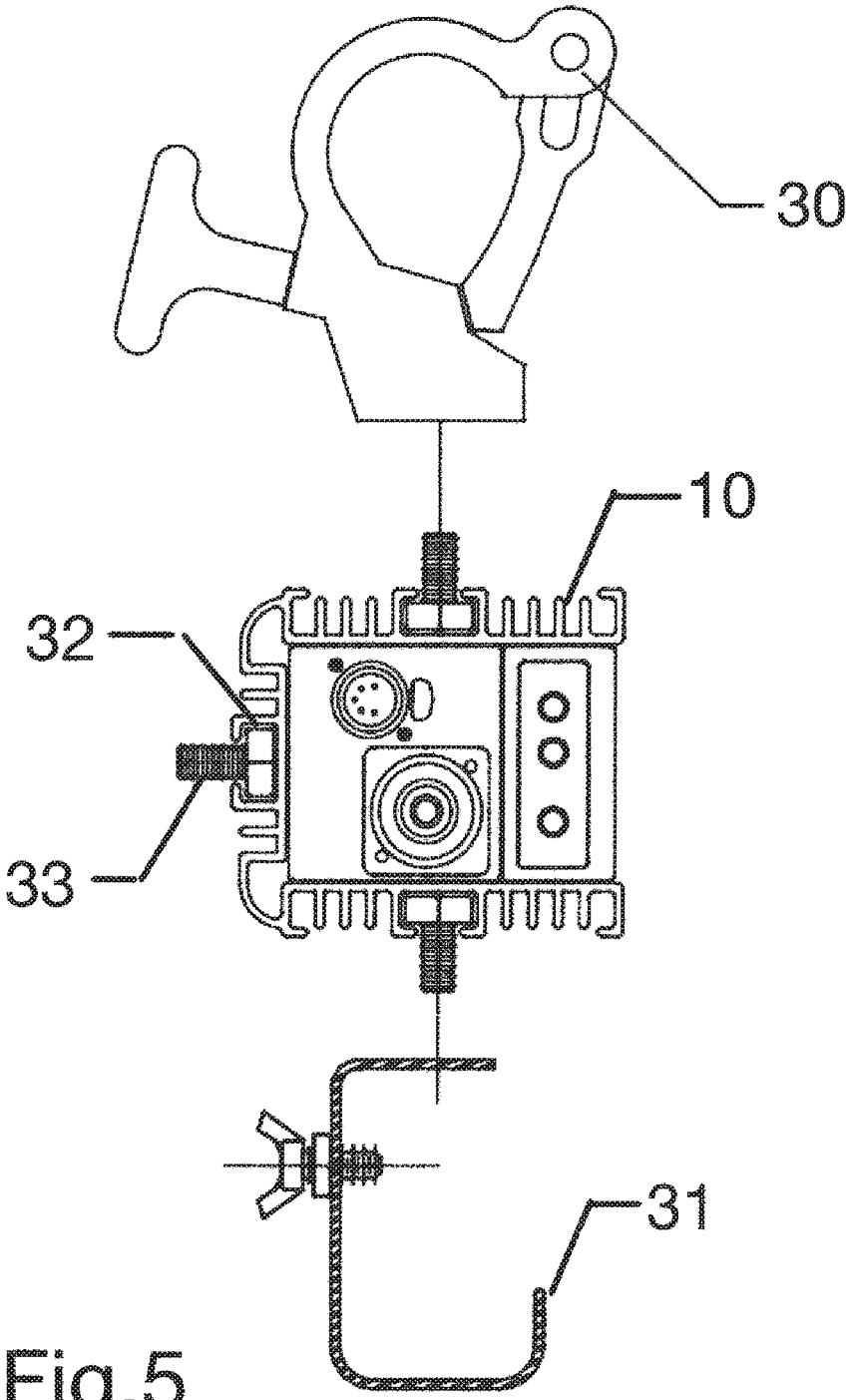
FIG. 5 illustrates provisions for attachment of hanging clamps and other supports to the dimmer of FIG. 2.

Such a unit will often be used on or near a structure from which one or more of its connected lamp loads are also supported, so the embodiment illustrates some methods for supporting it. Provided in the outer form, as illustrated in FIG. 5, is a track 32 that captivates the head of a ½" bolt 33, as is commonly used in fixture supporting hardware. As illustrated, the bolt head is slid into the track and any clamp (such as 30 or 31) or other hardware that can receive such a bolt can then be attached, with one or more such attachment on one or more of three of the unit's long sides. Tightening the clamp or hardware draws it and the bolt head tight against the flanges of the track, fixing the relationship.

A receiver with a threaded hole or latch receptacle can also be slid into a track or other detail of the unit housing.

Figure 6B:
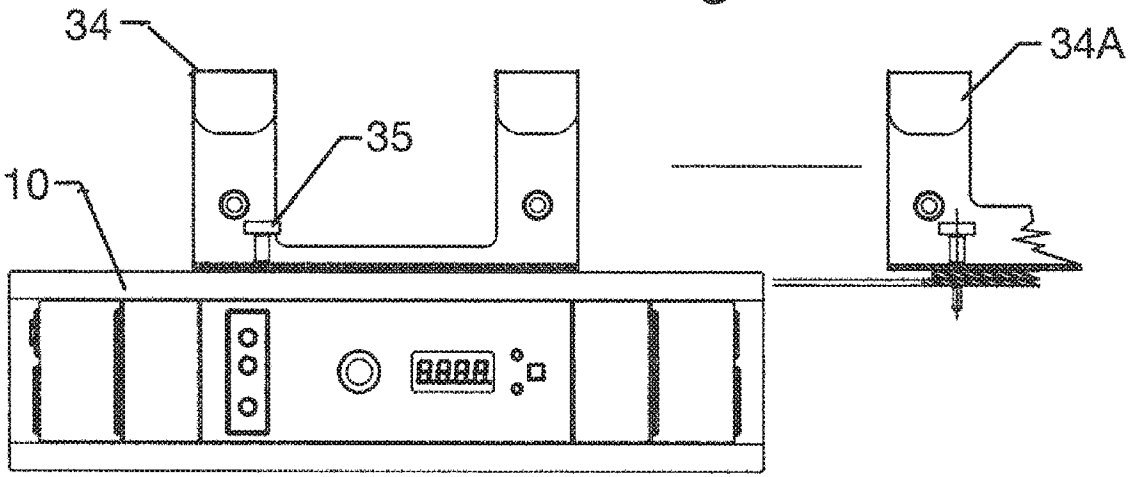
FIG. 6B is the front elevation of FIG. 2B with a hanging clamp assembly both in insertion and in inserted position.
Figure 6A:
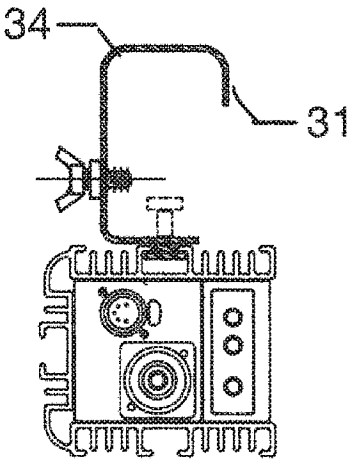
FIG. 6A is the end elevation of FIG. 2C with a hanging clamp assembly attached.

FIGS. 6A and 6B illustrate a formed hanger bracket 34 that sides into interlocking with any of the three sides, in this case, with the same detail used for the ½" bolt. The bracket is retained, in this illustration, by a spring-loaded plunger 35 that snaps into a recess in the outer form.

Figure 7B:
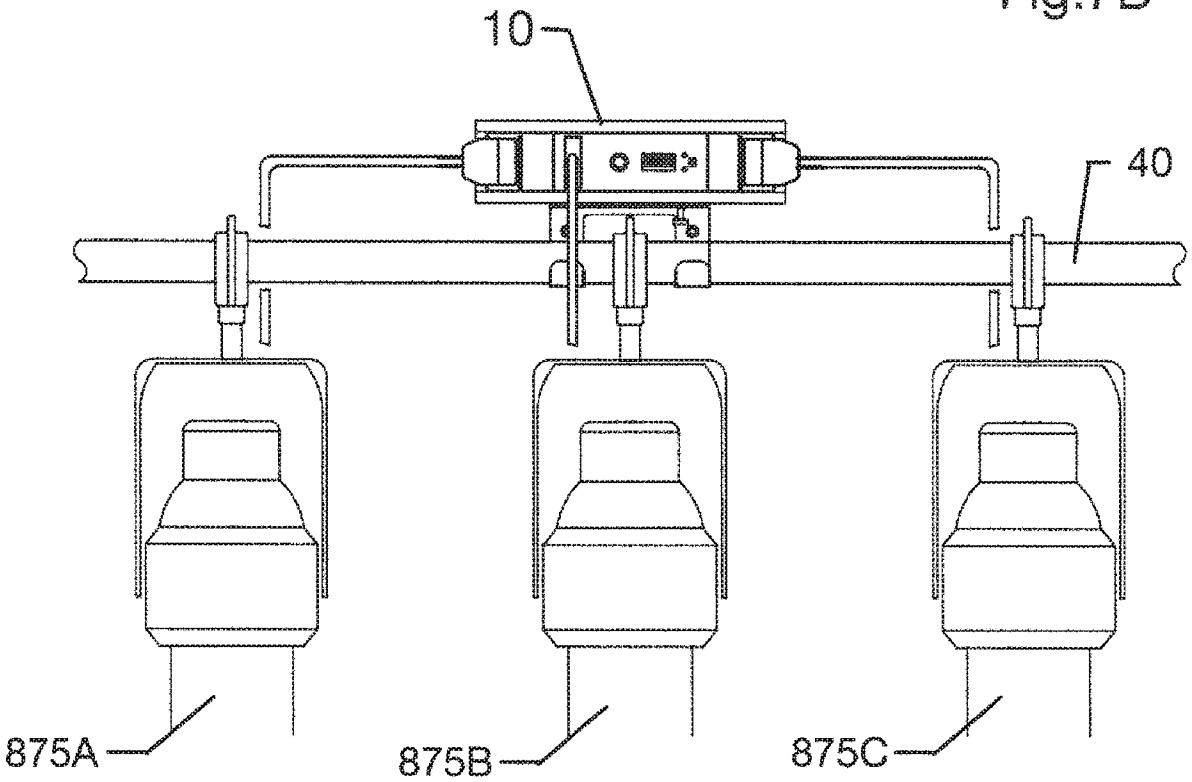
FIG. 7B is the front elevation of the prior view.
Figure 7A:
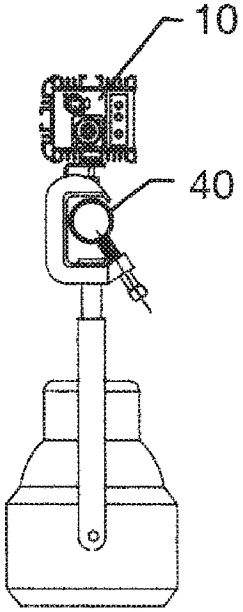
FIG. 7A is an end elevation similar to FIG. 2C with the hanging clamp assembly attached to a supporting pipe that also supports the lamp loads.

FIGS. 7A and 7B illustrate the unit 10 in one of many possible physical relationships with connected lamp loads. In this case, a plurality of fixtures is spaced along an elongated structural member, here a pipe 40 or a chord of a truss or other structure. Using the hanger bracket 34 or other hardware, the unit can be attached to a structure in proximity to the fixtures/loads, so that they may be plugged directly into the unit, without need of intervening extension cables.

Figure 8:
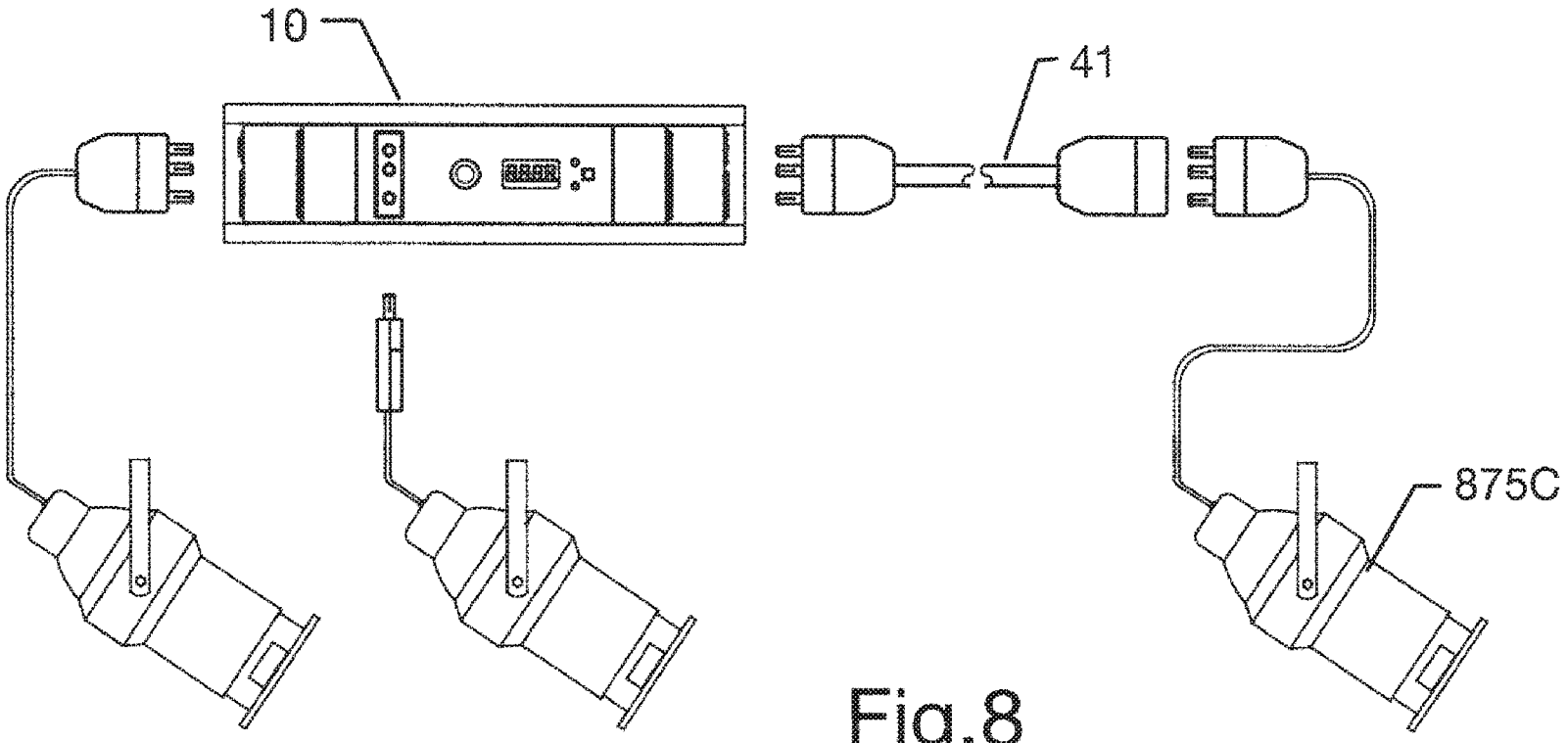
FIG. 8 illustrates the addition of an extension cable between the dimmer of FIG. 2A-E and a lamp load.

FIG. 8 illustrates that, where necessary or desired, a unit can be connected with fixtures by cable extensions, such as 41.

Figure 9:
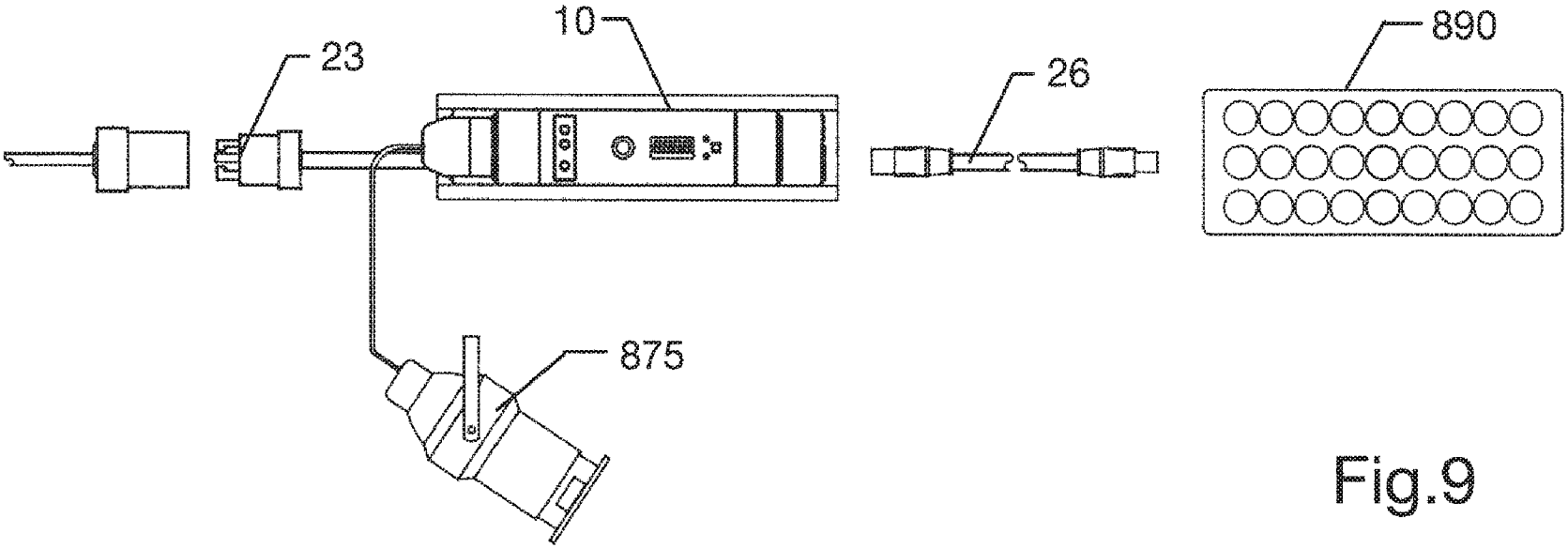
FIG. 9 illustrates the feeding through of undimmed input power to an additional load.

FIG. 9 illustrates that unused capacity in the supply of current to the unit, via its input, that is not required by connected lamp loads, such as 875 can be passed thru one unit to another such unit or to an undimmed power-consuming device, such as, for example, to the LED fixture 890 illustrated.

A plurality of separately dimmable/controllable outputs are provided. Three outputs are illustrated here, although more can be provided. Desirably, the number and capacity of the outputs is reasonably related to that of the input, such that all outlets can be used with typical load wattages.

Not all outputs need be of the same capacity, in fact, one or more output may be made capable of a substantially higher wattage for those occasions when a higher wattage fixture is employed (this, of course, reducing the permissible load on the remaining outputs to stay within the maximum capacity of the supply).

Figure 10:
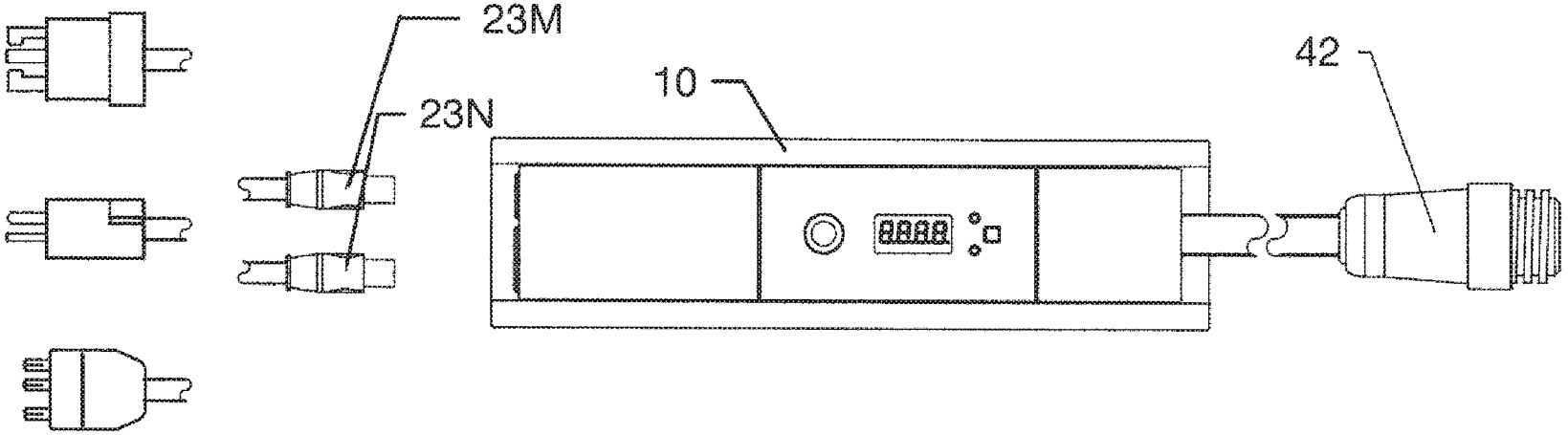
FIG. 10 is a variant of the dimmer of the prior Figures including six power stages and terminating in a multi-connector.

A unit may accept more than one power input. FIG. 10 illustrates a unit accepting two separate power inputs, such as via input pigtails 23A and 23B (schematically depicted as having one of several possible male connectors); each supplying three of six outputs; those outputs provided to a single six-circuit output multi-connector 42 which can be plugged directly to a known six-circuit/six-fixture "lamp bar" and/or to a "break-out" 144 (or via a multi-cable extension to either such a bar or breakout to remote the unit at some distance from the fixtures dimmed).

The advantages of this and other embodiments are many and immediate.

Consider an example in which 18 fixtures are hung at a given location. Using the prior art approach, three six-circuit multi-cables would be required to circuit them individually (whether because separate control of each is desired and/or because combining multiple fixtures by the use of additional cable and "twofers" at the position instead of at the dimmer end would add components, connections, bulk, and weight; and would limit future changes in combination without reworking the cable and twofers at the position). A substantial amount of dimming equipment and some form of "load patch" will be required (with its associated weight, volume, costs, and complications) to reduce the number of underloaded dimmers.

By contrast, six of the units illustrated can be supplied with undimmed power via a single multi-cable, providing individual control of all eighteen fixtures with a 66% reduction in the multi-cable required; no load patch; and a simple circuit breaker panel rather than a dimmer rack. Substantial savings are achieved in many aspects over the present approach. Combinations can be made and changed at will electronically by "soft-patching".

Because undimmed power is supplied to the fixture location, it can be readily shared with other consumers requiring it, such as automated and LED fixtures and fixture accessories.

A unit like that illustrated can also be used in some permanent installations, whether new construction or retrofit. By contrast with present approaches that install large dimmer racks in separate rooms requiring sound isolation and climate control; which must then be connected with often distant outlets by expensive permanent wiring; and whose cost is multiplied by the need to have an adequate number and density of outlets at all those locations where fixtures might be used in future and to provide a dimmer for each; a unit such as the illustrated can be employed in a more modest initial quantity and deployed when and where fixtures are actually used. As needs and fixture distribution change, units can be moved and additional units rented or purchased.

A unit like the embodiment illustrated has even more substantial advantages when the dimming approach employed permits supplying the unit with not just a supply equivalent to the rated voltage of an incandescent lamp (typically 120 volts), but also a higher voltage, such as the 208 volts required or preferred by the discharge sources used in many automated fixtures (and useable by many LED-based fixtures and many fixture accessories).

Figure 11:
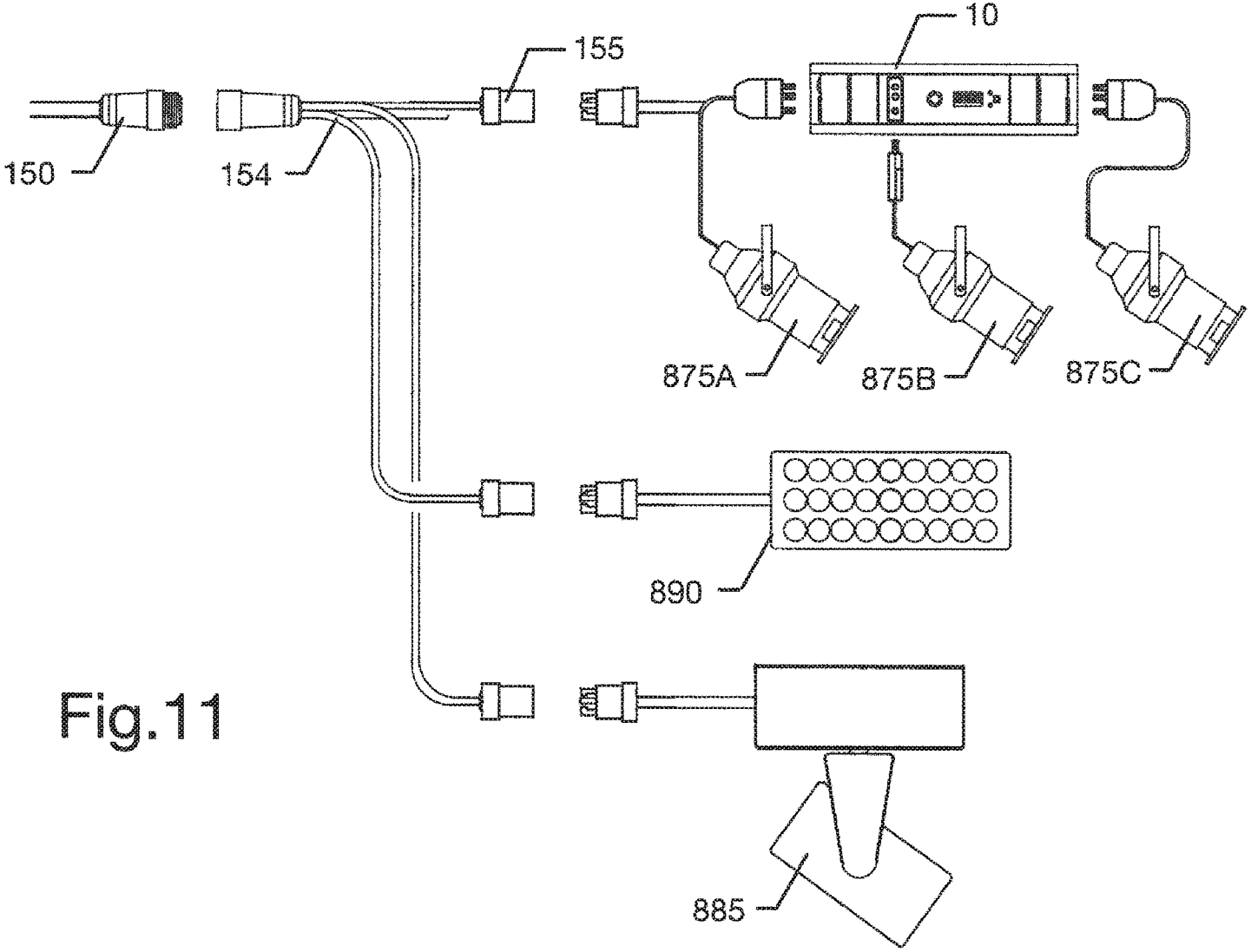
FIG. 11 illustrates the use of a dimmer of the prior Figures as supplied by a multicable.

Referring now to FIG. 11.

A six-circuit multi-cable 150 is employed with, in this case, a typical "break-out" 154 to the single-circuit connector 155 employed for the 208 volt connections by the user. All circuits can be supplied by 208 volts from a simple circuit breaker/distribution unit 250, in the known manner. In the example, one each LED fixture 890 and "mover" 885 are illustrated as plugged to two of the six circuits. The disclosed unit 10 is plugged, via an appropriate input adaptor/line cord, to another 208-volt circuit, although three fixtures with 120-volt bulbs 875A, 875B, and 875C are plugged to that unit. The unit, however, is designed to limit the maximum average voltage applied to the lamps connected so as not to become substantially greater than that resulting from the direct connection of such a lamp to a normal 120-volt supply. There are several approaches to a suitable electronic design, some of which will be disclosed herein.

As a product of this ability, 120 volt and 208 volt consumers can be intermixed on the same simple 208-volt supply and a common cabling system.

Where, in FIG. 1, separate 120 volt and 208 volt cabling systems are required, along with separate dimmer and distribution units; FIG. 11 illustrates a system of great economy, simplicity, and flexibility.

These benefits are achieved with no more than the use of such a unit, and without changes in the "vocabulary" of cabling and distribution equipment already in production, extensive inventories, and use.

Importantly, the use of power input connector(s) like the Neutrix Powercon or (True-1) that are not specific to an input voltage—unlike pin, Edison, and twist-lock connectors that are limited to a specific voltage by standard or usage (e.g., NEMA configuration) permits the same unit to be rapidly changed for use with different distribution systems and cables, on either 120 volt or 208 volt inputs (and, in other countries or on different mains systems, other voltages and voltage ranges).

Power Control

Distribution of dimmers for fixtures in proximity to those figures have long presented certain requirements on the power control approach employed, some of greater import in such distributed applications, as compared with centralized racks or packs.

Traditional phase control, inductively filtered, dimmers have been employed in "same voltage" applications in both central and in distributed models. Their disadvantages include the size, weight, and thermal losses of their filter inductor or "choke".

"Switcher" dimmers have been built that employ high speed pulse width modulation for power control. High switching speeds permit a reduction in filter inductor size, at the cost of electronic complexity. Such dimmers can be designed to accommodate wide variations in input voltage above the desired output.

Figure 18:
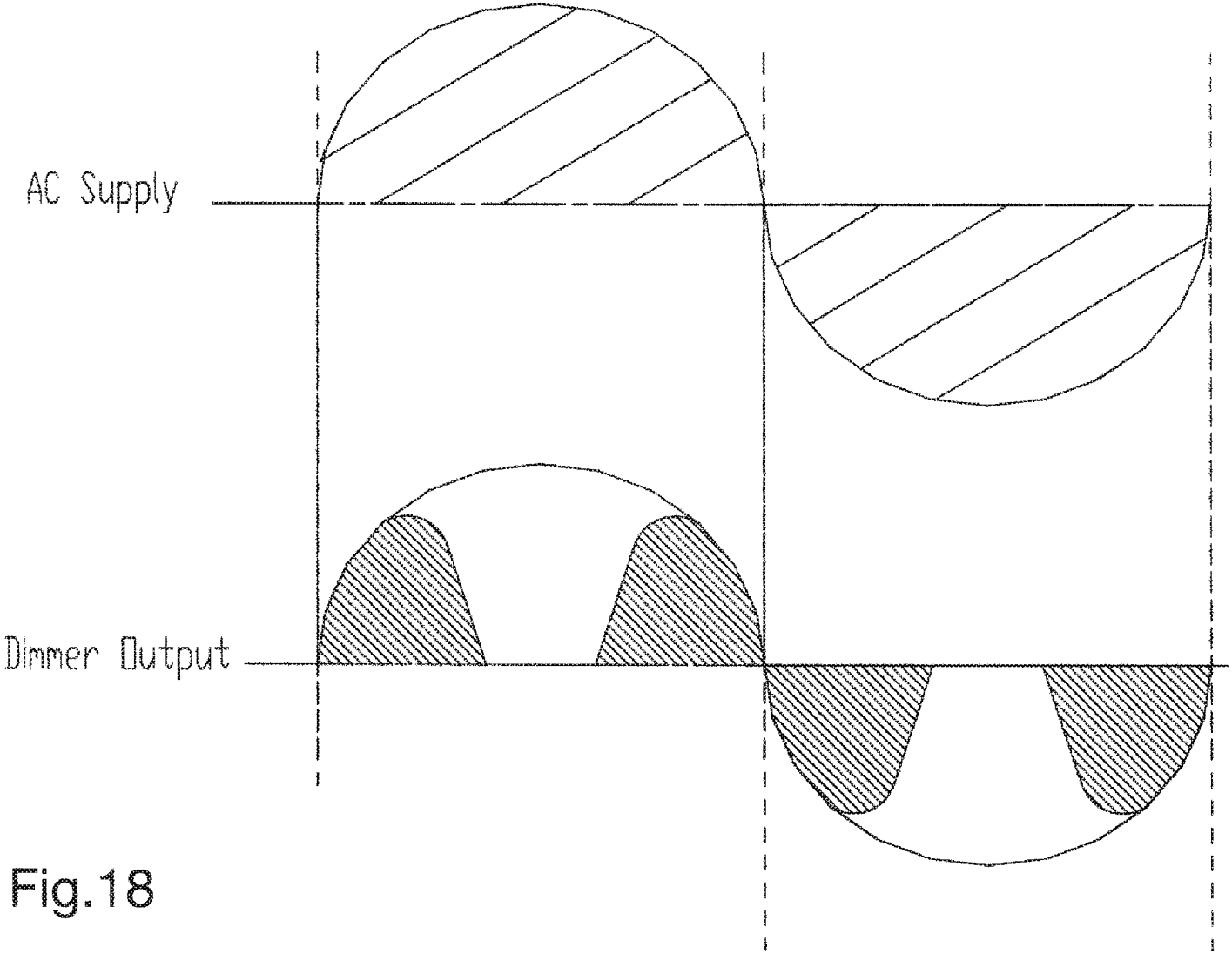
FIG. 18 illustrates plural transitions in a half cycle.

The applicant is a named inventor in various patents, including U.S. Pat. Nos. 4,633,161; 4,975,629; 4,823,069; 5,672,941; and 5,319,301 (included in their entirety by reference). Disclosures therein include for controlled transition dimming. Such dimmers employ semiconductor power devices capable of linear operation; alter the fraction(s) of half-cycles of the AC waveform let thru in order to vary the average power supplied to the load; and enter such linear operation to lengthen the duration of transitions between one and the other of substantially conductive and non-conductive conditions. This produces, for a given transition duration, audible noise and EMI suppression. One or more transitions in a half-cycle can be so located as to vary the intensity of a bulb within its design limits, despite the dimmer being connected to a power source having a substantially higher voltage. An example is illustrated in FIG. 18.

Figure 12:
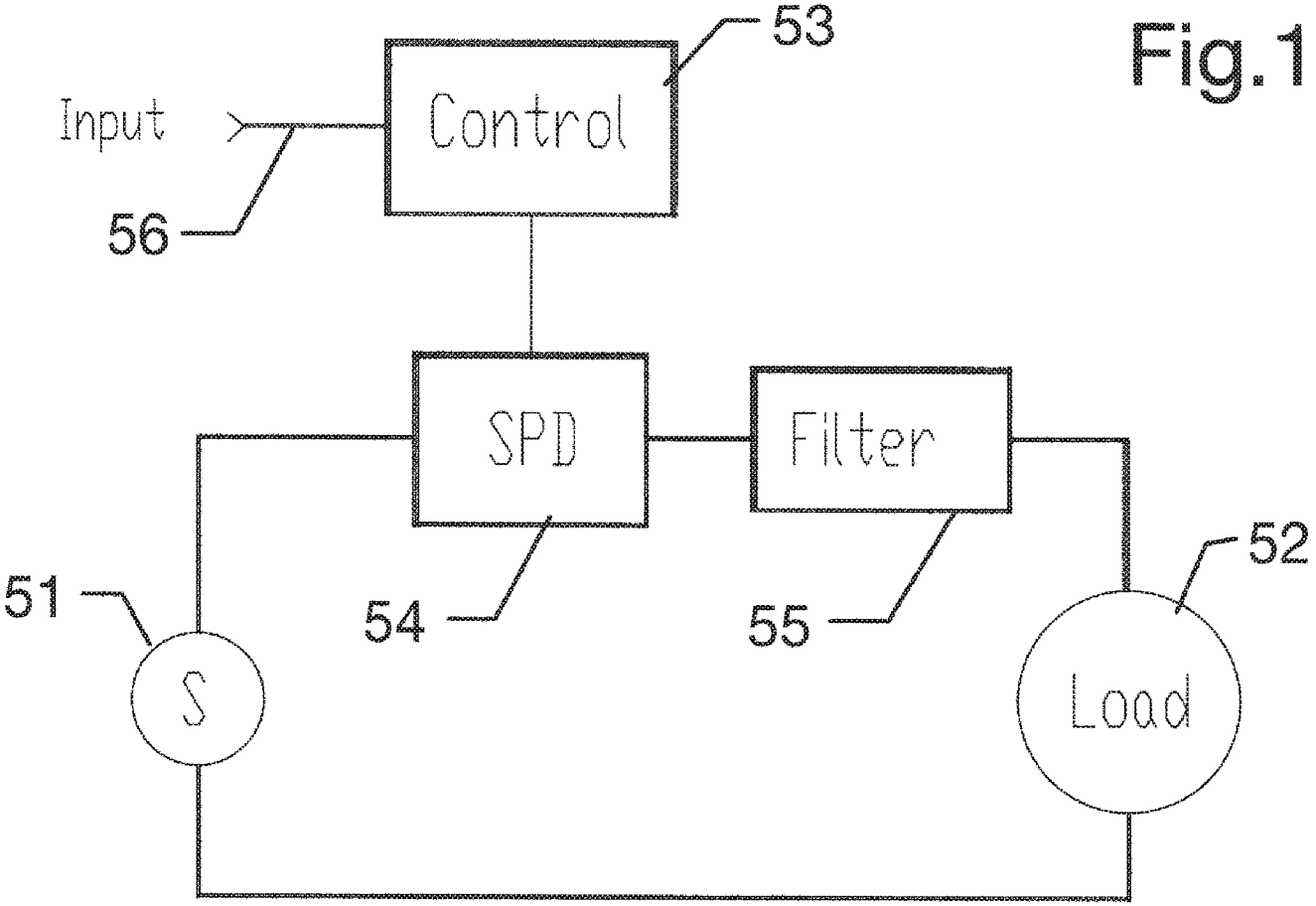
FIG. 12 is a simplified block diagram of a dimmer.

Referring to FIG. 12, a block diagram of one suitable hardware design capable of several different approaches to power control is illustrated. A semiconductor power device (SPD) 54 is connected between a supply (S) 51 and a LOAD 52 with a suitable return. Depending upon the power control approach chosen, the SPD 54 may comprise one or more devices of a type permitting switching (e.g., an SCR or bipolar transistor) or also linear operation (FET). The operation of the SPD is managed by a CONTROL element 53 in the well-known manner, which may receive values and/or instructions from an INPUT 56 corresponding to desired adjustments of the average power to be let thru the SPD 54 and the LOAD 52. Some designs may incorporate a FILTER 55, which may be inductive and/or capacitive or other.

Figure 13:
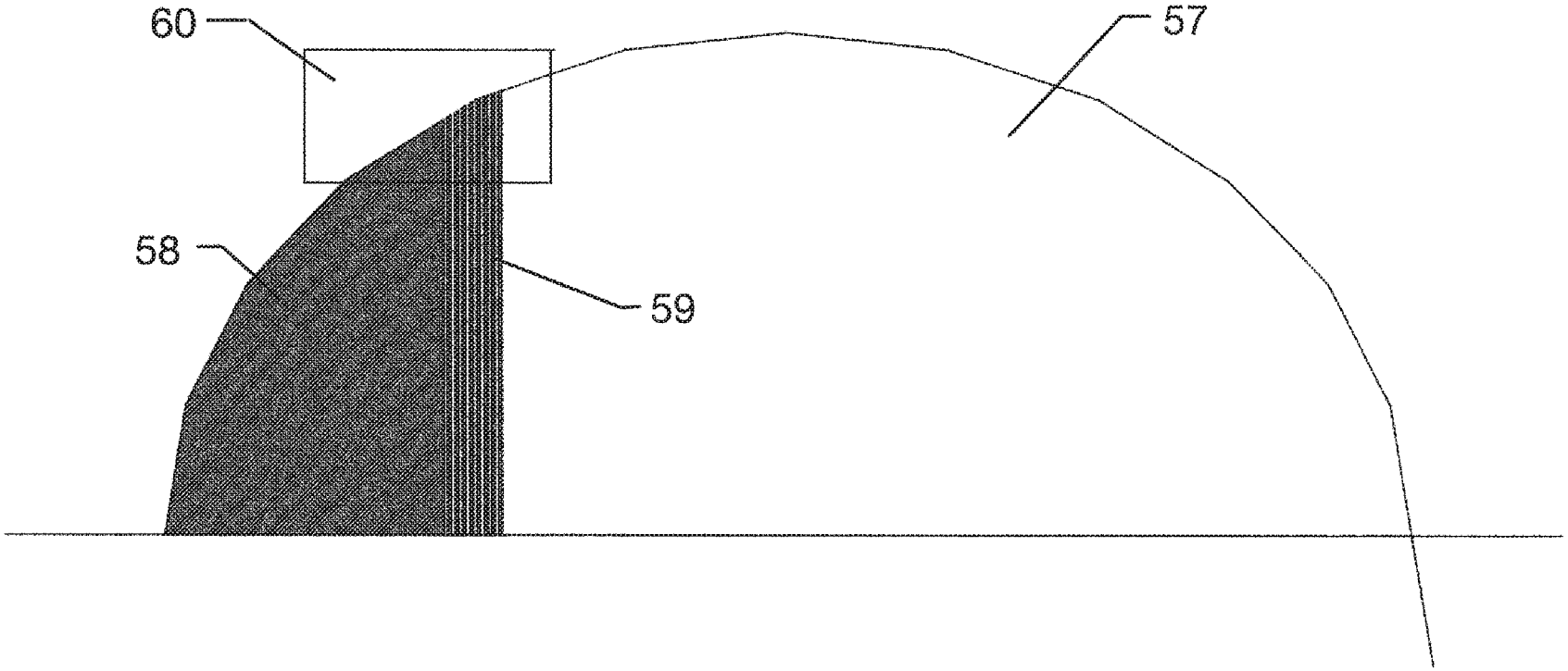
FIG. 13 is a half-cycle output waveform of a power control method employing high speed switching during the transition between one and the other of substantially conducting and non-conducting conditions.
Figure 14:
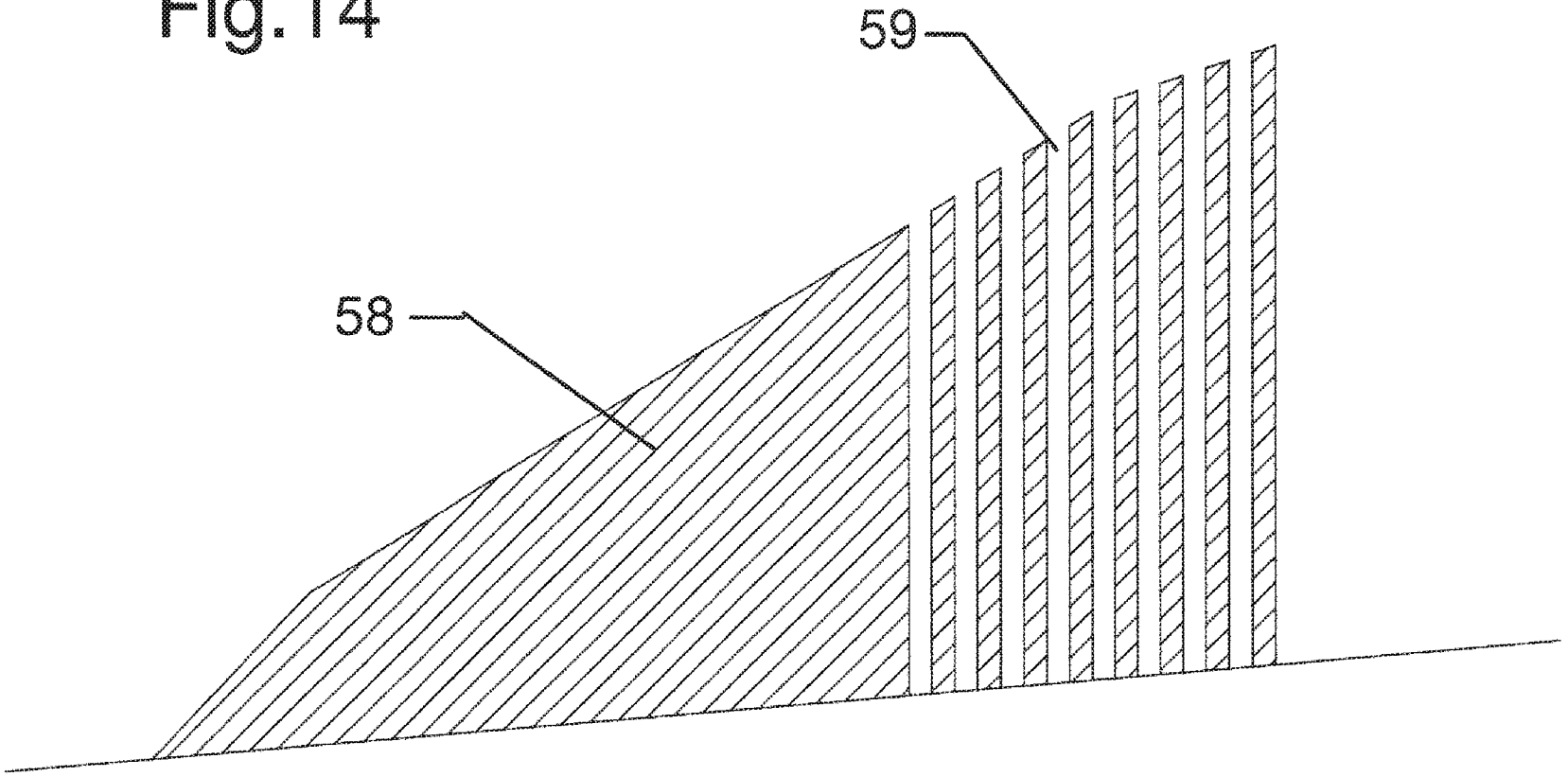
FIG. 14 is a detail view of one area in the prior Figure.

Losses are generated in all prior art approaches. It is desirable to reduce losses, especially thermal. FIG. 13 and detail FIG. 14 illustrates one of several approaches to reducing losses and the thermal load resulting, and achieving other advantages.

Like both traditional SCR-based phase control dimming and controlled transition dimming in some modes, the apparatus of the prior Figure can be employed to change the condition of the SPD 54 between one and the other of substantially conductive and non-conductive conditions, so as to vary the averaged proportion of power available from the supply 51 permitted to flow through that lamp load 52, to vary the luminous output of that lamp load. FIG. 13 illustrates a mode in which an SPD 54 is driven into a "switcher" mode for a period between one and the other of otherwise substantially either conductive 58 or non-conductive 57 states. This "burst" of high speed switching can smoothed by an associated filter means 55. A detail of that portion of the "burst" waveform contained within the dashed box 60 (prior to such smoothing, if employed) is presented as FIG. 14.

The high switching speed allows a reduction in filter size. And the SPD need not enter linear mode to ramp the transition. The size, weight, and thermal losses of the apparatus required by a given lamp load can all be reduced, with many practical benefits.

Many variations in design and operation are possible, and for various purposes.

For example, it has been determined that turn-off transitions ("reverse phase control") produce less in undesirable effects than the more conventional ("forward" or "turn-on") operation for the same transition duration. Such a dimmer can produce forward and/or reverse transitions, as well as employ more than one transition in a given half-cycle such that, for example, transitions are moved to points at more desirable phase angles.

Desirably, such a dimmer can vary its approach/waveform for/responsive to many parameters and conditions, including load, desired output, ambient temperature, ambient noise floor, and the behavior of other power stages/dimmers, including in the same enclosure. For example, to manage total dissipation coupled to a common heat sink; or, for example, to apportion connection of the lamp loads of different dimmers to different portions of a given half cycle to reduce total instantaneous current demand at any single phase angle and/or to reduce induced distortion of the mains waveform.

Inductors can be used for a filter/smoothing, but other approaches are possible. The filament of a controlled lamp load can be used in filtration/smoothing. The use of capacitors has previously been proposed for filtration/smoothing in the context of reverse phase control.

Figure 15:
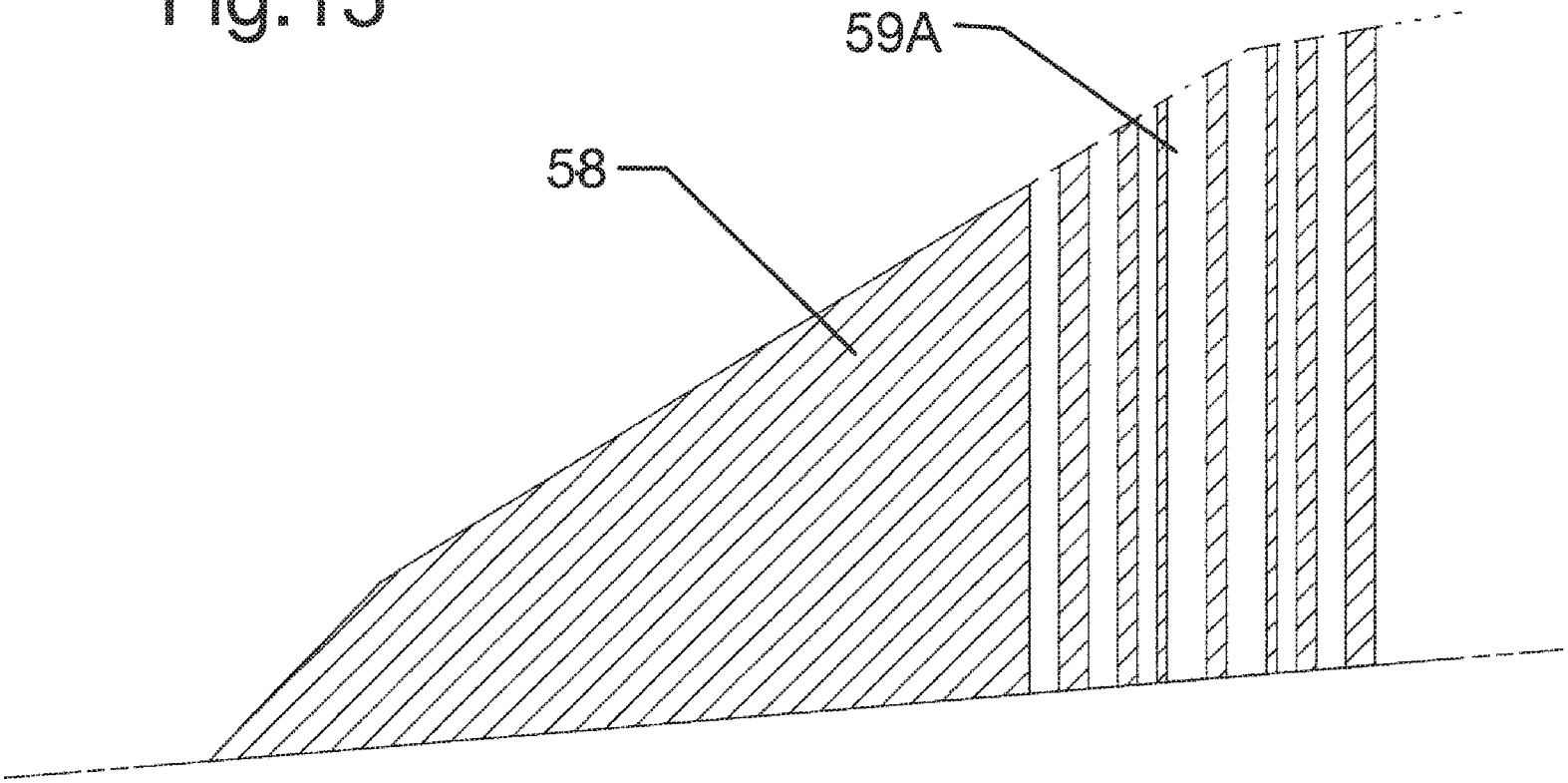
FIG. 15 is a similar detail view of a waveform in which the spacing of switching is varied.

Within the "burst" the number and spacing of switching between conductive and non-conductive conditions can be varied, including for shaping the waveform resulting after smoothing and maximizing the efficacy of a filter design. FIG. 15 is a detail of an example.

Figure 16:
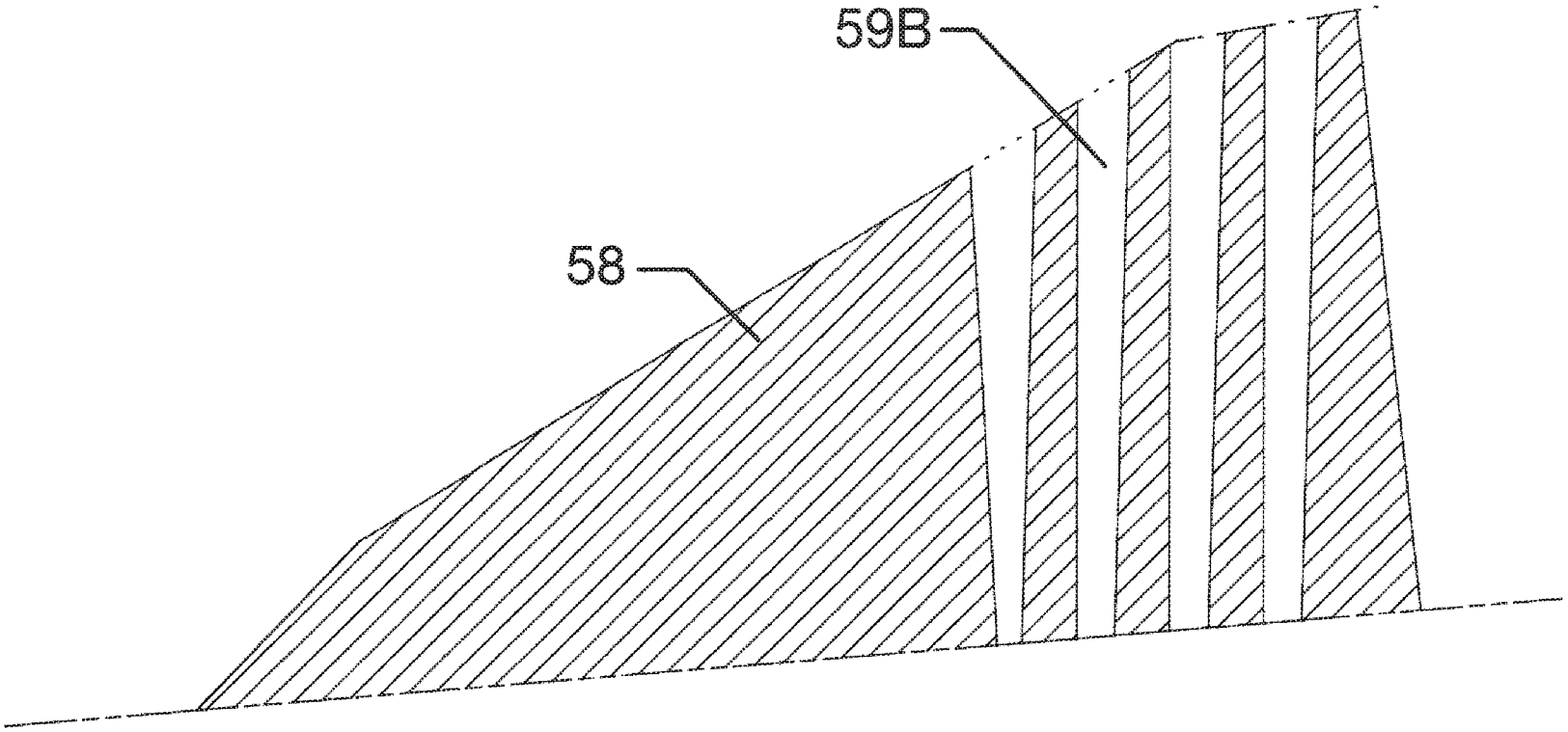
FIG. 16 is a similar detail view of a waveform with ramping.
Figure 17:
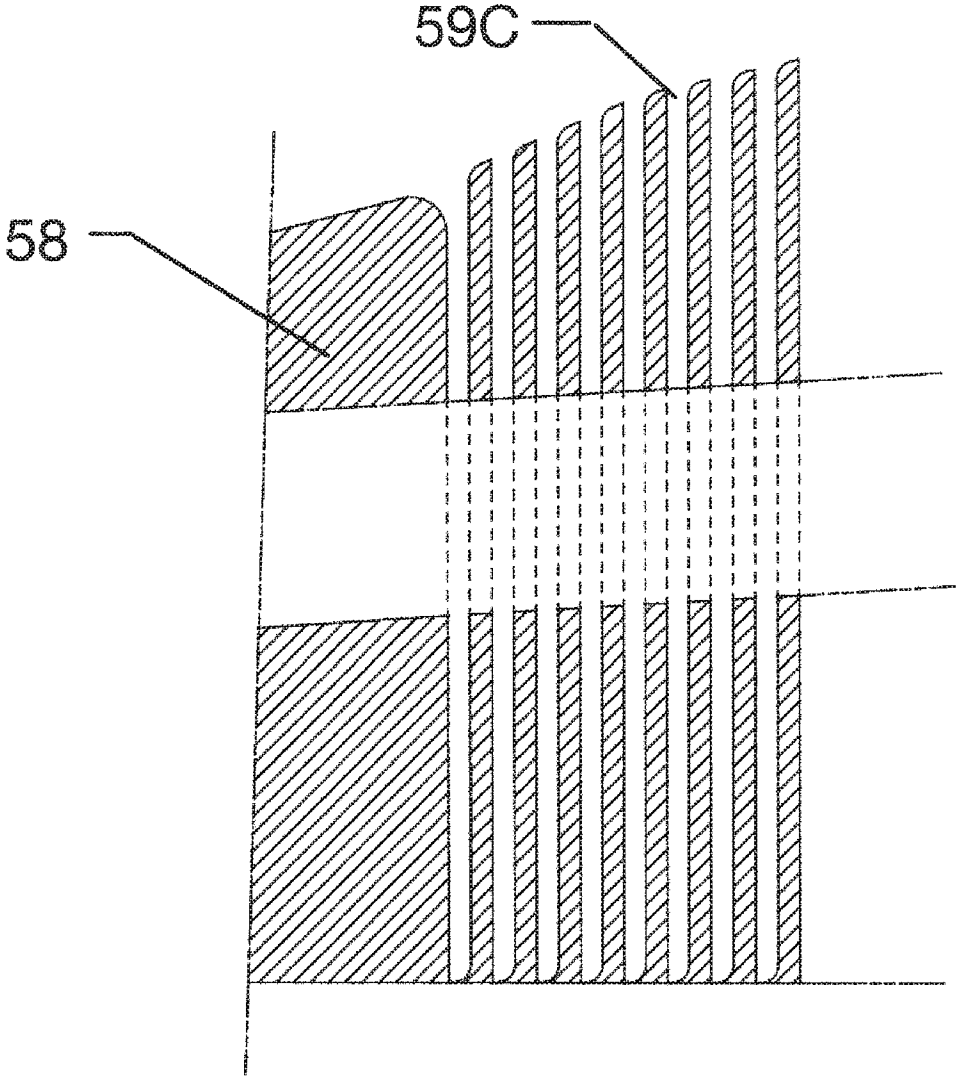
FIG. 17 is a similar detail view of a waveform with rounding.

In addition to shaping the overall transition after smoothing, the SPD can be driven to briefly enter a linear mode. FIG. 16 illustrates a waveform in which various changes between one and the other of conduction and non-conduction are ramped by linear operation to reduce the rate of change. FIG. 17 illustrates a waveform which "rounds the corners" of one or more of the changes between one and the other of conductive and non-conductive conditions. Although losses are higher in either such mode (or a combination of them), their duration is very brief and contribution to total losses modest.

Where multiple outputs/dimmers are employed, a filtration/smoothing strategy can be employed that shares a filter assembly among more than one output/power stage.

Figure 19:
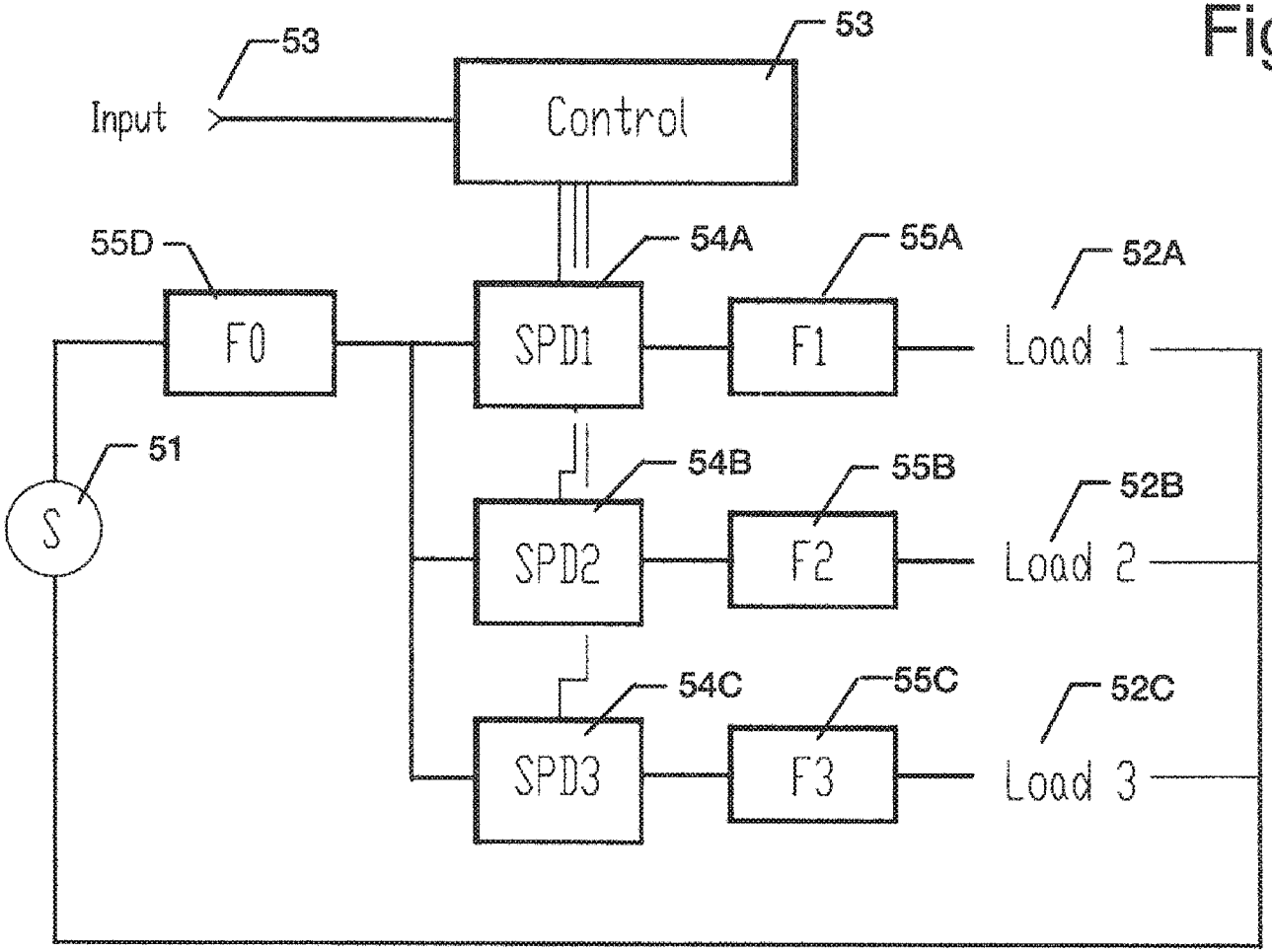
FIG. 19 is a block diagram of three power stages that share a common filter means.

In FIG. 19, three power stages are illustrated, each with an associated SPD; here SPD1 54A, SPD2 54B, and SPD3 54C. Filters/smoothing components can be provided; in common, as described, and here illustrated as F0 55D; and/or for each power stage, illustrated as F1 55A, F2 55B, and F3 55C.

A common and/or compound filtration/smoothing approach can also be of interest when it is desirable that a power input be shared among multiple power stages, at least one of which can be employed for a large load. For example, in the illustrated embodiment, three power stages/outputs are offered that would typically be used with fixtures having lamps of a maximum size/wattage of 750 watts, thereby loading a 20 A power input. However, for those occasions on which, for example, a different fixture type lamped to 1000 or 2000 watts is presented, at least one power stage of the unit would be designated for such use. A shared filter means F0, would serve for either the single large load or multiple smaller ones. (As in all embodiments, current sensing can be used to protect individual power stages against shorts and overloads. It can also be used to prevent loading of one or more outputs on a common power input to produce the total of loads from exceeding the capacity of such a shared power input.)

Power devices or other means can be employed to add, change, and/or bypass one or more shared or individual filter and other components, responsive to load, waveform, and/or other conditions, to improve apparatus efficacy.

A multiple output system can have common and shared elements. A semiconductor power control means may be used for shaping transitions by any of the disclosed methods (including linear "controlled transition" and "burst"/switched modes) First additional semiconductor power control means (SPD) can be provided to connect respective loads via the shared SPD. Second additional power control means (SPD) can also be provided to shunt respective loads to the alternating current supply directly. The phase angle/point(s) in AC supply half-cycles at which the output to each load should be transitioned between one and the other of substantial conduction and non-conduction (and/or vice versa) can be calculated by the control means or other. During said transition, the first additional SPD for that output will be used to pass current to the load via the shared SPD, which will be driven to perform the desired transition. When current should be passed through the load without transition(s), the second additional SPD for the output will be used to shunt current directly from the supply, bypassing the shared SPD. When current should not be passed through the load, neither the first additional nor second additional SPD will be made conducting. As a result, losses resulting from switching and/or linear operation will be concentrated in the shared SPD for dissipation. The additional SPDs will exhibit only modest losses. A common filter means may be employed. Separate filter means may be employed. The transitions performed by the shared SPD can be so-located that the first additional SPDs of more than one output are simultaneously conducting (when transition points are "shared"/simultaneous) and/or so located—or re-located—that the shared SPD is transitioning only one output at a time.

A specific physical embodiment is illustrated, however, the disclosed techniques may be employed in any form.

Further, at least the power control portion of the any physical embodiment, or another, can be made detachable from one or more other portions including, for example, the input and/or output connectors, and the former designed to be alternatively employed as a component in another embodiment having other provisions for other connector types; other connections (e.g., permanent wiring); a plurality of such power modules affording a greater number of controlled outputs in one package, and/or a different form factor.

Improved thermal features include the submersion of at least some heat-dissipating components in a thermally conducting but electrically inert fluid.

The enclosure can also serve as a node/portal for communication with other devices as described elsewhere in the application.

And power inlet and outlet connectors can be selected/designed such that the connector types on inlet and outlet adaptors cannot be mixed such that incorrect voltages/connections cannot be made, such that, for example, the use of a 208 v input adaptor with a 120 v output adaptor results in the availability of 208 volts on the 120 v type outlet connector.

Other improvements and variations are possible, and should not be understood as limited in scope.

Figure 20A:
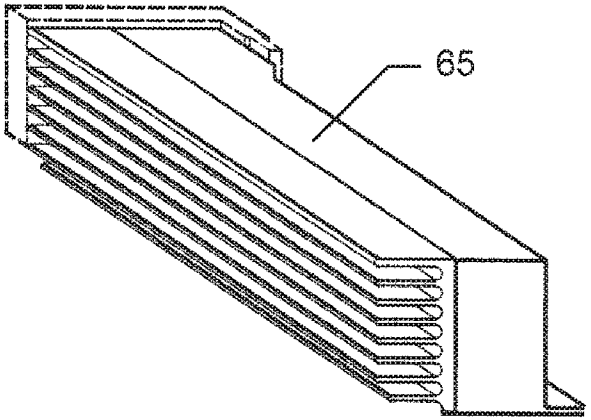
FIG. 20A illustrates one variation of an assembly including at least power control devices and a heat sink.
Figure 20B:
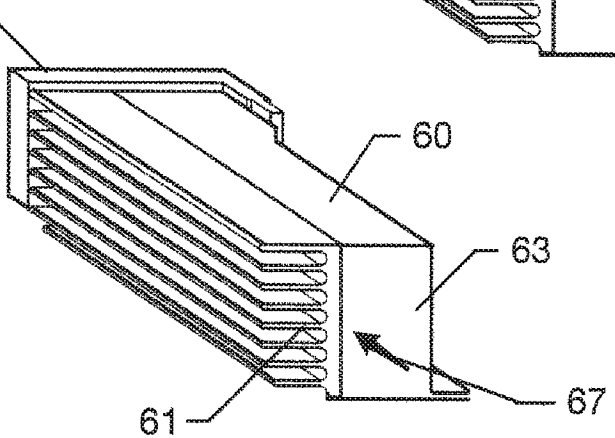
FIG. 20B illustrates another variant having a different length.
Figure 20C:
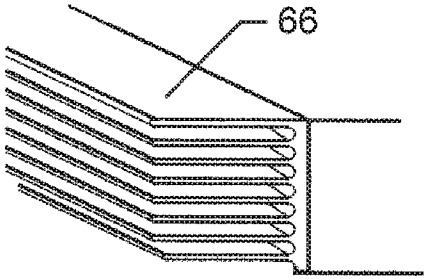
FIG. 20C is a detail of a variant with a heat sink of different fin depth.

Refer now to FIG. 20B. Unit 60 is an example of a known assembly in which the semiconductors used for power control are bonded to an extruded aluminum heat sink 61. An enclosure 63 protects the die and other related components. An associated header 62 may include contacts for power and/or control connections. Forced air cooling may be used with airflow 67 through the heat sink 61. Where power control devices other than SCRs are used, such as previously described, substantially all of one or more power stage, if not a dimmer, can be included in an assembly. The variations 65 and 66 illustrate how the extrusion can be elongated as is 65 in FIG. 20A, and/or the depth and/or spacing of the heat sink fins can be varied (as illustrated in FIG. 20C) to allow for increased thermal conductivity to the ambient, including to accommodate higher capacities and/or numbers of power stages in an assembly.

Figure 21:
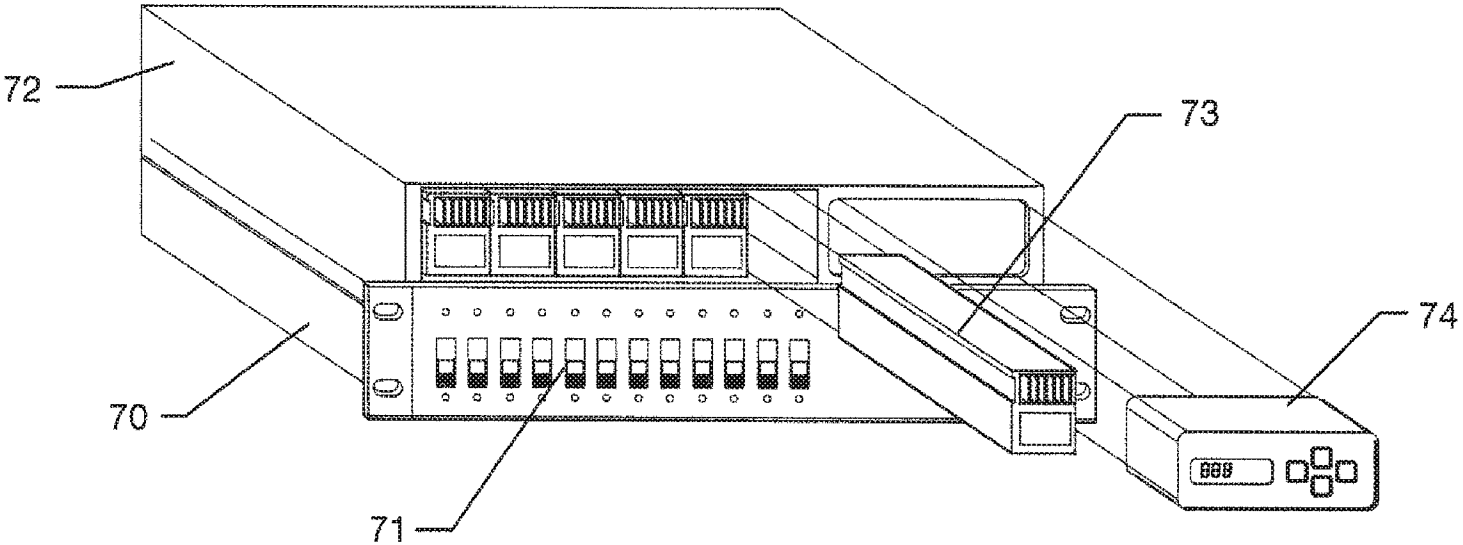
FIG. 21 is a unit combining a power distribution function with multiple plug-in dimmer assemblies.

FIG. 21 illustrates such assemblies as pluggable into a chassis that includes power distribution functions, such as illustrated in detail in a prior application. The chassis 70 included circuit protection devices 71 and a portion 72 to accommodate power stage assembles 73 and a control electronics module 74.

Such an arrangement increases the height of the chassis, reducing the quantity of circuits that may be supplied from a rack or other assembly of a given size.

Figure 22:
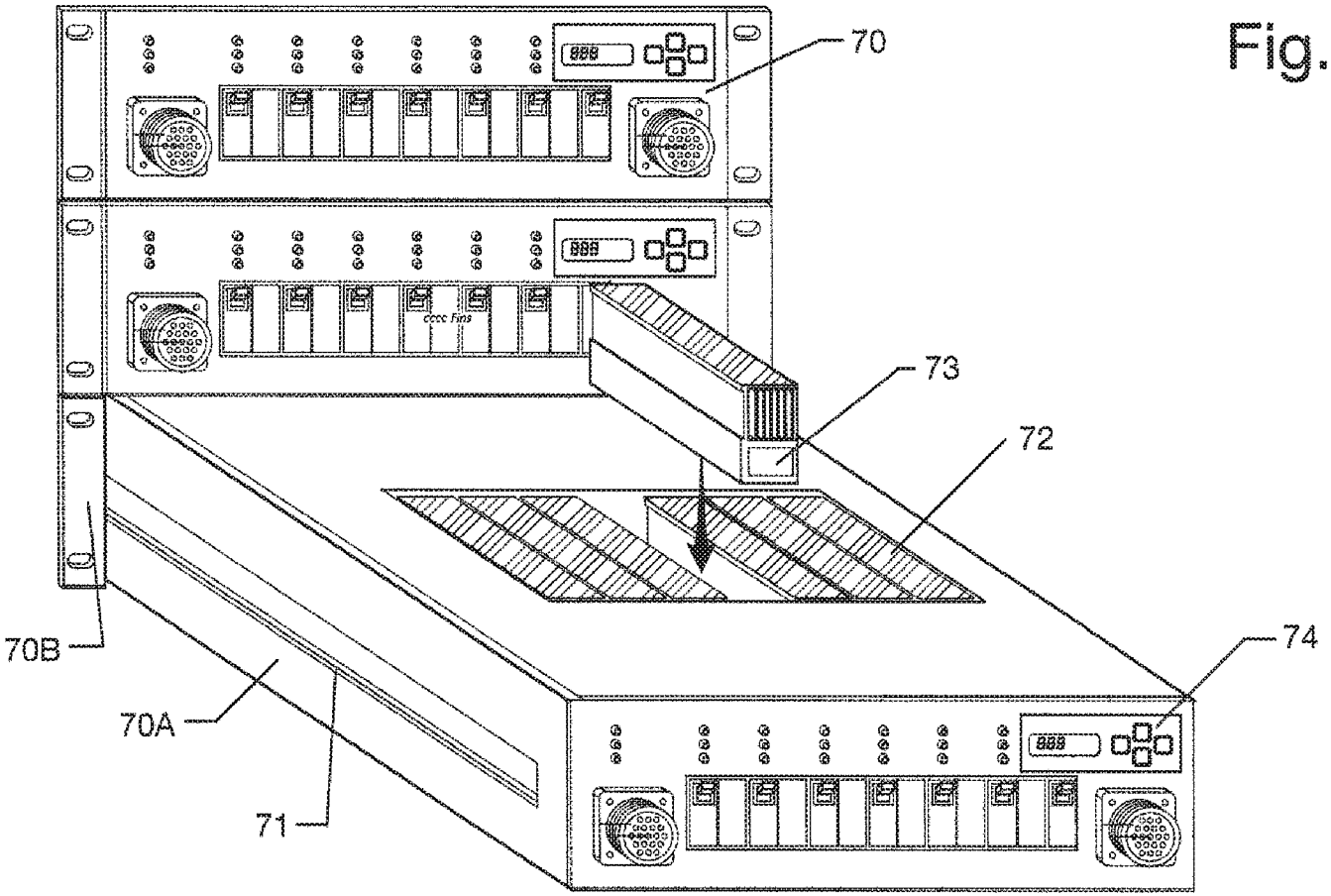
FIG. 22 is a unit generally similar to that of the prior Figure in which front panel area is reduced.
Figures 23A, 23B, 23C, 23D:
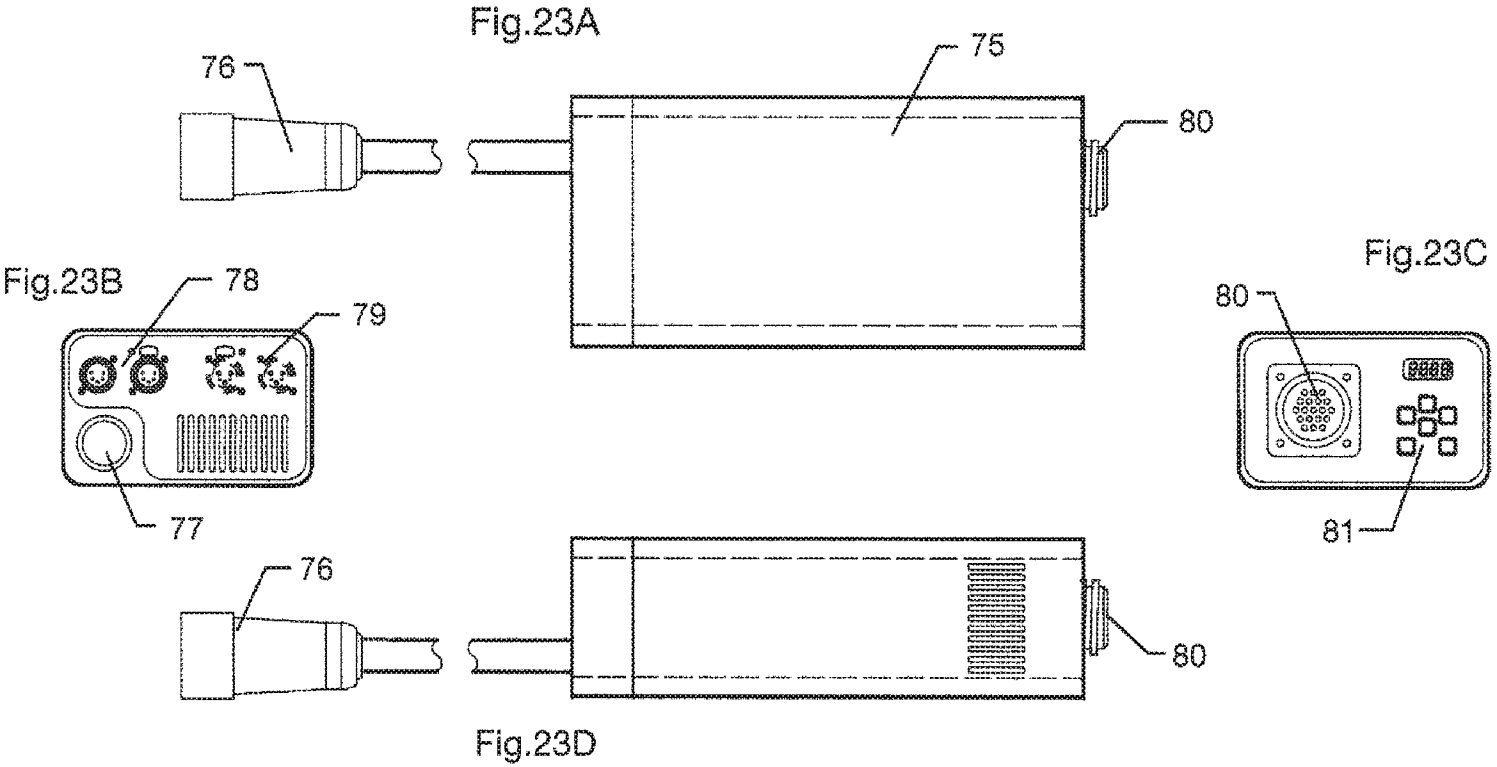
FIG. 23A is a plan view of a dimmer enclosure with power inputs and outputs via 6-circuit 19-pin connectors.
FIG. 23B is one end elevation of the unit of FIG. 23A.
FIG. 23C is the other end elevation of the unit of FIG. 23C.
FIG. 23D is a side elevation of the unit of FIG. 23A.

FIG. 22 illustrates an improvement in which access to, including replacement of dimmers and dimmer power stages can be provided without an increase in height, relative to the requirements for distribution undimmed power alone. Unit 70 includes provisions 72 between the front and rear surfaces and their connectors, circuit breakers, and indicators, to accommodate modules containing at least the power control devices of one or more dimmers 73. Forced air cooling can be provided, as can control electronics either in the same unit (e.g., 74) or in another. Access to these provisions can be provided by a "works in a drawer" approach in which brackets 70B attach to the rack or other enclosure, and chassis 70A is connected by known drawer slides 71, such that chassis can be displaced sufficiently clear for the purpose.

FIGS. 23A-D illustrate another enclosure for dimming.

As illustrated in FIG. 1, national and international lighting practice for portable lighting generally employs the known "Socopex" connector in a 19-pin, 6-circuit configuration. As illustrated, known "breakouts" such as 144, 154, and 164 are employed to convert to the single-circuit connector, which may differ for the same function between different users.

The dimmer unit 75 illustrated in the Figures employs a female 19-pin configuration for outputs, reducing the panel area requirements, and, therefore, the size of the enclosure and permitting the same unit to be used regardless of the single-circuit connector type employed.

Data input and through are provided as 78, with an addition connector set (for example 3-pin XLR) possible as 79. Six separate power inputs are accepted via Soco pigtail 76, attached via strain relief 77, with a dimmer power stage inserted in each circuit between it and the corresponding output circuit in receptacle 80. A user interface 81 is provided, as are means for mounting the enclosure to a structure.

FIGS. 24A-24D illustrate an enclosure in which the power input to the unit is by means of two circuits, here via Neutrix inlets 82 and 83. As illustrated in prior Figures, inlet line cords/pigtails can be selected with the desired power connector type, for example, 23A.

Paralleled feedthrough receptacles can be provided.

Figure 25A:
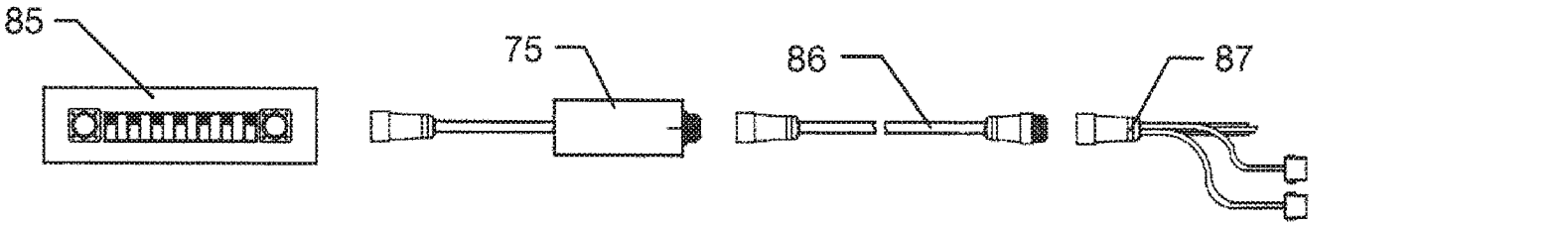
FIG. 25A is a block diagram of the unit of the prior Figures disposed near the unit providing for distribution to the circuits input.
Figure 25B:
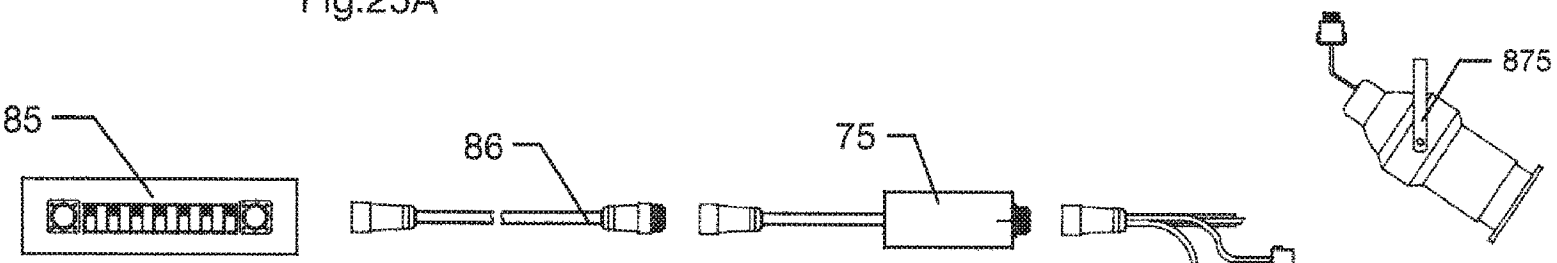
FIG. 25B is a block diagram of the unit of the prior Figures disposed near the lamp loads.

FIGS. 25A and 25B illustrate the flexibility of the illustrated unit.

In FIG. 25A, the unit 75 is located at or near a power distribution unit 85, supplying the required circuits. A multi-cable extension 86 connects the unit's outputs with distant loads, such as fixture 875, including by means of a breakout 87.

In FIG. 25B, the unit 75 is located in proximity to the connected loads, and at least one extension multi-cable 86 connects it with a distant power distribution unit 85.

FIGS. 26A-F illustrate that the choice of power input connection can be made field-changeable. A connector, here incorporated in an end cap assembly 84A of FIGS. 26A-D, includes a multi-pole, multi-circuit connector 88, which couples with a corresponding connector interior to the unit. In version 84A, a cable clamp, such as 77, which passes a pigtail, here as illustrated in three of the possible version with a 6-circuit Soco (FIG. 26B), a 4-wire twistlock (FIG. 26D), and a 5-wire twistlock (FIG. 26C). In version 84B of FIGS. 26E and 26F, the panel mount Neutrix inlets 82 and 83 are illustrated. It will be apparent that other connector types can be employed in either pigtail or panel-mount versions. The use of a pigtail can reduce panel area and, as illustrated in FIG. 25A, allow connection to the panel-mount receptacle of a power distribution unit without need of a short multi-cable extension. A similar technique can be used on the output side to allow changes in output connector(s) and/or pinout. Not all users employ the same pinout for the Soco connector, and differently-wired such assemblies can allow the same unit to be employed by different users without modification.

Electrical Parameter Measurement and Reporting

The distribution and use of electrical power in lighting systems and many other applications requires utilization of supply services and generators and distribution cabling and equipment within their safe working capacity. For this purpose, measurement and display, if not remote reporting, of parameters including voltage, frequency, and current are desired. Improvements to such functions are disclosed.

Figure 27A:
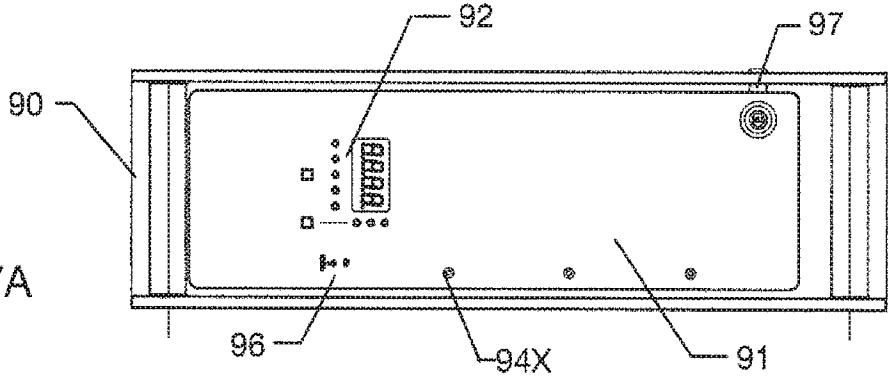
FIG. 27A is a plan view of one embodiment of a unit measuring the electrical characteristics of a multi-phase supply service.
Figure 27B:
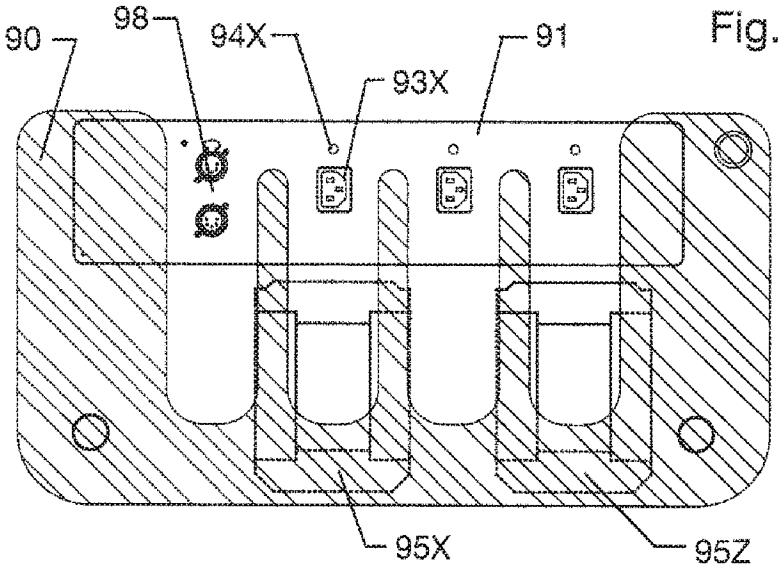
FIG. 27B is a side elevation of the unit of FIG. 27A.
Figure 27C:
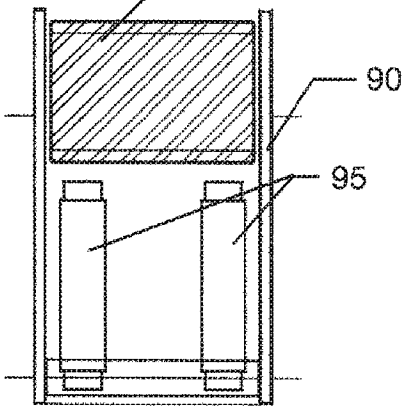
FIG. 27C is an end elevation of the unit of FIG. 27A.
Figure 28:
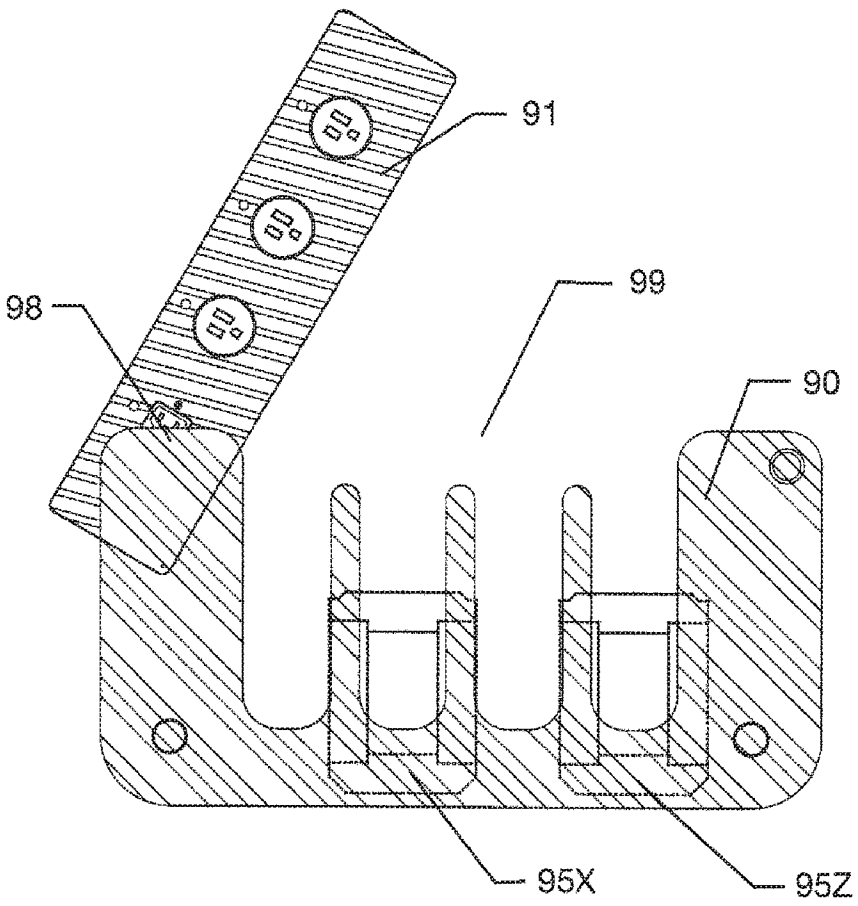
FIG. 28 is a side elevation of the unit similar to FIG. 27B with the electronics enclosure hinged upwards for cable insertion.

A percentage of elements used in distributing and employing electrical power might incorporate metering provision for the power they consume. Such is not always the case and a number of elements are often combined on a common supply branch, requiring a determination as to the total power that they consume. An independent unit can be provided for insertion in the distribution system for measurements of the common service and total load. One type is of the plug-through variety, in which the service is coupled through the unit, where measurements are taken. Fewer connections are required if the current flow need not be via the unit. Refer now to FIGS. 27A-27C, one embodiment of such a unit. As seen in the Figures, current transformers 95 are provided for at least three phases, if not neutral and ground. Single-conductor high amperage "feeder" cables are passed through the gaps in the current transformers, which may be of the "split core" type (e.g., as manufactured by WattCore) that also permit insertion and removal of a continuous cable, including when energized and conducting. As illustrated, such transformers mounted in an enclosure formed of non-conductive material. An inner enclosure 91 includes associated electronics and mounts a display and associated controls 92. In this embodiment, the inner enclosure can be closed around the conductors and locked with 97 to prevent its removal, and hinged upwards, as illustrated in FIG. 28, when desired.

Measurement of voltage and calculations using both voltage and current are not practical without a connection to the conductors. It has been suggested by others that this can be provided for without the complications of the plug-through approach by employing low-current convenience and other circuits on other equipment supplied by the same service to sample such voltages. As such, the Figures illustrate inlet connectors (in both IEC 93X and Edison styles) for the purpose. For such measurements and calculations based on them to be correct, the voltage sample must be from the same phase as the current transformer. Comparison of voltage swings with current sensed can determine whether a voltage input is from the correct phase—or such comparisons can be used to make the correlations automatically. In the Figures, an indicator (e.g., 94X) reports whether the two match. Current transformers generate significant power, so that the unit can derive at least some its operating needs passively from one or more transformers; from one or more sample input; and/or from a separate inlet (e.g., 98). The unit can be equipped with battery or supercap storage for operation when operating power is not available, and to report its loss (rather than what might be as failure of the unit itself or a communications link).

Figure 29:
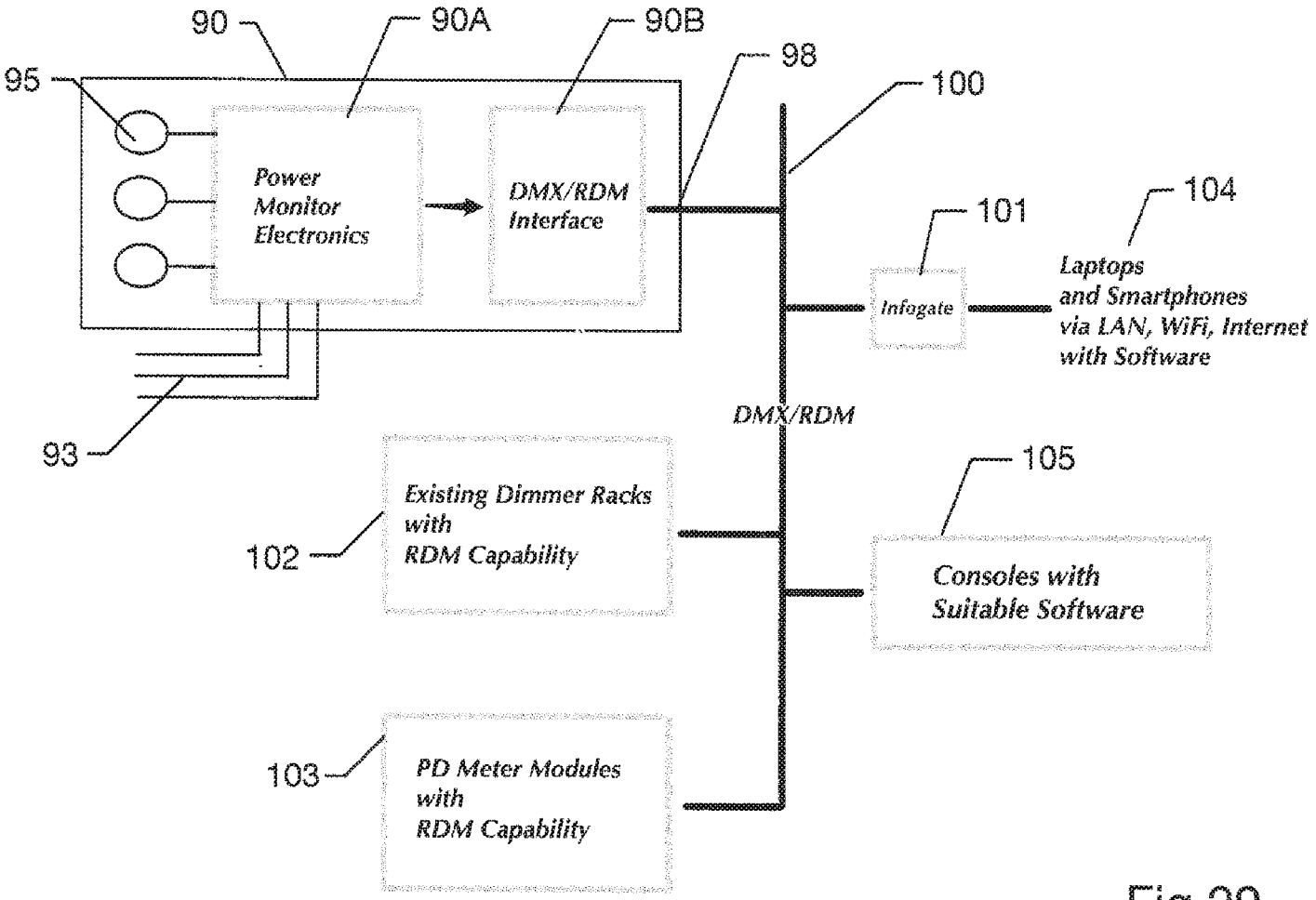
FIG. 29 is a block diagram illustrating networking of power measurements.
Figure 30:
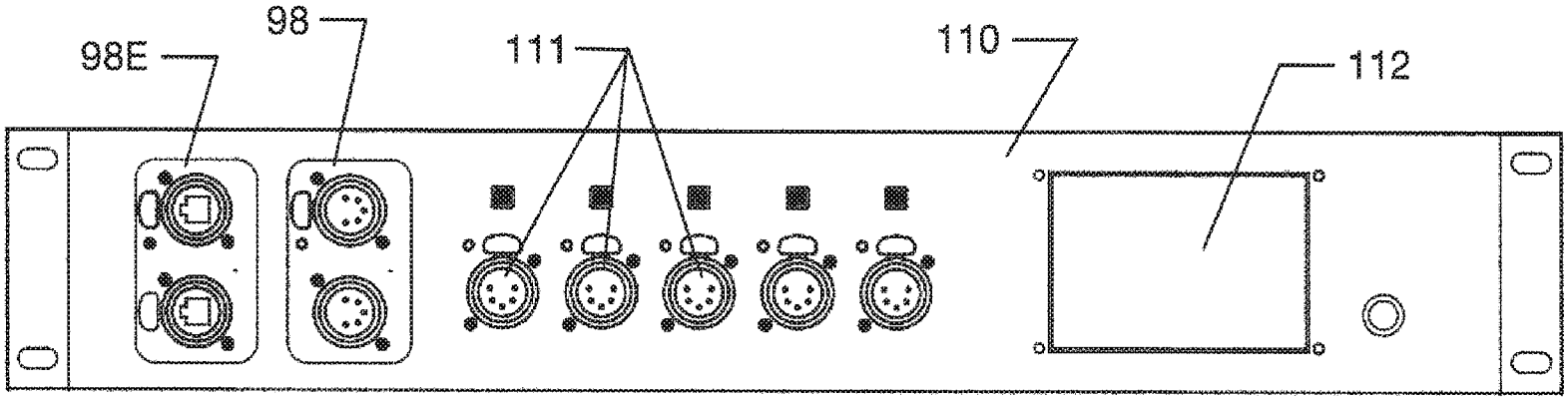
FIG. 30 is a front elevation of a unit combining power measurement electronics with reporting, data distribution, and down-conversion features.

It is desirable that it be possible to determine real time values from another location, and networking of power sensors in building management is known. The unit illustrated provides for the use of the known RDM variant of DMX-512 for this purpose. FIG. 29 illustrates some of the alternatives. Power monitor 90 includes current transformers 95 and voltage inputs 93, which are processed by known electronics 90A. Measurements are coupled to a transceiver 90B, communicating via connectors 98 with a DMX/RDM network 100. Multiple such monitors can be connected to the network 100, and their values accessed by lighting control equipment with suitable software (e.g., console 105) and by personal computers, tablets, and smartphones 104 connected by interface 101. Values can be linked by wired or wireless means. Values can also be derived from existing equipment with modest modification. Dimmer packs and racks, for example, sense at least voltage for internal purposes and may be supplied with RDM software. Such software can be amended to report voltage. Similarly, some modular power distribution systems offer optional metering modules for local display of voltage, frequency, and current. With the addition of RDM reporting, such values can be networked. FIG. 30 illustrates that the functions of measurement, local display, and networked reporting can be integrated in a common unit. Unit 110 accepts current and voltage inputs; provides local display and control with LCD touch screen 112; has RDM reporting; and includes DMX/RDM "opto" distribution to outlets 111 and Ethernet down-conversion/communication via outlets 98E in a single package.

The associated electronics 90A and network interface 90B can be packaged separately from the current transformers, which can be of the clamp-type often used externally with multi-meters (e.g., Fluke). This provides, among other advantages, greater flexibility in the ability to sample conductors. One or more connectors or other means to couple the sensing functions with associated electronics and/or display such that current transformers can be permanently installed in equipment and the display and/or reporting function readily added, including on an "as needed basis".

In circumstances where step-down transformers are used in high current distribution, two or more sets of feeder might be provided for on the secondary side, requiring an equal number of power monitors to total. Illustrated is a scaling switch 26, which allows metering current on the higher voltage primary side while sensing voltage on the secondary, with corrected conversion of the current input value to reflect on the secondary side.

Improved Addressing and Interface

All of the device types illustrated in FIG. 1 and many others require receipt of values from an external source. This might be via an input from a serial data stream, such as the well-known DMX-512 protocol, one that includes values corresponding to desired adjustments to the operation of the device, such as for a beam parameter like intensity. Devices might also accept additional values, whether via the same serial data stream and/or otherwise, such as for mode selection and operating commands.

Because such serial data streams typically include values for a plurality of devices to be independently controlled, a method is required to specify to which subset of all the values in a data stream a given device should respond. This is called "addressing", and, in data formats like DMX-512, is done by setting a "starting address" (often the first byte of the relevant subset in the data packet) typically using an operator interface on the device.

The "RDM" enhancement of the DMX-512 protocol is intended to simplify some operations. A bi-directional protocol, RDM assigns every unit of every model of every device a unique identifier/"serial number". Exchanges are defined, in which devices on a serial link can be identified, and with which DMX-512 starting addresses, modes, and commands can be sent to a device, as well as condition and other information queried from it. However, determining the RDM address of a specific device is a precondition to initiating the conversation with a device for these purposes, just as setting a starting address is required for device control via the DMX-512 protocol itself.

Figure 31:
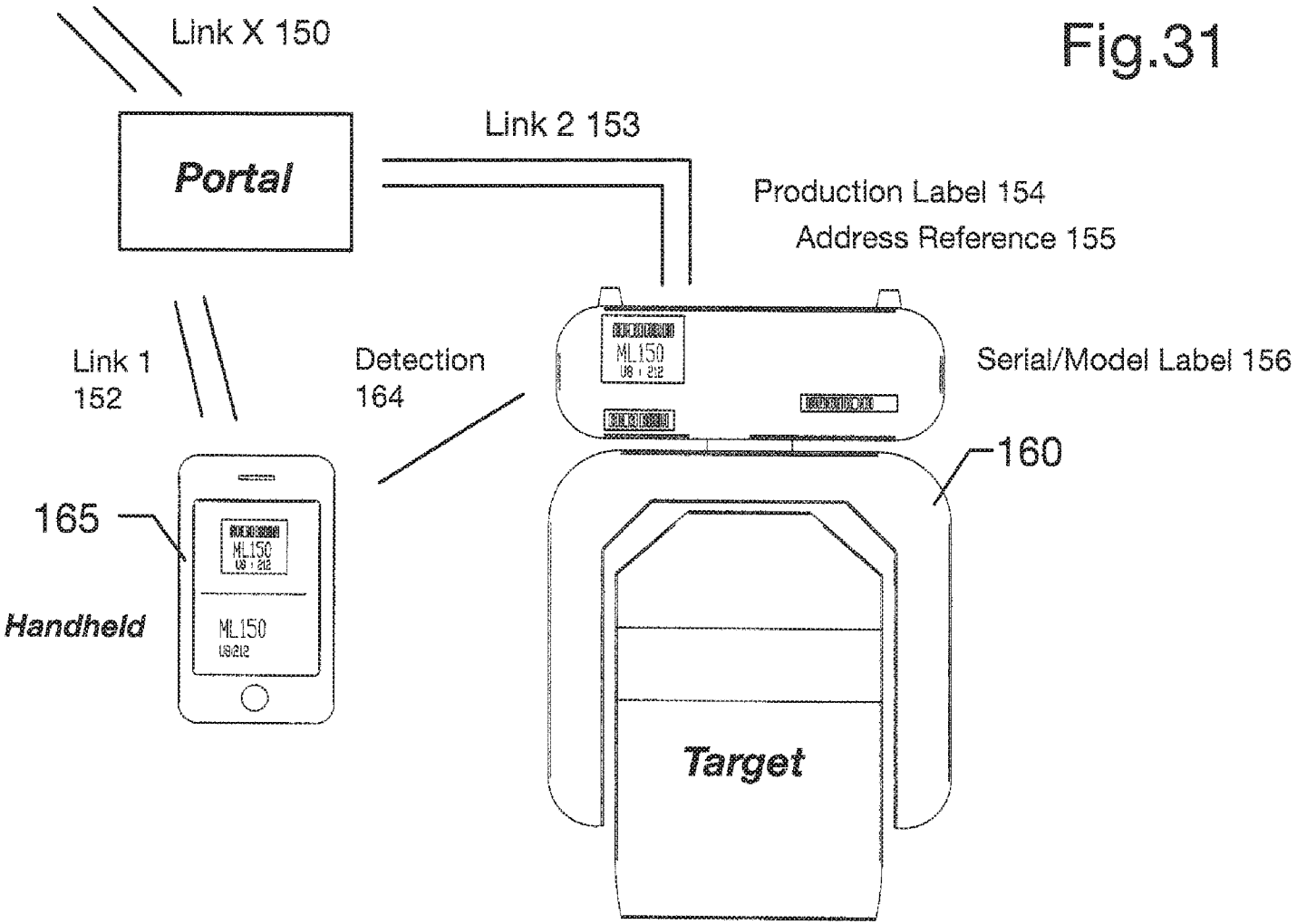
FIG. 31 is a block diagram of improvements to accessing and addressing devices.

Refer now to FIG. 31, where improvements for gaining control over devices and setting their addresses are illustrated.

Illustrated is at least one device (the "target") 160 with which an interaction is desired. Also illustrated is a physically separate means (here a "handheld") 165 employed by a user in such interaction, which can be a "smartphone" or "tablet".

The target 160 is provided with at least one means by which it may be identified, including with the handheld 165, here a bar code or similar (although other means can be employed). That bar code or other means (e.g., RFID; the flashing of an indicator or other output that can be sensed and decoded) can encode an identifier (such as an IP address, an RDM identifier, or another value linked to one) that can be used to establish communication with the device 160 (here the "address reference"). For example, using a scanner (e.g., by Symbol Technologies); a scanner accessory to a smartphone; or a smartphone or tablet with digital camera and recognition software (e.g., RedLaser), reading the address reference on the desired device.

The handheld 165 can be employed by the user in identifying the specific device desired for interaction, especially when several similar devices are in proximity. A laser-based scanner's visible beam, in scanning a bar code, is inherently employed to point at/designate only one object; that whose corresponding bar code is being scanned. In the case of a camera-equipped device, a video image in the handheld's display can assist the user in framing the bar code or other identifier of only the intended device in the image, such that it will be scanned (or by identifying a plurality of such images in an image and prompting the user to touch one on the display). Visual, audible, and/or tactile cues can confirm the detection of a valid identifier. And LED-equipped devices can be "strobed" at high rates with encoded values, such that an image of the outputs of multiple fixtures can be differentiated and the one designated be detected.

In one mode of operation in the illustrated embodiment, the combination of an identifier on a target and a means provided by a second device (the "handheld") capable of reading/detecting it permits configuration for communication (including between these two) to be made automatic.

In one example, where both handheld and target are provided with compatible means of communication (including, but not limited to a wireless link, including Bluetooth or IR), the identification of the desired target by a handheld can be used to provide the handheld with an address or other identifier that can be used to initiate communications in one or both directions via that link. For example, the handheld 165 can be provided by such detection/identification with an address (such as an IP address or serial number) that permits the target to identify subsequent commands broadcast by the handheld as being intended for it. A general broadcast by the handheld can also trigger a detectable response by the target (as well as other devices) with its address or other means to uniquely contact it, but the range and/or field of view of the handheld's detection be so limited as to recognize only the target's response (although other devices might be responding as well) or allow the user to select one of the responding devices from a common display of them.

By whatever method, identification of an address or other means of uniquely "speaking to" a target permits communication with it.

Importantly, embodiments include those in which the handheld and target are not equipped with compatible means for direct communication (or in which such means is not used to initiate communication). For example, in FIG. 38, a "Link 1" 152 and a "Link 2" 153 are illustrated. Link 1 152 might be a wireless connection such as wifi or Bluetooth. Link 1 152 can couple the handheld with a third device 151, a "Portal". "Link 2" 153 couples the portal with the target 160, for example, ultimately via a connection such as DMX/RDM, provided to, for example, couple desired parameter adjustment and other information between a controller (such as a lighting console) and the target.

The target 160 need not be capable of communicating with the handheld via a Link 1 wireless connection, nor the handheld have a Link 2 connection, but, by detecting a suitable identifier from the target, the handheld can communicate with the target over both links. Such communication can provide for direct control of function, setting of address, feedback of status and other data, and identifying the device in relevant communication with other devices or for other purposes.

The term "portal" identifies at least one point where two links are coupled and where information can be bridged.

The "Link X" 150 illustrates that the "portal" 151 will likely be but one component in a networked system that might include, for example, controllers and stores for non-cue database information (subsequently described).

The function of a "portal" can be served/incorporated in many forms and device types, including data distribution equipment, fixtures, and dimmers.

The disclosed method permits direct control of a target by the user regardless of whether or what address employed by the console/control system via Link 2 has or has not been assigned. And it can be employed to set or reset a "Link 2" address.

Gaining control is automatic, and not subject to human error. The identifier read can be applied to many surfaces of the device at little cost so that it can be read in many orientations. Only the addition of an identifier label or other means to identify the target device is required. The same components and RDM software used for normal operation now provide a means to connect a sophisticated handheld controller. The advantages in retrofitting existing designs, if not inventory, are especially important.

In device control, the use of a "smartphone" or "tablet" with a universal "app" provides a user interface that is more convenient, versatile, friendly, and sophisticated than that which is offered on most products, a uniform interface can be used to interact with many different types, brands, and models of device, with the particulars of the machine level interaction necessary handled by the protocol.

The identifying value can be an address itself (such as IP address or RDM serial) or can serve as a pointer to such or any other data required for communication. FIG. 38 illustrates a label 154 with values associated with a specific use; a bar code with an IP and/or RDM address 155; and a manufacturer's model and serial number 156.

Scanning the same or other identifiers can be used for other purposes.

As, for example, RDM codes identify manufacturer and model, and a serial number often provided in bar code form, the handheld can access instructions and specifications for the product via onboard software and/or recourse to files elsewhere in the lighting control network or online, including for the current firmware/software version.

Property/inventory control bar codes/identifiers applied by a shop or owner can be used for inventory updating, as well as to report issues with equipment. Where a device has onboard diagnostics, the user can link its error reporting as well as their own description of the issue(s) back to the owner or maker for prompt support.

And such techniques can be employed in other situations in which interaction needs to be established between two devices, such as interfacing peripherals to personal computers.

Bar coding and other forms of automatic identification are widely employed in our modern world. Bar coding/automatic identification in lighting has been limited to inventory control for owners of equipment and for identification of model and serial number by manufacturers of products made in large quantities.

Fixtures, cables, and connectors can have having applied with both machine and human readable values. A bar code or other method could be an encoding of the same value(s) that appears in human readable form. Or it can be arbitrary, serving only as a pointer to a record in a file that contains relevant information.

It is also possible to use labels with only machine-readable values, which uniquely identify a given item (with or without identifying its type or model). This includes bar codes and other identifiers provided as/with serial numbers by a manufacturer.

In one example, a user generates a database describing the location, function, and power and data connections of the items in a lighting system, using long known database software. In addition to the traditional tabular reports, labels are printed like those illustrated, for application to the item and with, in these examples, both machine- and human-readable values. Suitable labels and printing techniques are, for example, widely used by the airlines, including for bag tags. Like present hand-written or printed labels, those illustrated can be designed to present the value or values desired by the user to identify the item, its location, its connections, and/or other information as read and translated by a, preferably, handheld reader, such as previously described. Used as a pointer to a record or records in one or more files, those files being accessible on the handheld or via a connection between it and a server at another location, "reading" a label can access information related to the item that is not present on the label.

Further, the handheld can serve as a data entry terminal so that when new or changed information about or relevant to the referenced item arises the user, by entering it, modifies the master record(s), such that its accuracy and usefulness is increased. Where multiple users have handhelds and other access, whether through lighting controllers or generalized personal computers, all can access the master record(s) such that the most current and complete information is available. Replacement labels can be printed, if desired, but simply placing a mark on the old label can signal that some value(s) on the label are no longer accurate and that it should be scanned for a current update.

In addition to generating labels from a prepared specification, entry of information can be used to document an "improvised" configuration to permit maintaining it and later reproducing it. Scanning a fixture, electrical connectors, and a nearby location identifier can produce a record of fixture type, location, and circuiting, as well as a "plot" or graphical spacial representation of the physical layout.

Scanning identifying labels, like the previously described addressing scheme, can be used to gain control over a device for testing or adjustment purposes.

Various of the units and techniques described herein can cooperate in a larger system.

For example, elements also seen in FIG. 29, including remote power monitors (RPM) units 90A and 90B, can be coupled to a DMX/RDM network and to a dimmer rack, console and laptop. A network (a DMX "universe") can be connected with a unit, as previously described, which also has a higher bandwidth connection to an Ethernet-based network, which, in turn, is connected with a unit, which, in turn, is connected with a second DMX/RDM universe. The second DMX/RDM universe, can couples additional power monitors, as well as a power distribution unit, which could include an integrated interface such as 100, and also with an interface. A smartphone can be coupled by wireless link with a nearby unit. It will be seen, for example, that while some remote power monitors are on different DMX/RDM "universes" than remote power monitors, that a connection via a network- or, for example, by another route, provides access to all four—as well as other devices.

Figure 32:
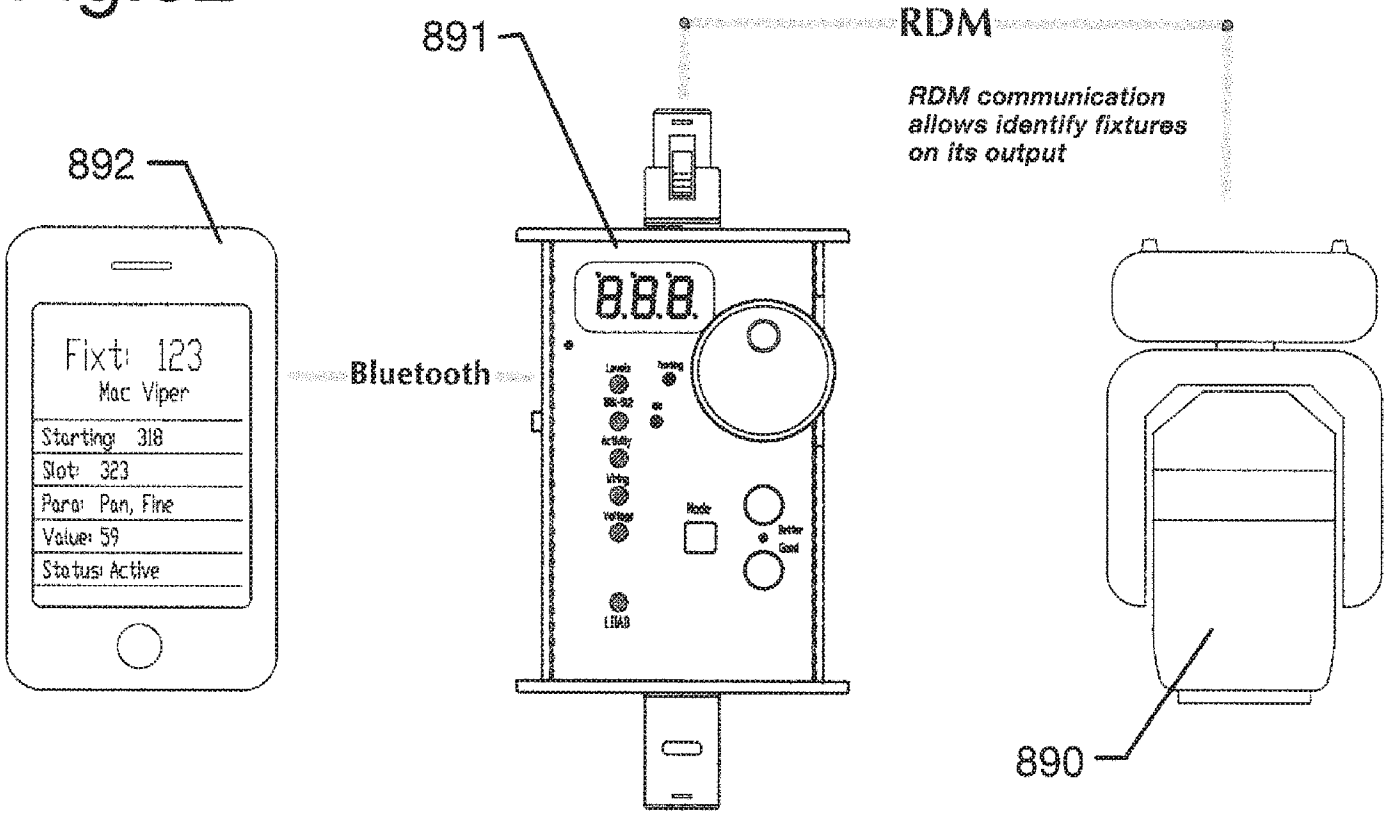
FIG. 32 is a block diagram of a smartphone and adaptor for various interactions. with a device.
Figures 35A, 35B:
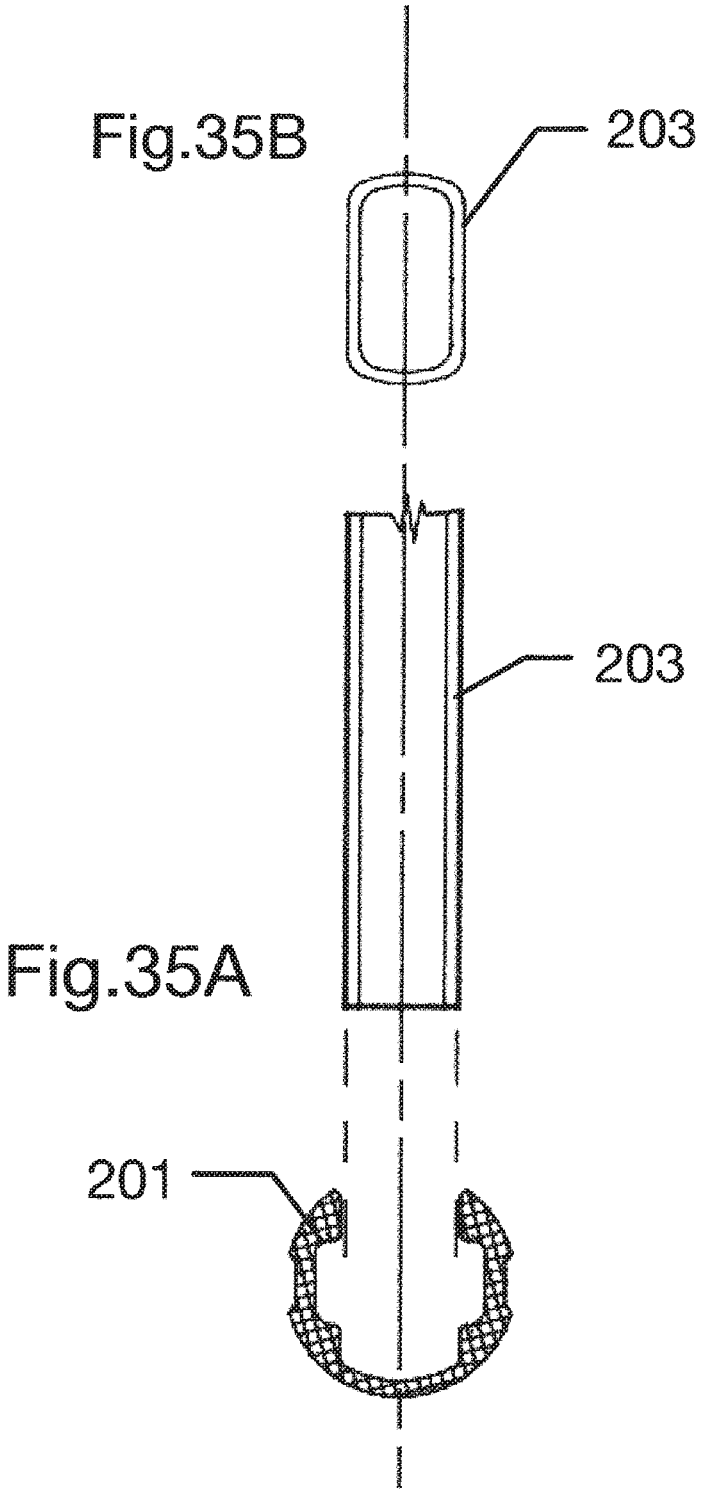
FIG. 35A is an end elevation of shapes of the prior Figures prepared for joining.
FIG. 35B is a rotated view and section of shape 203A in the prior Figure.
Figures 36A, 36B, 36C:
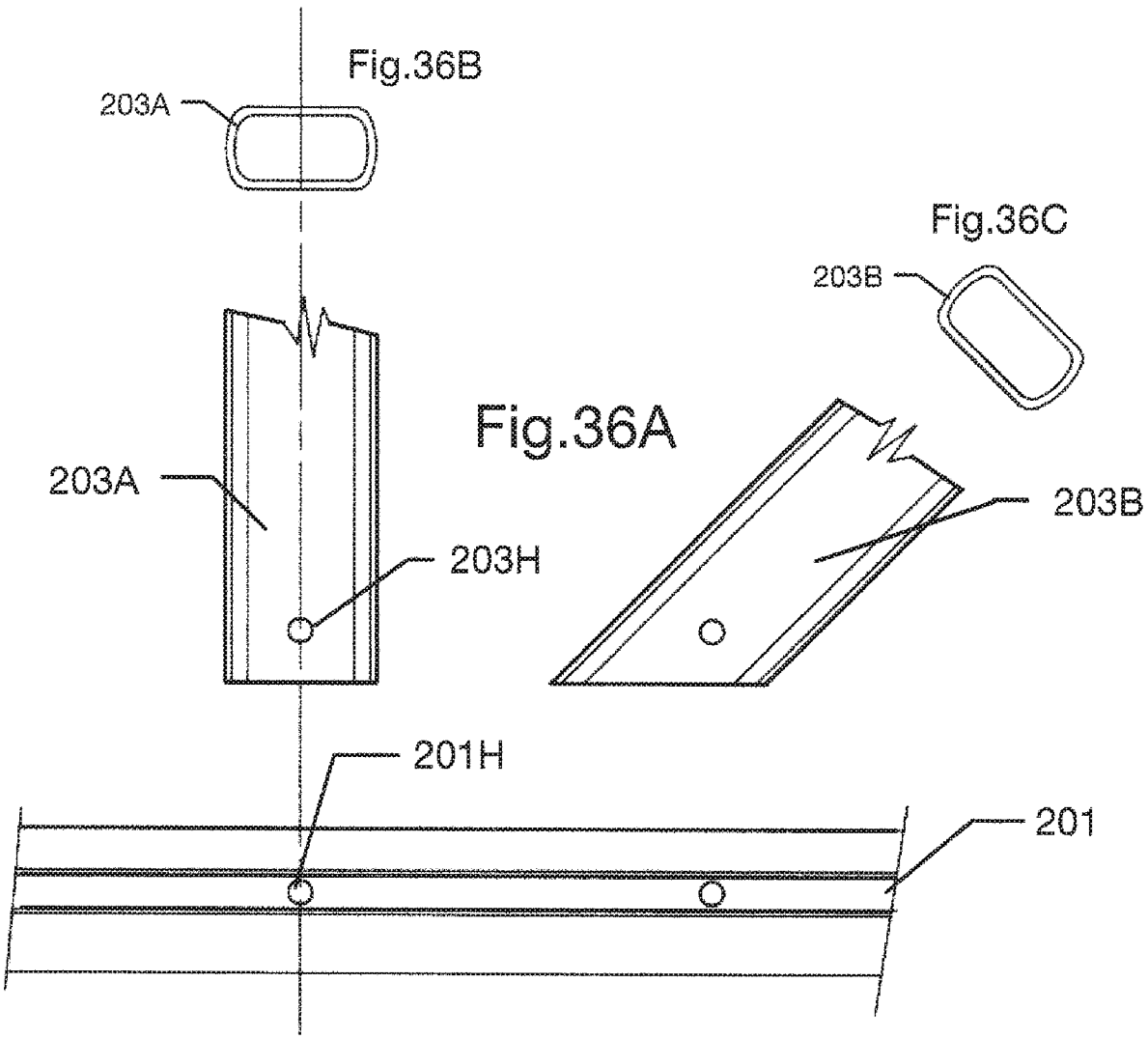
FIG. 36A is a side elevation of shapes of the prior Figures prepared for joining.
FIG. 36B is a rotated view and section of shape 203A in the prior Figure.
FIG. 36C is a rotated view and section of shape 203B in FIG. 36A.
Figures 37A, 37B, 37C, 37D:
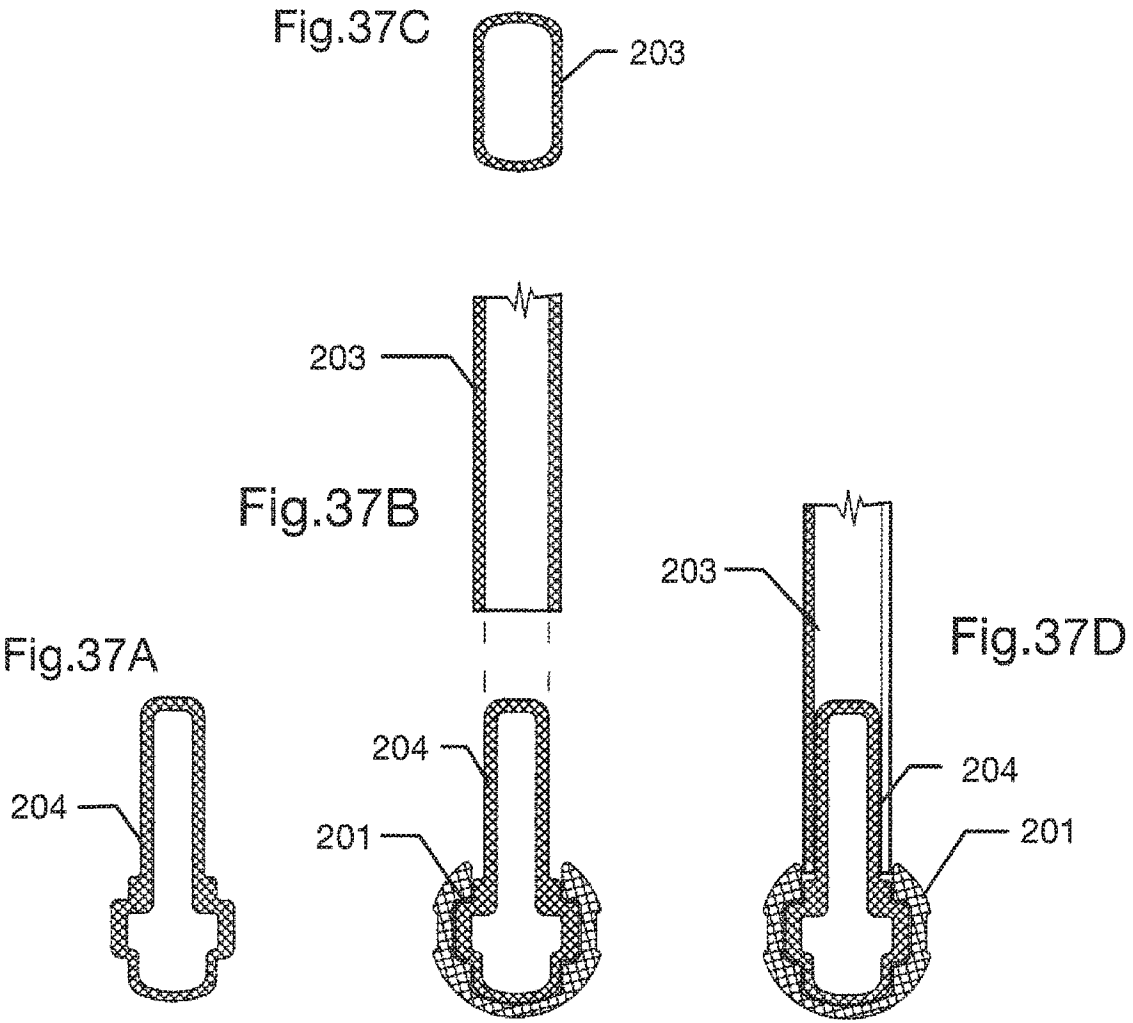
FIG. 37A is a section through one possible shape for a fitting that can be used in joining other shapes.
FIG. 37B is a section through the shapes of the prior Figure in the process of assembly.
FIG. 37C is a rotated view and section of shape 203 in the prior Figure.
FIG. 37D is a section through the shapes of the prior Figures as joined.

FIG. 32 illustrates the combination of a smartphone 892 and an interface unit 891 to connect with a device 890. Interface unit 891 can provide displays and controls to interact with device 890. Smartphone 892 offers an enhanced user interface, connectivity, storage, and computational resources.

FIGS. 33A and 33C illustrate an improved fixture design, which, with a non-halogen source, may accept a DMX or other signal for control. As illustrated in by exploded views, lenses may be inserted in fixture housing. A choice from a plurality of such lenses is illustrated in FIG. 33C.

Structures

Various Figures illustrate improved construction of structures, including those employed for support of lighting fixtures and other loads.

The applicant has previously disclosed various improvements in applications including 20040187426A1 and 20070193186A1, included in their entirety by reference.

FIGS. 34A-34F illustrate several structural shapes. "Basic Shape 1" 201 is generally circular and can be approximately 1.9" in diameter, when intended for uses with clamps and other hardware designed for 1½" Schedule 40 pipe and similar shapes. The basic shape includes at least one recess, sized in this example to accept at least a second structural member. Such a "Type 2" member can take many forms. One, illustrated, is a commonly available rounded corner rectangular shape 200; rolled, extruded, or otherwise formed.

Also illustrated in FIG. 34B is a "Plug" shape 202 designed to fill the recess in the Type 1 shape 201, and producing a substantially uniform, rounded cross section. One of several suitable details is illustrated to provide a "snap fit" of the plug shape when inserted. The plug shape 202 further extends into the Type 1 shape 201, such that pressure on the plug imposed by a clamp or hanger is distributed and does not dislodge the plug. A stiffening rib in the plug prevents its deformation under load.

A third example Type 2 "Member" shape 203 is also illustrated in FIG. 34C. Its profile is designed to serve as both a crossmember used to connect the basic/Type 1 shape 201 with other parts of a structure, and to also serve as a plug when (as illustrated in FIG. 34F) inserted lengthwise in the basic shape 201.

FIGS. 35A-B and 36A-C illustrate a preparation of shapes for assembly. Rectangular stock or a Type 2 profile is trimmed in the length required for its purposes, and their ends trimmed to generally correspond to the angle at which they intercept the Type 1 stock 201.

Cross members are inserted and retained. Mechanical fasteners can be employed, such as roll-pins. Mechanical attachment allows assembly without welding-related labor, strength reduction, shape distortion, or the limitation to metals and those alloys suitable for welding. Other materials and alloys, optimized for strength and other factors, can be employed—as well as different materials mixed in the same structure.

Bonding, welding or other attachment methods can (or can also) be employed.

Figure 38A:
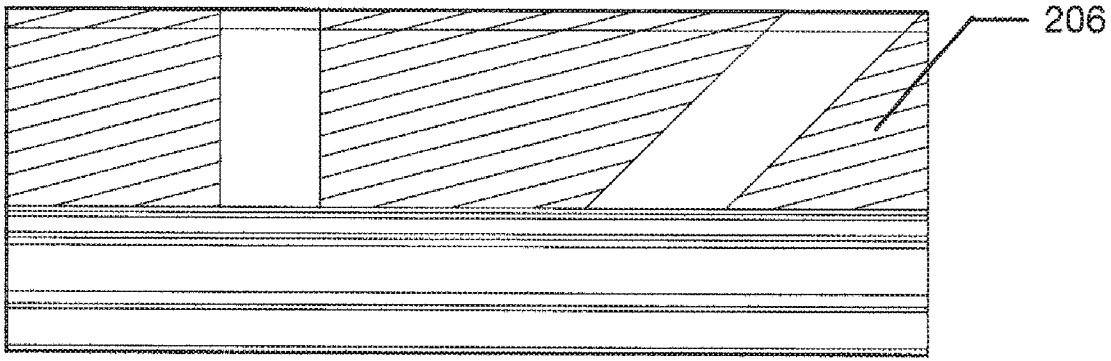
FIG. 38A is a side elevation of a feedstock from which fittings like those of the prior Figures can be fabricated.
Figure 38B:
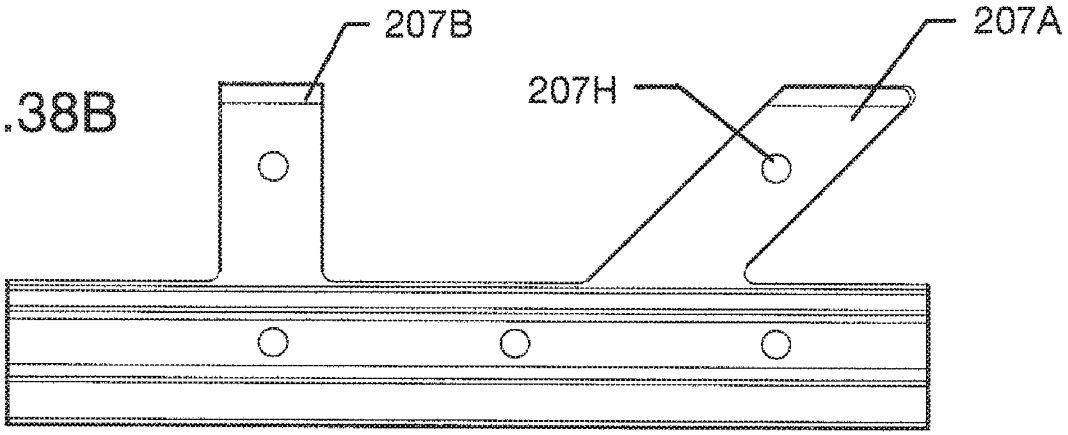
FIG. 38B is a side elevation of a fitting fabricated from the feedstock of the prior Figure.
Figure 39A:
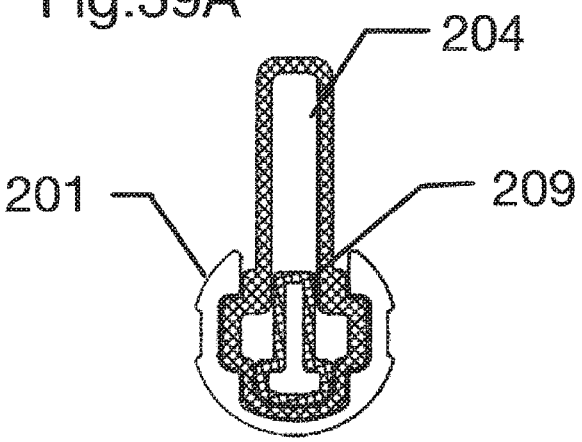
FIG. 39A is a section through a reinforced fitting produced from three shapes, including views of the fitting and reinforcing shapes.
Figure 39B:
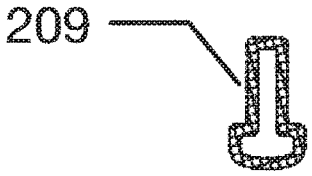
FIG. 39B is a section through a reinforcing shape as seen in FIG. 39A.
Figure 39C:
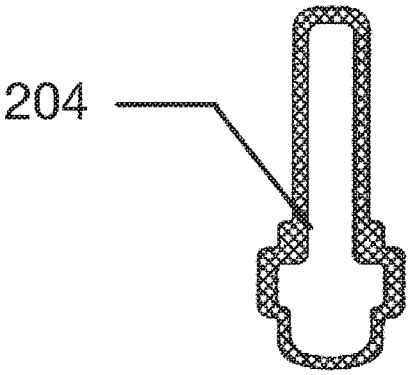
FIG. 39C is a section through the fitting shape as seen in FIG. 39A.

In addition to direct insertion, the connection between the Type 1 shape and a Type 2 member can be made using a fitting. FIGS. 37A-D illustrate one example of a "Type 3" shape 204 that inserts into a Type 1 interior 201 and into the Type 2 profile 203. FIGS. 38A and 38B illustrate one of many methods of producing such fitting, in this example, by milling an extruded shape 206 as necessary.

It should be noted that, importantly, different cross sections and/or section lengths of a structure require different spacings of the intersection/attachment of perpendicular and/or diagonal cross members in a structure (and of the intersection angles of the latter) to the elongated basic shapes. This requirement can be readily met, including by providing pass holes for fasteners (or other provisions) as required by the different requirements of multiple models/lengths in lengths of the basic structure's shape and/or in fittings (if employed), such that multiple specific models and lengths of structure can be assembled from the same stock with few or no additional, model-specific operations.

FIGS. 39A through 40E illustrate a system in which an additional element, "Type 4" 204, can be inserted through Type 3 fittings or forms 203, for purposes including spacing, reinforcement, and load distribution.

Figures 41A, 41B, 41C, 41D, 41E:
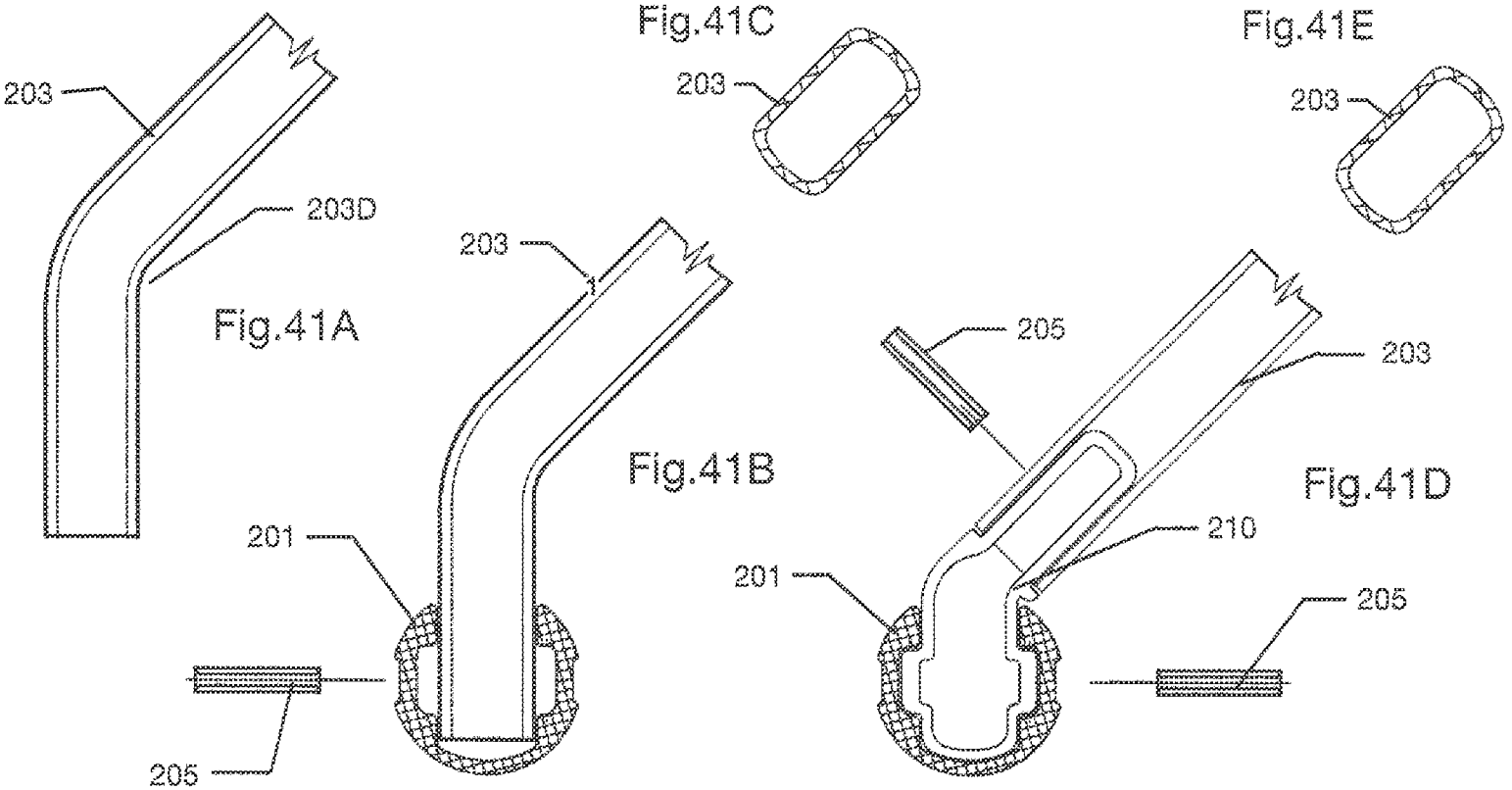
FIG. 41A is an end elevation of a shape with an integral bend.
FIG. 41B is an end elevation of the joining of the bent shape of the prior Figure with an elongated basic shape.
FIG. 41C is a view of the Type 2 203 member 203 of FIG. 41A
FIG. 41D is an end elevation of an alternative construction in which an angled intersection is provided by use of a fitting.
FIG. 41E is an enview of the 203 connector of FIG. 41D

Intersection/connections between the Type 1 shape 201 and cross members 203, with the latter in a plane rotated from that of the recess in the Type 1 shape 201 will be desired. FIGS. 41A through 41E illustrate two of several techniques for doing so. One example illustrated in FIGS. 41A-C is a bend 203D in the Type 2 member 203 itself. A second, Illustrated in FIGS. 41D and 41E is the use of a fitting 210 that incorporates an angular offset. In the case of a bend/angle formed in the cross member shape, it may be locally reinforced, for example, with additional material inserted.

Figure 42A:
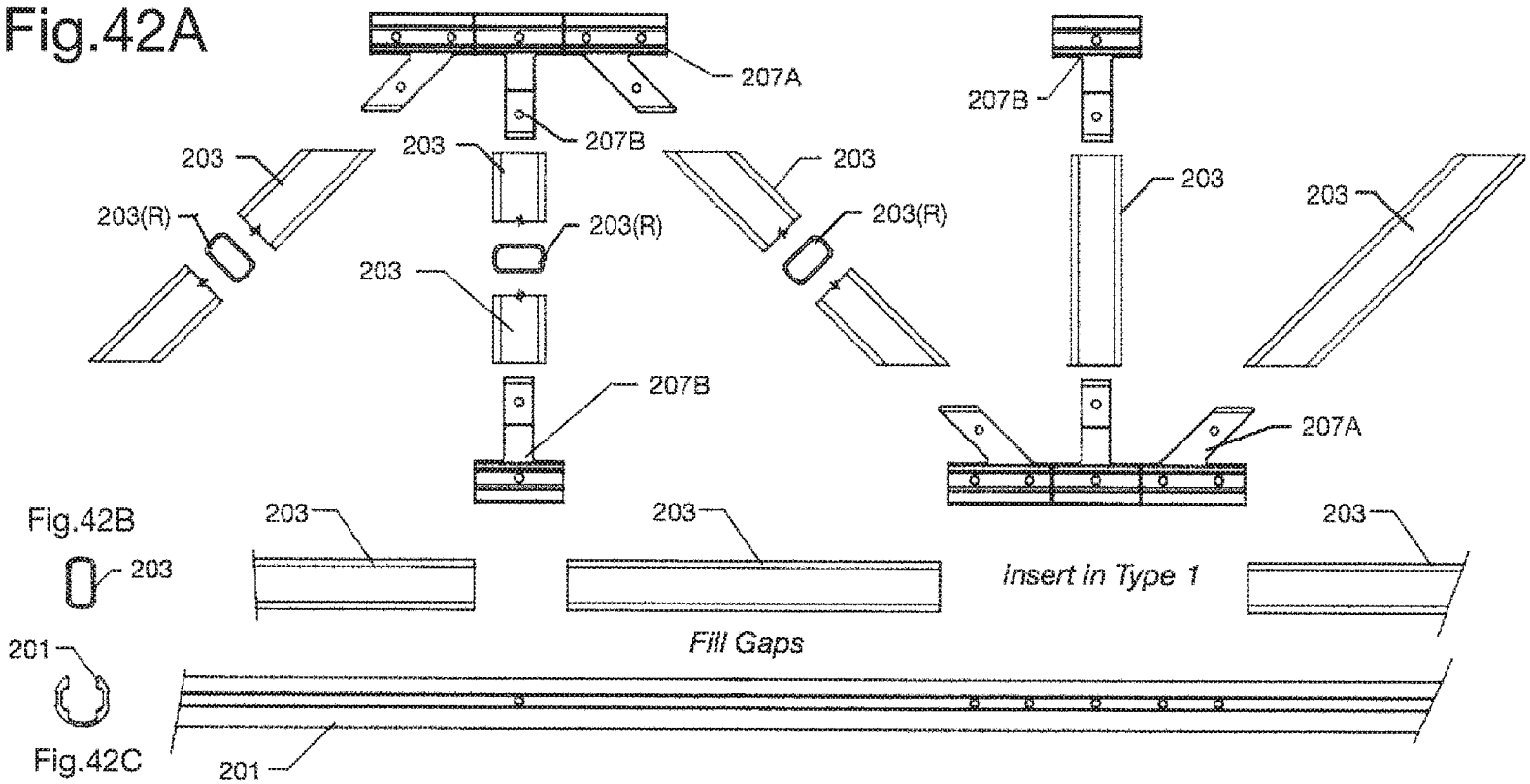
FIG. 42A is an exploded side elevation illustrating how various of the elements illustrated in the prior Figures can be assembled into a structure, with rotated sections of the various shapes.
Figure 43B:
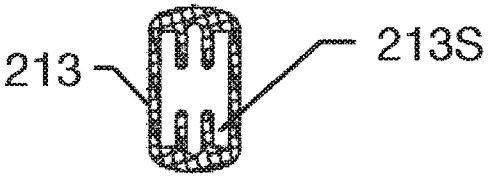
FIG. 43B is a rotated section of the crossmember shape of the prior Figure.
Figure 43A:
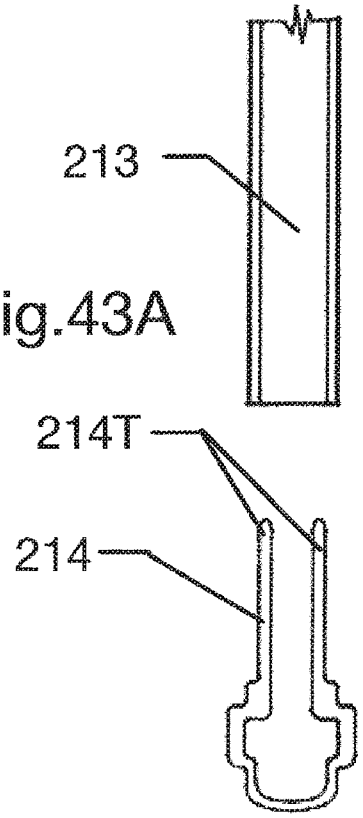
FIG. 43A is an end elevation of a crossmember shape and fitting having features that interlock.
Figure 43C:
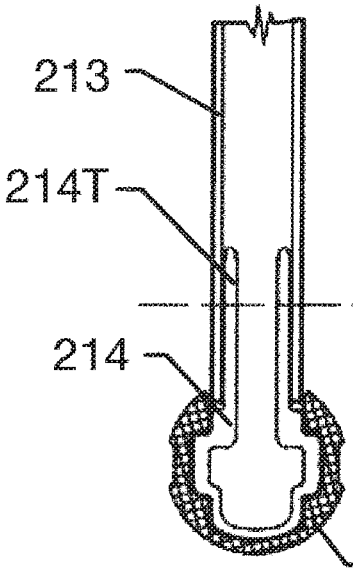
FIG. 43C is an end elevation of the shapes of the prior Figure joined.
Figure 43D:
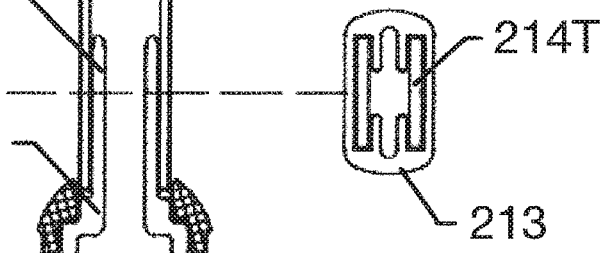
FIG. 43D is a rotated section through the assembled joint between the fitting and crossmember, illustrating the interlocking features.
Figure 44A:
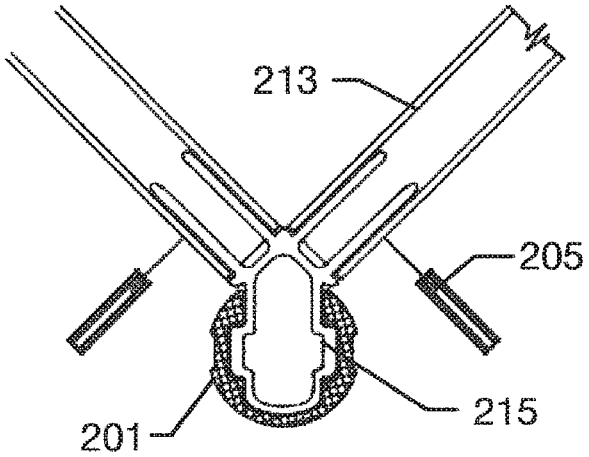
FIG. 44A is a section through an example fitting shape that joins two crossmember shapes to a common elongated basic shape.
Figure 44C:
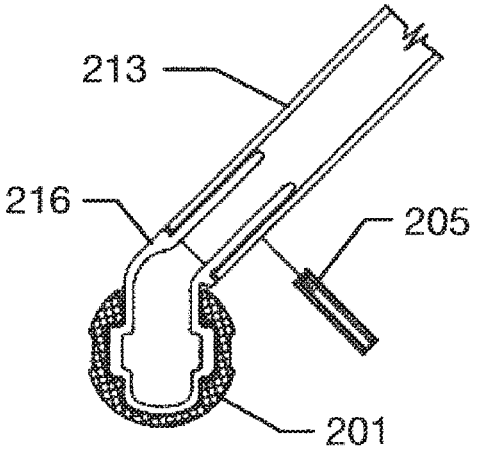
FIG. 44C is a section through an example fitting that joins a single crossmember shape to an elongated basic shape at an angle.
Figure 44B:
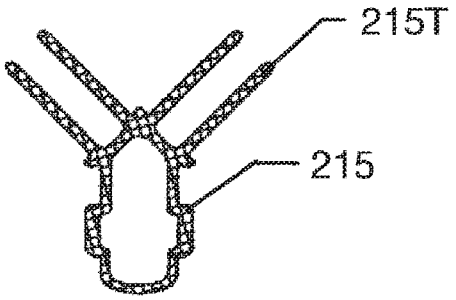
FIG. 44B is a section of a fitting shape as illustrated in the prior Figure.
Figure 44D:
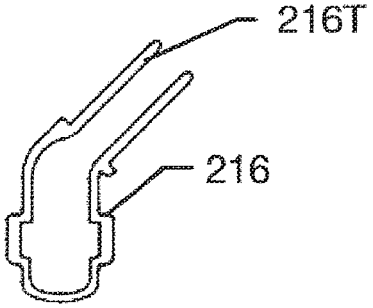
FIG. 44D is a view of a fitting shape as illustrated in the prior Figure.

FIG. 42A illustrates but one example of a combination of elements. The example portion of a structure might be a joist, truss side, or ledger in which two, often parallel, chords (one of them shown) are separated and stiffened by cross members, and with both right and diagonal intersections 207. A Type 1 shape 201 is shown, along with Type 2 cross members 203 and (in this example) fittings. If desired, Type 2 plug or (here) cross member stock 203 can be inserted in the recess in the Type 1 shape 201 to fill those portions between cross members and fittings, for purposes including the better accommodation of clamps and hardware, stiffening, and/or appearance.

Many designs for fittings are possible. FIG. 43A through 44D illustrate fittings 214 having projections 214T that engage an internal detail 213S in the cross member 213.

In FIGS. 45A-C and 46A-C, flat plates are employed, rather than a dimensional fitting. Spacers 219 and 220 are sandwiched between the plates 217 and 218 and 220 and 221. In this example, but it will be apparent that the plates might also engage an internal detail in the cross member as illustrated in the prior Plates, as well as that a single shape might be formed in an open or closed dimensional shape.

Stacked stampings can be used in fittings and in assembly.

Figure 47A:
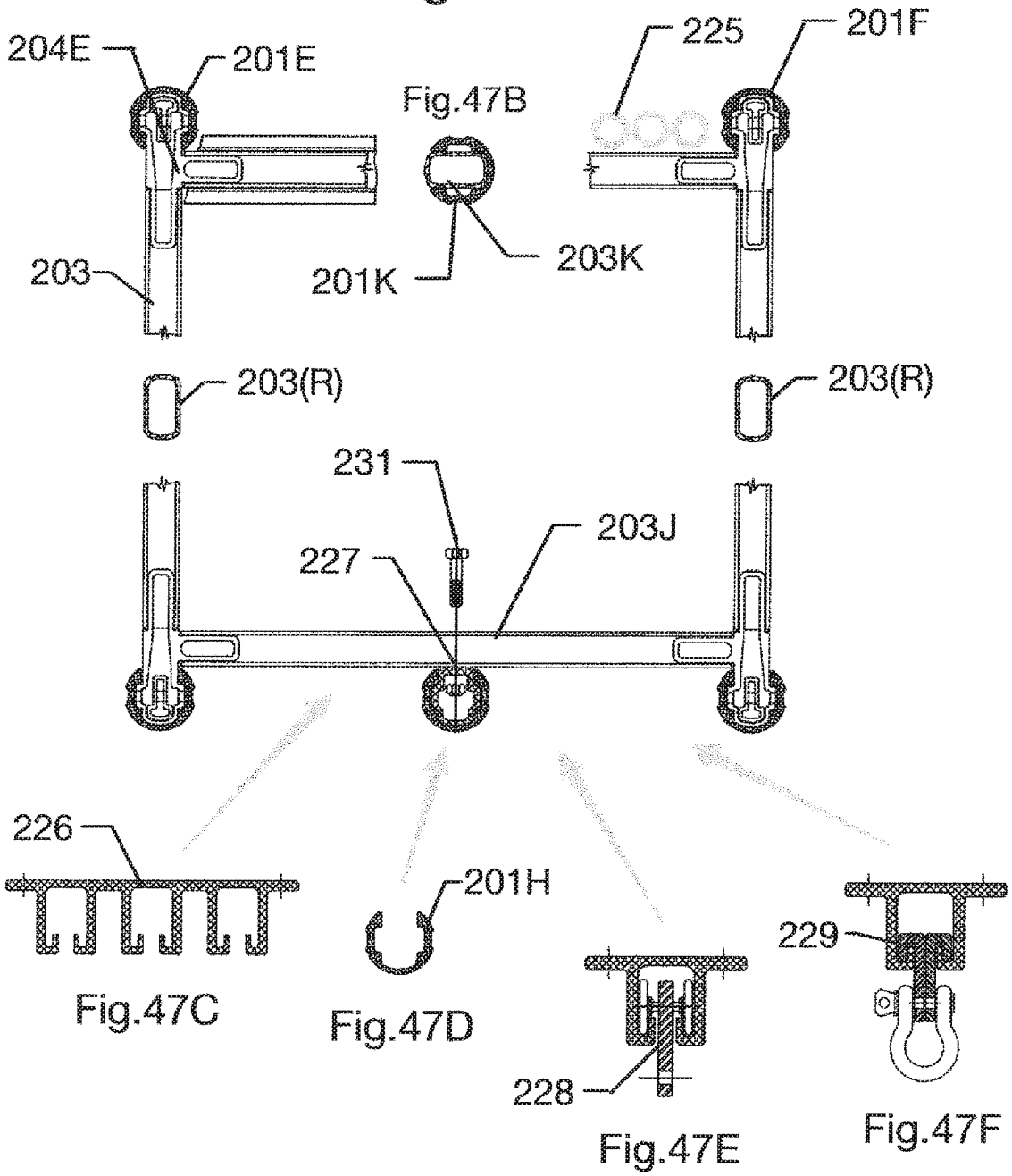
FIG. 47A is a section through a dimensional truss structure employing the elements illustrated in the prior Figures, illustrating various features, including additional elements to adapt the structure for specific functions.

FIG. 47A is a cross section of a dimensional truss as assembled from several of the components illustrated in the prior Figures. Where desired, cross members can have Type 1 shapes attached to increase their cross section, for added stiffness and/or to permit ready attachment of hangers and attachments (e.g., 201K and 203K seen in section in FIG. 47B). Members in the "top" face of the truss illustrated are recessed, which prevents power and control cables 225 laid across them from falling off or requiring taping or tying down. Recessing in the nominal "bottom" allows accommodating optional "traveler track" 226 and other shapes 228 and 229 for the support and movement of draperies and other loads. Where desired, additional members in the nominal "bottom" can be disposed in the same plane as the Type 1 members for the support of loads, such as shape 201H, also seen in FIG. 47D, attached by means of fitting 227 and bolt 228 to crossmember 203J.

Larger structures often require joining sections. Various techniques are known. In the case of portable trusses, bolting and clevis methods are the common.

FIGS. 48A through 48F illustrate one alternative construction of elongated structural elements. An elongated shape 241, seen in FIG. 48B, can be attached to both sides of another shape to form a suitable structural element. In FIG. 48D, shape 242 of FIG. 48C is employed. In FIG. 48F, shape 203 as seen in FIG. 48E and other prior Figures. Shape 241 might also be used with shape 200 of FIG. 48A and other Figures.

Sandwiches of multiple shapes can be used for any element. Openings/receivers for mechanical fasteners can be extruded in a shape.

FIGS. 49A-I and 50A-D illustrate other improvements, in examples employing some of the structural elements disclosed herein.

A "corner detail" 250 is illustrated, which may be cast and/or machined or otherwise produced. As illustrated in the Figures, a fitting 207 is illustrated that attaches to the corner detail 250, to the elongated basic shape 250, and, if desired, for strength, to at least one diagonal cross member 203D. (The length of the fitting between the intersection (if any) of a cross member (diagonal or otherwise), terminating at the elongated shape, and can be varied as required by the structure's specifics design, including by trimming a basic fitting design to the required length.)

Both bolting and clevis provisions are offered for joining structures including the corner detail with other structures.

Bolt holes and optional floating/sliding plates replacing the need for washers or a nut for bolted connections are described in a prior application.

A clevis detail is illustrated, in which a recess in the corner detail 250 accepts a "link" 255, which may be captivated in one corner detail for shipping. The shape of the link 255 and the recess brings two structures into alignment when pushed together, which simplifies bolting (if used) or insertion of a pin (or bolt) through the hole 250H in the corner detail for a clevis-type connection.

In the illustrated embodiment, the corner detail 250 is provided with recesses to accept and connect with cross members and fitting 207.

Adaptors can also be employed to mate sections with the clevis systems of other structure designs.

FIGS. 51A through 51G illustrate another approach to the intersection of Type 1 stock and cross members. Here, the basic shape 261 is an essentially radially continuous one, whether circular or other. As and where desired, for cross member intersections and a "slot" 261S is opened in a portion of the basic shape's profile, including to admit the cross member into the interior volume of the basic shape. In the example, buttressing details for the cross member are provided in the interior.

Improved Truss Profile

The structural elements and techniques such as those disclosed can be used in a variety of applications, including but not limited to truss and similar structures.

Trusses and other structural forms to support loads, as well as components in roof systems, platforms, scaffolding, scenery, display booths, and many other applications have not only been of near identical materials and fabricating techniques, but in generic forms.

Truss sections, as manufactured by companies like James Thomas Engineering, Tomcat, and Total Fabrication, to name just a few, are most commonly sold and used in standard lengths and cross sections/profiles. The most common type is "20.5", with "12×12" also popular. Both are square in cross section and, as illustrated in FIGS. 56B and 56D, when stored or transported, consume a volume equal to their envelope, at considerable cost. It has long been a desirable object to reduce the storage and shipping volume of trusses, relative to their cross section in use.

Refer now to FIG. 52, where is illustrated in simple form, a cross section offering dramatic reductions in storage and shipping volume, with functionality and strength comparable to popular present types.

Unlike most prior art truss profiles, the disclosed profile has five, not four, parallel elongated main chords, intended for the potential support of loads. Four of the five chords define a volume, the spacing between two chords being different than the spacing of two other such chords. Here, chords 301 and 302 are spaced substantially farther apart than chords 303 and 304. A fifth chord 305 is substantially contained within the volume defined by the other four. In one preferred embodiment the spacing between the two more widely spaced chords is similar to the chord spacing of known "20.5" truss. The two more closely spaced chords are spaced substantially the same distance apart as those of known "12×12" truss. (Both truss profiles are illustrated for comparison in FIGS. 56B and 56D.)

Crossmembers connect one each of a widely spaced chord with a less widely spaced chord on each side, those in the same plane as 311 connecting chords 301 and 304; those in the same plane as 312 between 302 and 303. Similarly, crossmembers 312 and 313 connect the less widely spaced chords 303 and 304 with central chord 305.

Where indicated, known "snap braces" or "stiffeners" can be used to stiffen the shape by connection between two chords. For example, chord 301 and 302, and/or chords 303 and 304, as well as chord 305 with one or the other of chords 301 or 302.

It will be seen that the illustrated truss 30 can be used with the wider face up or down. This affords chords at either one of two spacings. The top chords can, for example, hang masking to conceal the truss itself and loads hung from the lower chord.

As seen in FIGS. 553A and 54A, the central chord 305 can be located either substantially within the volume defined by the outer chords, in the same plane as the two more widely spaced chords, or beyond the plane formed between them. The central chord has many practical advantages, including as a point of attachment for loads centered under the truss.

Another benefit of the disclosed profile is that the load capacity of the truss is substantially determined by the overall cross section, but storage and shipping volume is dramatically reduced because the sections nest when stacked, resulting in the reduction of volume illustrated by the equal-scale comparison in FIG. 56A-D of the volume requirements of ten sections of "20.5" truss 20; "12×12" truss 12; and truss 30 with the disclosed profile.

FIGS. 55A and 55B illustrate one variant in which permanent stiffeners 316 are installed at one end of the truss section (here terminated in known clevis fittings, e.g. 381F) and ends offset so that the permanent stiffeners do not interfere with stacking.

FIG. 55B is a side elevation of a typical truss section, here showing the offset required to accommodate the permanent stiffeners 316.

Importantly, the structural elements and techniques disclosed in the instant application can be used in fabricating truss of the improved profile. One benefit is that the components, materials, and joining techniques can be optimized to form an engineered structure of maximum performance.

The scope of the inventions herein should not be understood as limited except by the issue claims.

What is claimed is:

1. Apparatus for controlling the average power supplied to a plurality of lamp loads, comprising:

an enclosure, said enclosure suitable for locating in proximity to said lamp loads, a multi-pole connector of a nineteen contact configuration, said multi-pole connector connected to said enclosure, said enclosure having provisions to accept an alternating current supply, at least six semiconductor power stages each capable of varying the average power supplied to a lamp load and having at least one ramped transition between one and another of substantially conducting and non-conducting conditions, each of said power stages being connected between said alternating current supply and said multi-pole connector, said power stages capable of responding to control values produced external to said enclosure.

2. Apparatus according to claim 1 wherein said provisions to accept can adapt to a plurality of different power input configurations.

3. Apparatus for controlling the average power supplied to a plurality of lamp loads, comprising:

an enclosure, said enclosure suitable for locating in proximity to said lamp loads, a multi-pole connector of a nineteen contact configuration, said multi-pole connector connected to said enclosure, said enclosure having provisions to accept alternating current, at least six semiconductor power stages, each of said power stages being connected between said alternating current accepted and said multi-pole connector, capable of varying the average power supplied to a lamp load responsive to a control value generated external to said enclosure, and having at least one duration-extended transition between one and another of substantially conducting and non-conducting conditions, said provisions for accepting alternating current providing for selecting among a plurality of different power connector configurations.

4. Apparatus according to claim 3, said power connector configurations including a second multi-pole connector of a nineteen contact configuration.

5. Apparatus according to claim 3, said power connector configurations including a multi-phase connector.

6. Apparatus according to claim 3, said power connector configurations including a plurality of single phase power connectors.

* * * * *